US007029006B2

(12) United States Patent
Izumi et al.

(10) Patent No.: US 7,029,006 B2
(45) Date of Patent: Apr. 18, 2006

(54) SHEET FEEDING APPARATUS AND IMAGE FORMING APPARATUS

(75) Inventors: Makoto Izumi, Shizuoka (JP); Yasuhiro Uchida, Shizuoka (JP); Masaru Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 10/601,529

(22) Filed: Jun. 24, 2003

(65) Prior Publication Data

US 2004/0041333 A1 Mar. 4, 2004

(30) Foreign Application Priority Data

Aug. 29, 2002 (JP) ..... 2002-251859
Dec. 27, 2002 (JP) ..... 2002-380820

(51) Int. Cl.
*B65H 1/00* (2006.01)

(52) U.S. Cl. ..... 271/145; 271/157; 399/114; 399/124

(58) Field of Classification Search ..... 271/157, 271/145, 147, 152; 399/114, 124, 90, 411
See application file for complete search history.

(56) References Cited

U.S. PATENT DOCUMENTS

| | | | | |
|---|---|---|---|---|
| 4,466,604 | A * | 8/1984 | Kishimoto et al. | 271/111 |
| 4,556,210 | A * | 12/1985 | George | 271/157 |
| 5,123,637 | A * | 6/1992 | Musaka | 271/117 |
| 5,765,826 | A | 6/1998 | Isoda et al. | 271/162 |
| 5,995,773 | A * | 11/1999 | Awano | 399/21 |
| 6,523,821 | B1 | 2/2003 | Kashiwagi et al. | 271/145 |
| 6,647,223 | B1 * | 11/2003 | Ishii | 399/90 |
| 2002/0081124 | A1 | 6/2002 | Kuwata et al. | 399/107 |
| 2003/0057634 | A1 | 3/2003 | Matsushima et al. | 271/117 |
| 2003/0080497 | A1 | 5/2003 | Matsushima et al. | 271/171 |

FOREIGN PATENT DOCUMENTS

JP 2001-310829 11/2001

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

A sheet feeding apparatus main body for containing sheets in the inside thereof includes: a first cover and a second cover which are openable and closable; and a detecting sensor for detecting an opening and closing of the first cover. The detecting sensor does not detect closing of the first cover when the first cover is closed in a state in which the second cover is opened and detects closing of the first cover when the first cover is closed in a state in which the second cover is closed.

7 Claims, 39 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding sheets to a printer, a copier, etc., and an image forming apparatus provided with the sheet feeding apparatus.

2. Related Background Art

In a conventional image forming apparatus such as a printer or a copier, it is required to contain a large number of sheets on each of which an image is formed, along with higher speed operation of the image forming apparatus. However, there is a limit in increasing a capacity for containing sheets because, if a capacity for containing sheets in an image forming apparatus main body is increased, the image forming apparatus main body is enlarged. Thus, an image forming apparatus has been proposed which is provided with a sheet feeding apparatus on a side surface of the image forming apparatus main body other than a sheet cassette mounted in the image forming apparatus main body, thereby realizing increase in a capacity for containing sheets. An example of such an image forming apparatus is described in Japanese Patent Application Laid-Open No. 2001-310829.

FIG. 40 is a perspective view for explaining a sheet feeding apparatus described in Japanese Patent Application Laid-Open No. 2001-310829.

In the figure, reference numeral 900 denotes an image forming apparatus main body which forms an image on a sheet according to, for example, an electrophotographic process, and 901 denotes a sheet feeding apparatus which is disposed on a side surface of the image forming apparatus main body 900. An upper door 940 is constituted so as to open and close around a horizontal shaft 941 provided in the vicinity of the image forming apparatus main body 900 and form an opening on an upper surface side of the sheet feeding apparatus 900, that is, above a sheet mounting stand 910.

First and second upper door detection switches 943 and 944, which detect an opened/closed state of this upper door 940, are attached to an upper edge on a front surface side of the opening formed by this upper door 940. Detected pieces 943*a* and 944*a*, which press these two upper door detection switches 943 and 944 when the upper door 940 is closed, are provided on a lower surface of the upper door 940.

A side door 950 is constituted so as to open and close around a vertical shaft 951, which is provided at a side edge on a side opposite to the image forming apparatus main body 900, and form an opening on a side surface side of the sheet feeding apparatus 901 on the opposite side of the image forming apparatus main body 900, that is, besides the sheet mounting stand 910.

In addition, first and second side door detection switches 953 and 954, which detect an opened/closed state of this side door 950, are attached to a side edge on a front surface side on a side surface side of the opening formed by this side door 950. Detected pieces 953*a* and 954*a*, which press these two side door detection switches 953 and 954 when the side door 950 is closed, are provided on an inner side surface of the side door 950.

However, as in such a conventional sheet feeding apparatus, if a plurality of sensors such as the upper door detection switches 943 and 944 and the side door detection switches 953 and 954 for detecting an opening and closing of doors are provided in association with the upper door 940 and the side door 950, respectively, costs for the sheet feeding apparatus including an arithmetic controller unit increase. In addition, in the case in which an opened/closed state of the upper door 940 and the side door 950 is judged by the plurality of sensors, reliability of the sheet feeding apparatus falls.

SUMMARY OF THE INVENTION

The present invention has been devised in view of such a present situation, and it is an object of the present invention to provide a sheet feeding apparatus, which can detect the closing of two doors with one sensor (detecting sensor), and an image forming apparatus provided with the same.

In order to attain the above-mentioned object, according to the present invention, there is provided a sheet feeding apparatus for containing sheets in the inside thereof, including: a first cover and a second cover which are provided in an apparatus main body so as to be openable and closable; and a detecting sensor for detecting the opening and closing of the first cover, in which the detecting sensor does not detect the closing of the first cover when the first cover is closed in a state in which the second cover is opened and detects the closing of the first cover when the first cover is closed in a state in which the second cover is closed.

DETAILED DESCRIPTION OF THE PREFERRED EMBODIMENTS

Embodiments of the present invention will be hereinafter described in detail with reference to the accompanying drawings.

First Embodiment

Figure 1:
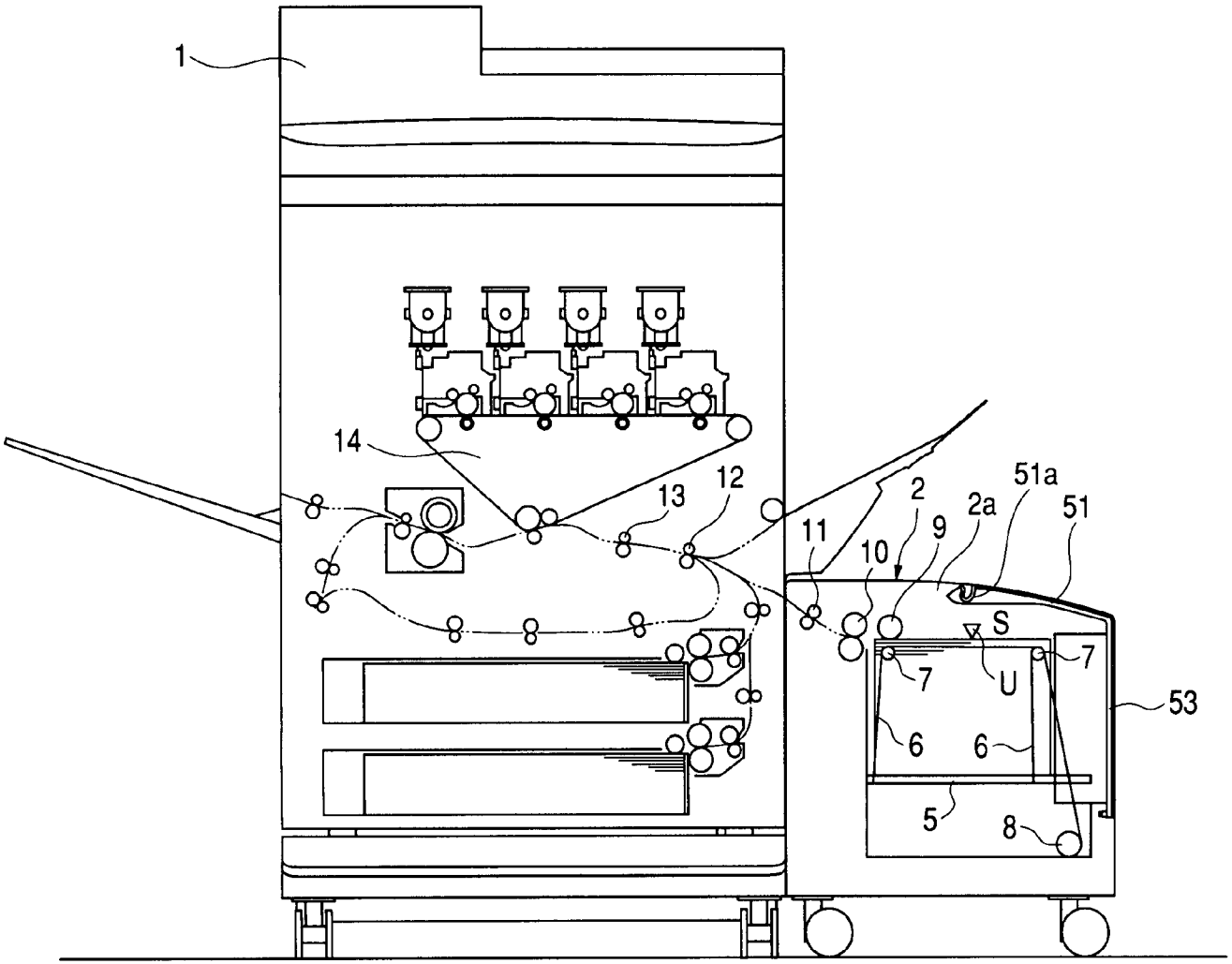
FIG. 1 is a sectional view of an image forming apparatus and a sheet feeding apparatus of a first embodiment and shows a state in which a cover is closed.
Figure 2:
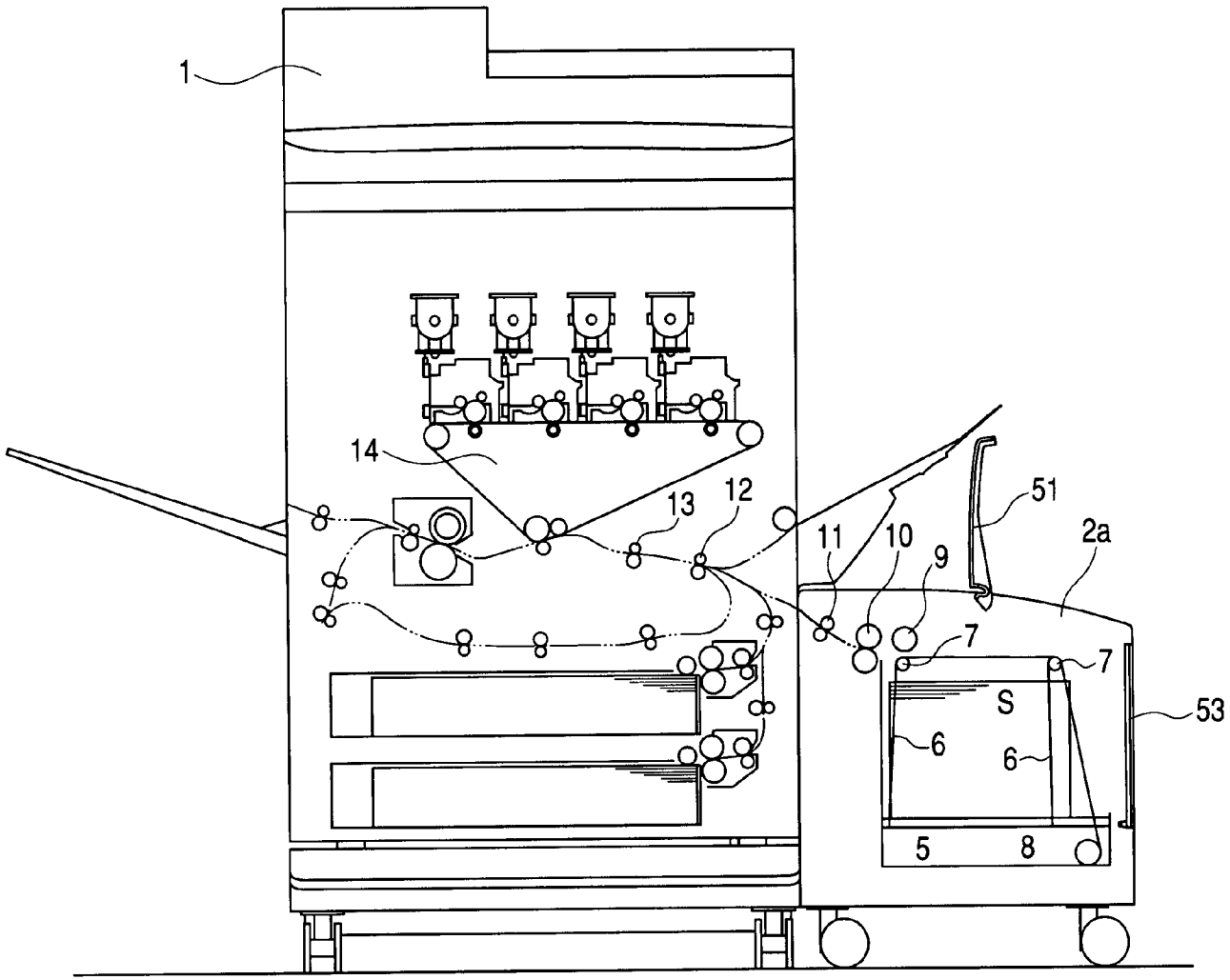
FIG. 2 is a sectional view of the image forming apparatus and the sheet feeding apparatus of the first embodiment and shows a state in which only an upper cover of the sheet feeding apparatus is opened.
Figure 3:
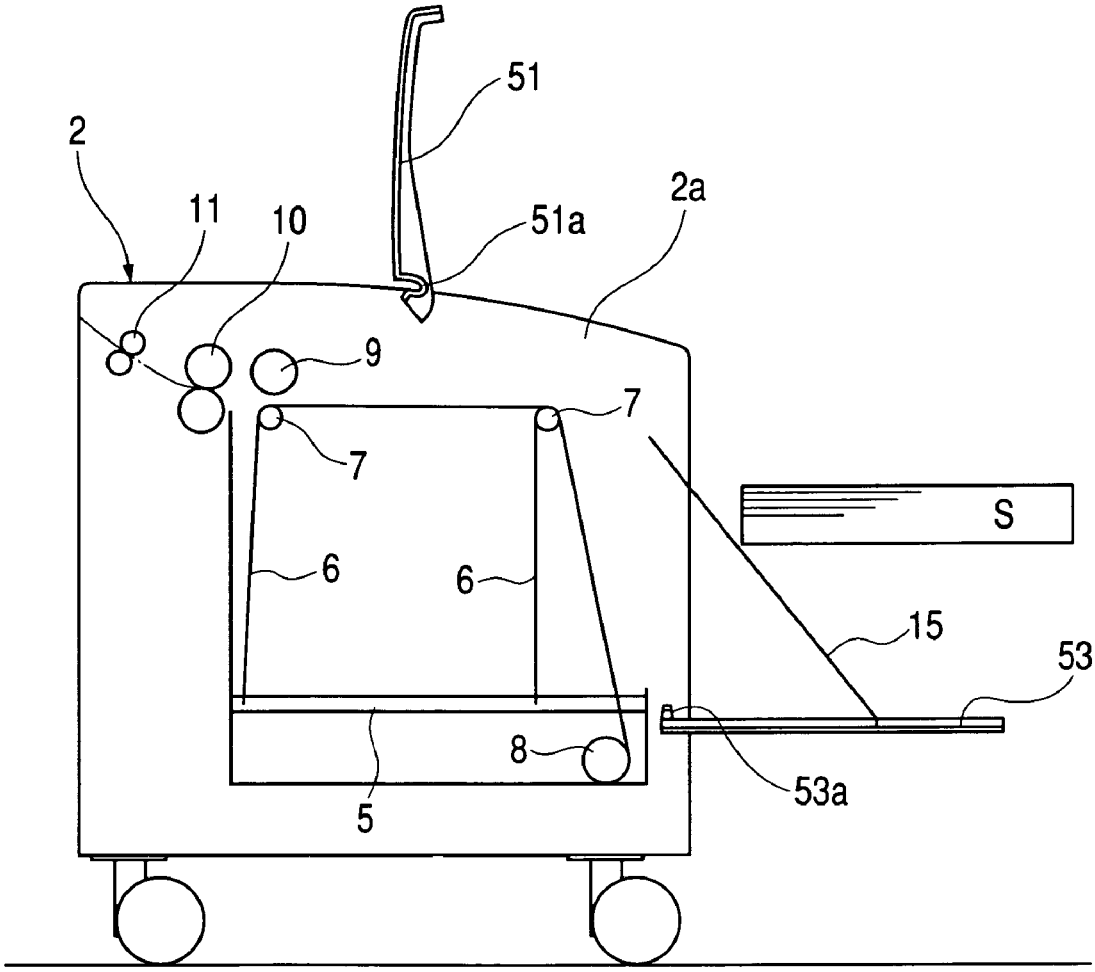
FIG. 3 is a sectional view of the sheet feeding apparatus of the first embodiment and shows a state in which the upper cover and a side cover of the sheet feeding apparatus are opened.

Details of an image forming apparatus adopting a first embodiment and a sheet feeding apparatus therefor will be described with reference to FIGS. 1 to 9. Note that the figures are sectional views of the image forming apparatus in accordance with the first embodiment and the sheet feeding apparatus for the image forming apparatus. FIG. 1 is an explanatory view showing a state in which a cover, which also serves as an armor cover, of the sheet feeding apparatus is closed. FIG. 2 is an explanatory view showing a state in which an upper cover of the sheet feeding apparatus is opened. FIG. 3 is a sectional explanatory view showing a state in which the upper cover and a side cover of the sheet feeding apparatus are opened.

In the figures, reference numeral 1 denotes an image forming apparatus main body; 2, a sheet feeding apparatus; 51, an upper cover; 53, a side cover; and 5, a sheet tray.

Overall Structure

First, schematic structures of the sheet feeding apparatus and the image forming apparatus will be described. The sheet tray (sheet support means) 5 in the sheet feeding apparatus 2 is raised and lowered by elevating means. That is, the sheet tray 5 is suspended from a wire 6 via a pulley 7 and is raised as the wire 6 is wound by a winding drum 8 in the state in which the cover is closed as shown in FIG. 1. A height of the sheet tray 5 is controlled by sheet surface detecting means U and a controller such that an optimum height is maintained allowing an upper most sheet of a sheet stack S on the sheet tray 5 to be fed by a feeding roller 9 and enter a nip of a separation roller pair 10 smoothly. This sheet feeding apparatus 2 is coupled to the image forming apparatus main body 1 by coupling means (not shown) provided in the image forming apparatus main body 1. Note that sheet feeding means of the present invention is constituted by the feeding roller 9 and the separation roller pair 10.

When the sheet feeding apparatus 2 receives a feeding signal from the image forming apparatus in the above-mentioned state, an uppermost sheet of the sheet stack S is fed by the sheet feeding means. That is, the sheet stack S is fed by the feeding roller 9 and separated by the separation roller pair 10 to be fed one by one into the image forming apparatus main body 1 by a conveying roller 11.

The sheet S fed from the sheet feeding apparatus 2 is conveyed to image forming means 14 by a conveying roller 12 and a registration roller 13 where an image is recorded on the sheet S.

The image forming means 14 in this embodiment adopts the electrophotographic process, and a photosensitive member and a developing device are mounted on the image forming apparatus main body 1. Then, when the sheet S is conveyed to the image forming means 14, synchronizing with the conveyance of the sheet S, the image forming means 14 applies irradiation of light from a laser scanner on a photosensitive drum according to an image signal to thereby form a latent image. The latent image is then visualized by being subjected to toner development in the developing device. The toner image of the latent image thus formed is transferred onto the sheet S according to bias application to a transfer roller and the sheet S is conveyed to fixing means to have the toner image thermally fixed thereon. Thereafter, the sheet S is discharged to a discharge tray by a discharge roller.

Jam Treatment

The sheet feeding apparatus 2 has an upper cover 51 serving as a first cover of the present invention and a side cover 53 serving as a second cover of the present invention. The upper cover 51 and the side cover 53 are attached to a sheet feeding apparatus main body 2*a* so as to be openable and closable with an upper cover pivotal fulcrum 51*a* and a side cover pivotal fulcrum 53*a* as pivotal centers, respectively.

In the case in which jam occurs inside the sheet feeding apparatus 2, as shown in FIG. 2, a user opens the upper cover 51 upward, the cover allowing an upper opening serving as a first opening to be opened and closed.

Supply of Sheets

In the case in which there is no print sheet in the sheet feeding apparatus 2, as shown in FIG. 3, the user opens the upper cover 51 upward and, at the same time, opens the side cover 53 sideways, the side cover allowing a side opening serving as a second opening to be opened and closed. Note that the upper opening and the side opening are continuous and, when both the upper cover 51 and the side cover 53 are opened, an opening continuous from an upper part to a side part of the sheet feeding apparatus 2 is opened.

The side cover 53 is held so as to be substantially horizontal by a wire 15 whose one end is fixed to a frame body of the sheet feeding apparatus 2 (as shown in FIG. 3). In this state, since a space sufficient for stacking the sheet stack S on the sheet tray 5 is lowered to a lowermost part, the user can easily stack a sheet stack on the sheet tray 5.

Figure 4:
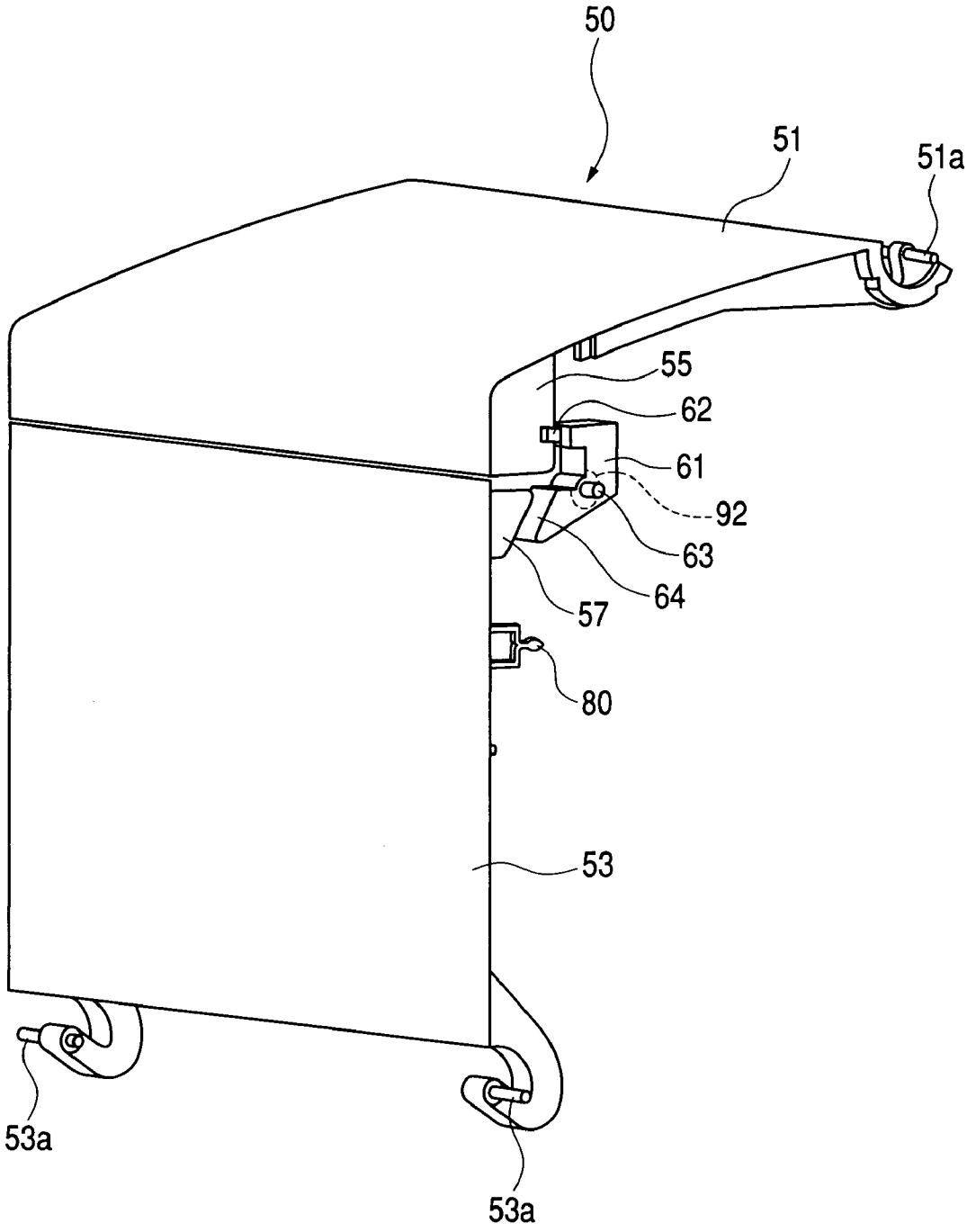
FIG. 4 is a perspective view showing a structure of a cover section of the sheet feeding apparatus in accordance with the first embodiment.

FIG. 4 is a perspective view showing a structure of a cover section of the sheet feeding apparatus 2.

In the figure, reference numeral 62 denotes a cover detecting sensor serving as a detecting sensor, and 61 denotes a sensor attachment stand serving as a holding member for holding the cover detecting sensor 62. This sensor attachment stand 61 is attached to the sheet feeding apparatus main body 2*a* so as to be pivotable (movable) with a pivotal support shaft 63 as a fulcrum and in a state in which it is biased to the side cover side by a biasing spring 92 serving as biasing means.

Here, this cover detecting sensor 62 is a photo-interrupter having a slit portion. As described later, when the upper cover 51 is closed, a flag 55 provided on the upper cover 51 is inserted in this slit portion, and the cover detecting sensor 62 comes into a light shielding state. In addition, this cover detecting sensor 62 is connected to a controller (not shown) and, when the cover detecting sensor 62 comes into the light shielding state, this controller judges that the upper cover 51 and the side cover 53 have been closed.

Reference numeral 57 denotes a side cover projected portion integrally provided in the side cover 53, and 64 denotes a bumping portion provided at a side edge of a side cover of the sensor attachment stand 61. This bumping portion 64 is provided in a position where it abuts against the side cover projected portion 57 in a state in which the side cover 53 is closed. Note that reference numeral 80 denotes a locking projection for locking a locking portion provided in a sheet feeding apparatus main body (not shown) to hold the side cover 53 in a closed state.

Next, detection of the opening and the closing of the upper cover 51 and the side cover 53 in the cover section constituted as described above will be described. Note that, in this embodiment, in the case of opening the upper cover 51 and the side cover 53 for supply or the like of the sheets S, the side cover 53 is opened after an opening of the upper cover 51. In the case of closing the upper cover 51 and the side cover 53, the upper cover 51 is closed after the closing of the side cover 53.

The state shown in FIG. 4 is a state in which the upper cover 51 and the side cover 53 are closed. In this case, the bumping portion 64 on the sensor attachment stand 61 is in abutment against the side cover projected portion 57. In addition, the flag 55 of the upper cover 51 (hereinafter referred to as upper cover flag) is inserted in a slit portion (not shown) of the cover detecting sensor 62 to bring the cover detecting sensor 62 into a light shielding state. Consequently, the controller judges that the upper cover 51 and the side cover 53 are in the closed state. In this way, the cover detecting sensor 62 is turned ON/OFF according to insertion or non-insertion of the upper cover flag 55, whereby the opening and closing of the upper cover 51 is detected.

Figure 5:
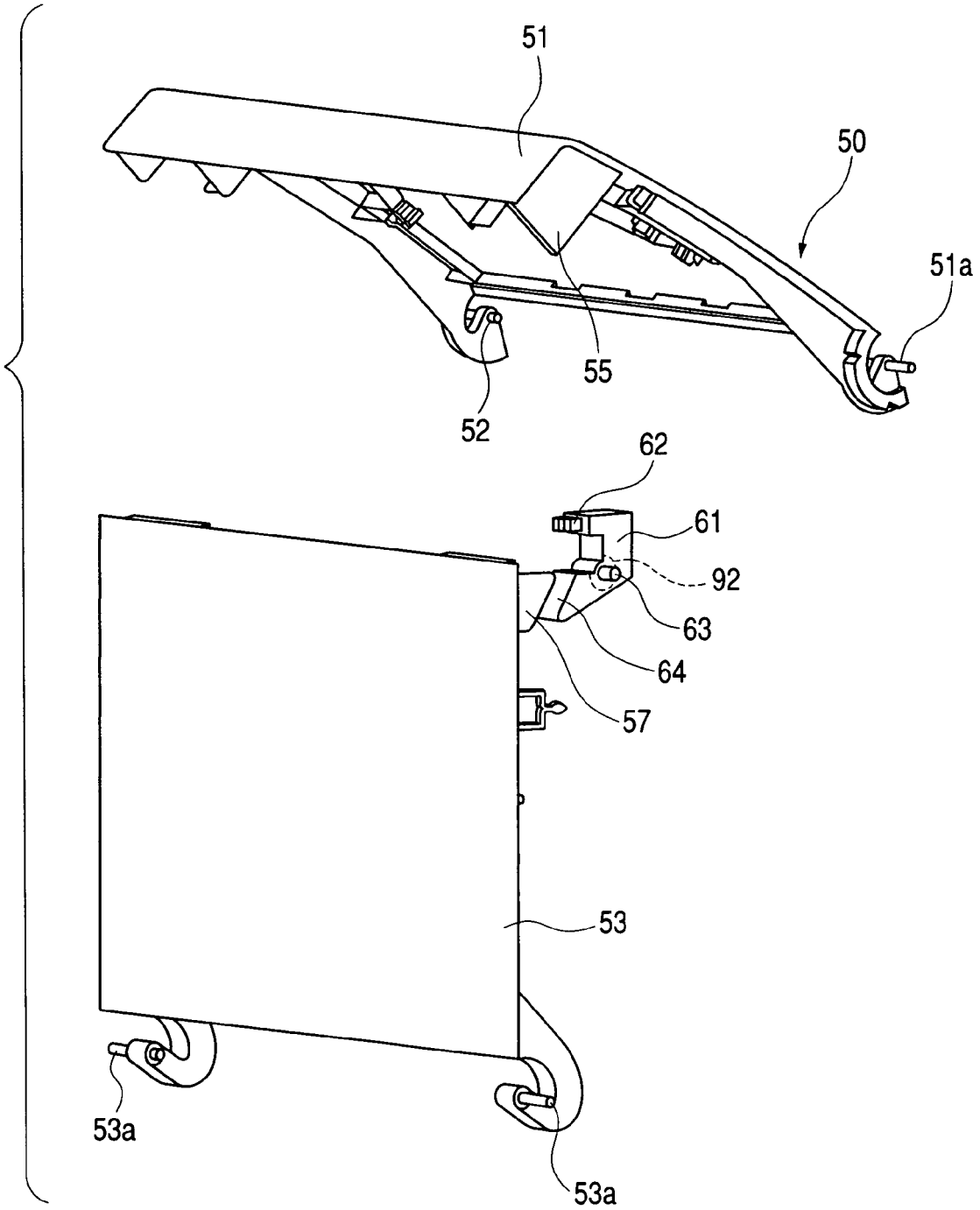
FIG. 5 is a perspective view showing a state at the time when the upper cover of the cover section of the sheet feeding apparatus in accordance with the first embodiment is opened.

Here, for example, in supplying sheets, as shown in FIG. 5, when the upper cover 51 is opened first, the upper cover flag 55 moves from the slit portion of the cover detecting sensor 62. Consequently, the light shielding state of the cover detecting sensor 62 is released, and the controller judges that at least the upper cover 51 has come into an opened state.

Figure 6:
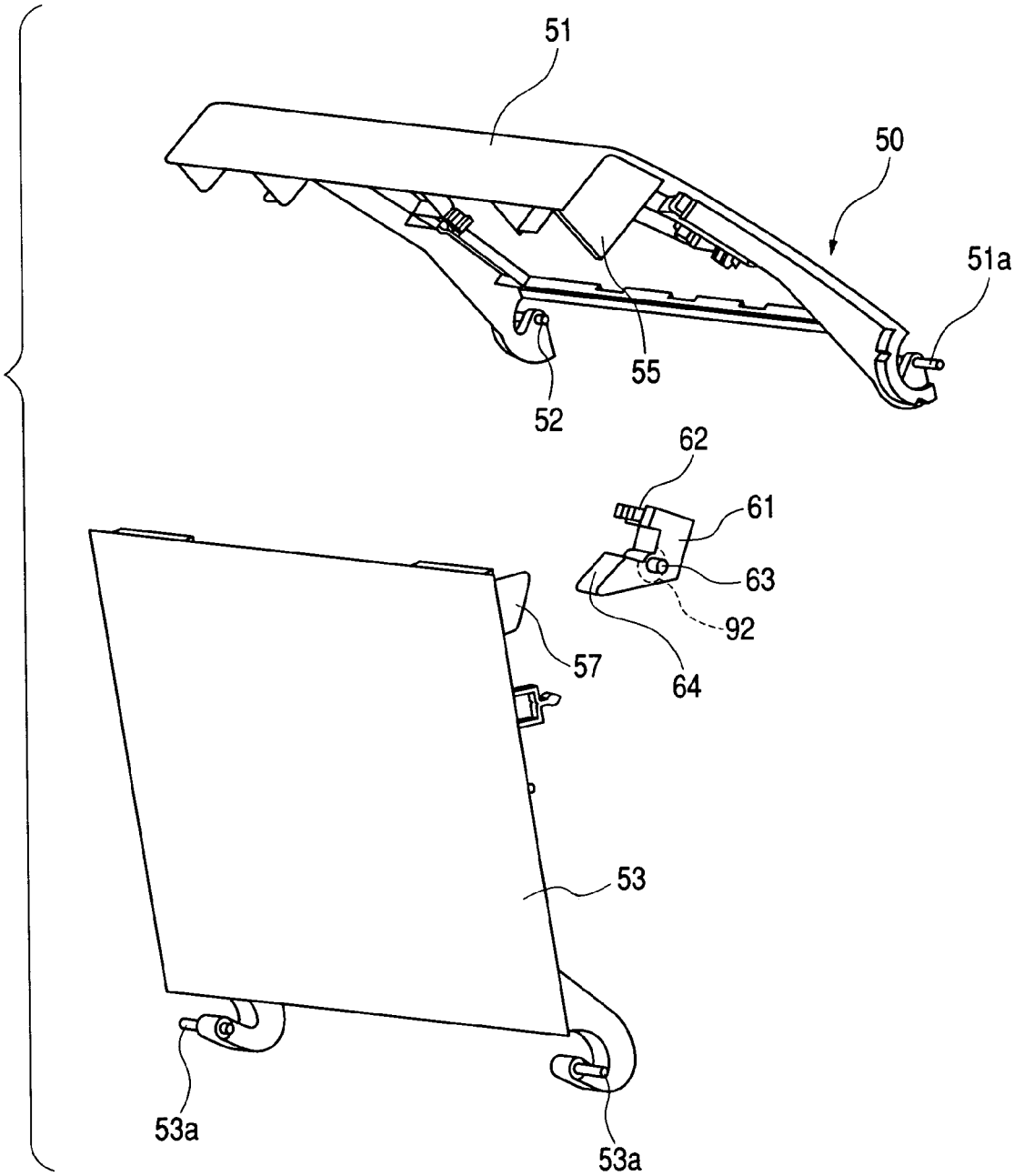
FIG. 6 is a perspective view showing a state at the time when the side cover of the cover section of the sheet feeding apparatus in accordance with the first embodiment is opened.

Next, when the side cover 53 is opened, as shown in FIG. 6, the sensor attachment stand 61 is pivoted clockwise with the pivotal support shaft 63 as a fulcrum by a biasing force of the biasing spring 92, and then locked by locking means (not shown) to thereby stop in a predetermined position.

Note that, at this point, the slit portion of the cover detecting sensor 62 is in a light transmitting state. Consequently, the controller judges that the side cover 53 is in an opened state.

Next, when the side cover 53 is closed in a state in which the supply of sheets is finished and the upper cover 51 is opened, the side cover projected portion 57 abuts against the bumping portion 64 of the sensor attachment stand 61 according to the closing movement of the side cover 53. Consequently, the sensor attachment stand 61 is pivoted from the predetermined position where it has been stopped to be returned to the state shown in FIG. 5.

Then, when the upper cover 51 is closed, the upper cover flag 55 is inserted into the slit portion of the cover detecting sensor 62, and the cover detecting sensor 62 changes from the light transmitting state to the light shielding state. Consequently, the controller judges that the upper cover 51 and the side cover 53 have come into a closed state.

Figure 7:
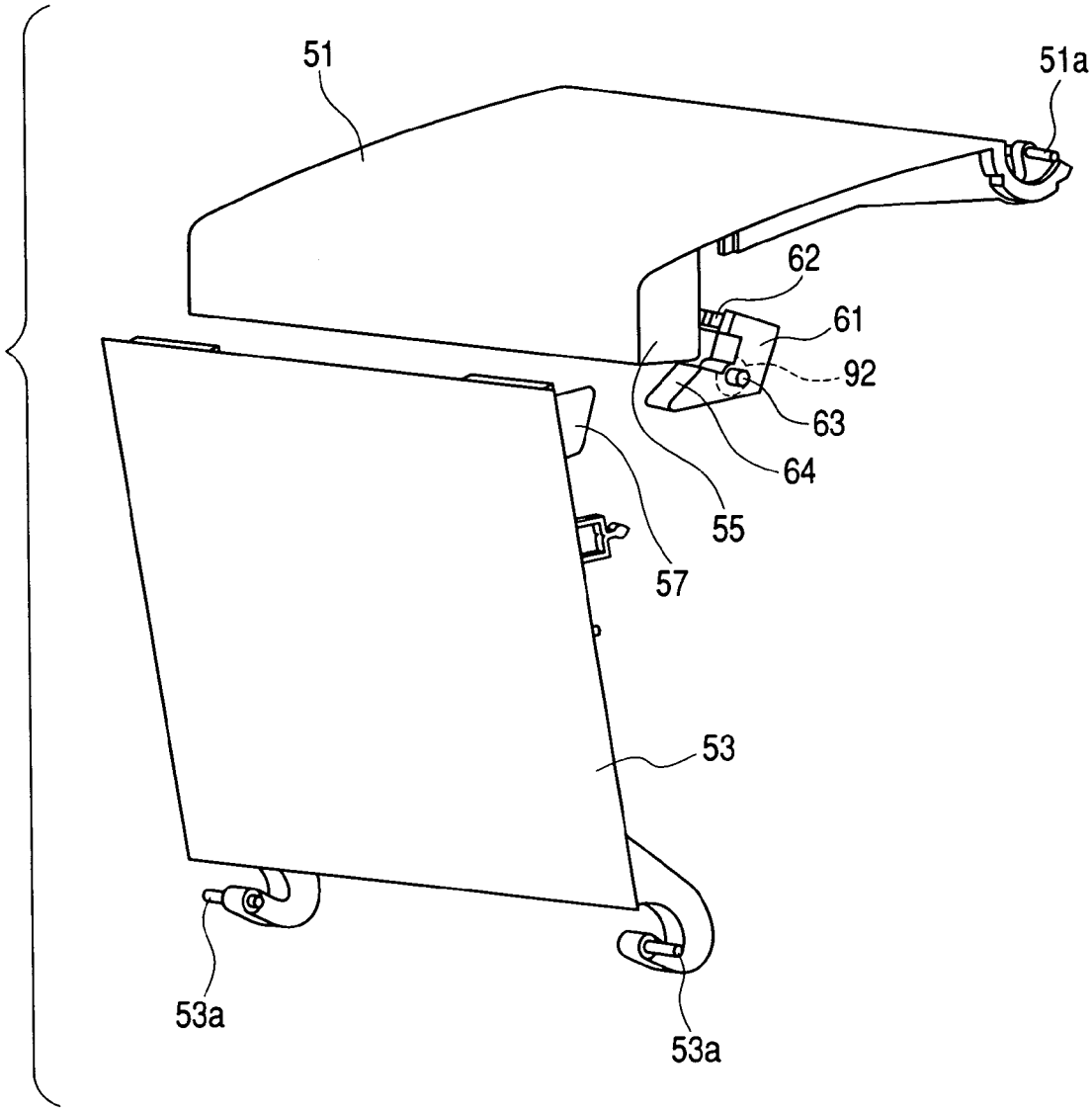
FIG. 7 is a perspective view showing a state at the time when the upper cover is closed in a state in which the side cover of the cover section of the sheet feeding apparatus in accordance with the first embodiment is opened.

Incidentally, when the user closes the upper cover 51 in a state in which the side cover 53 is opened, as shown in FIG. 7, since the sensor attachment stand 61 is stopped in a predetermined position in the state in which the side cover 53 is opened, the upper cover sensor flag 55 is not inserted into the slit portion of the cover detecting sensor 62, and the cover detecting sensor 62 stays in the light transmission state. That is, the cover detecting sensor 62 does not detect the closing of the upper cover 51, and the controller judges that the upper cover 51 is in the opened state.

In this way, the cover detecting sensor 62 does not detect the closing of the upper cover 51 when the upper cover 51 has been closed earlier than the side cover 53, that is, in a state in which the side cover 53 is opened, and detects the closing of the upper cover 51 when the upper cover 51 has been closed in a state in which the side cover 53 is closed. Consequently, the closing of the upper cover 51 and the side cover 53 can be detected by one cover detecting sensor 62.

As a result, a structure of the controller is simplified, and costs for electric components such as the sensors and the controller can be controlled. Moreover, since detection of the closing of the upper cover 51 and the side cover 53 is performed by one sensor, reliability in terms of failure rate of the sensors, arithmetic operation of the controller, and the like is improved.

Figure 8:
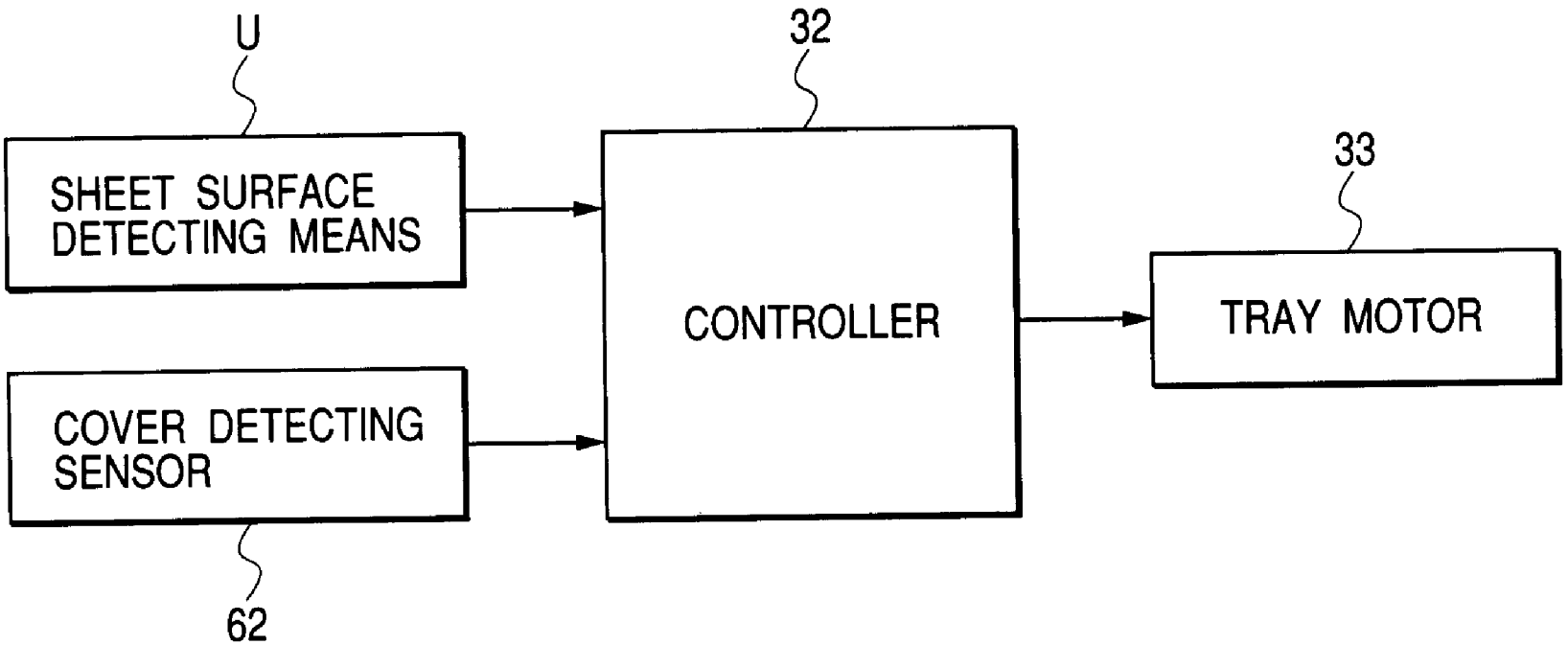
FIG. 8 is a block diagram of a structure for controlling an opening and closing of the upper cover in accordance with the first embodiment and raising and lowering of a sheet stacking stand.

The sheet tray 5 is controlled to be raised and lowered according to the opening or the closing of the upper cover 51. That is, as shown in FIG. 8, the opening and closing of the upper cover 51 is detected by the cover detecting sensor 62 and, at the same time, a sheet surface is detected by sheet surface detecting means U for detecting an upper surface position of the sheet stack mounted on the sheet tray 5, and according to detection signals of the cover detecting sensor 62 and the sheet surface detecting means U, a controller 32 serving as control means drives and controls a tray motor 33, thereby raising and lowering the sheet tray 5.

Figure 9:
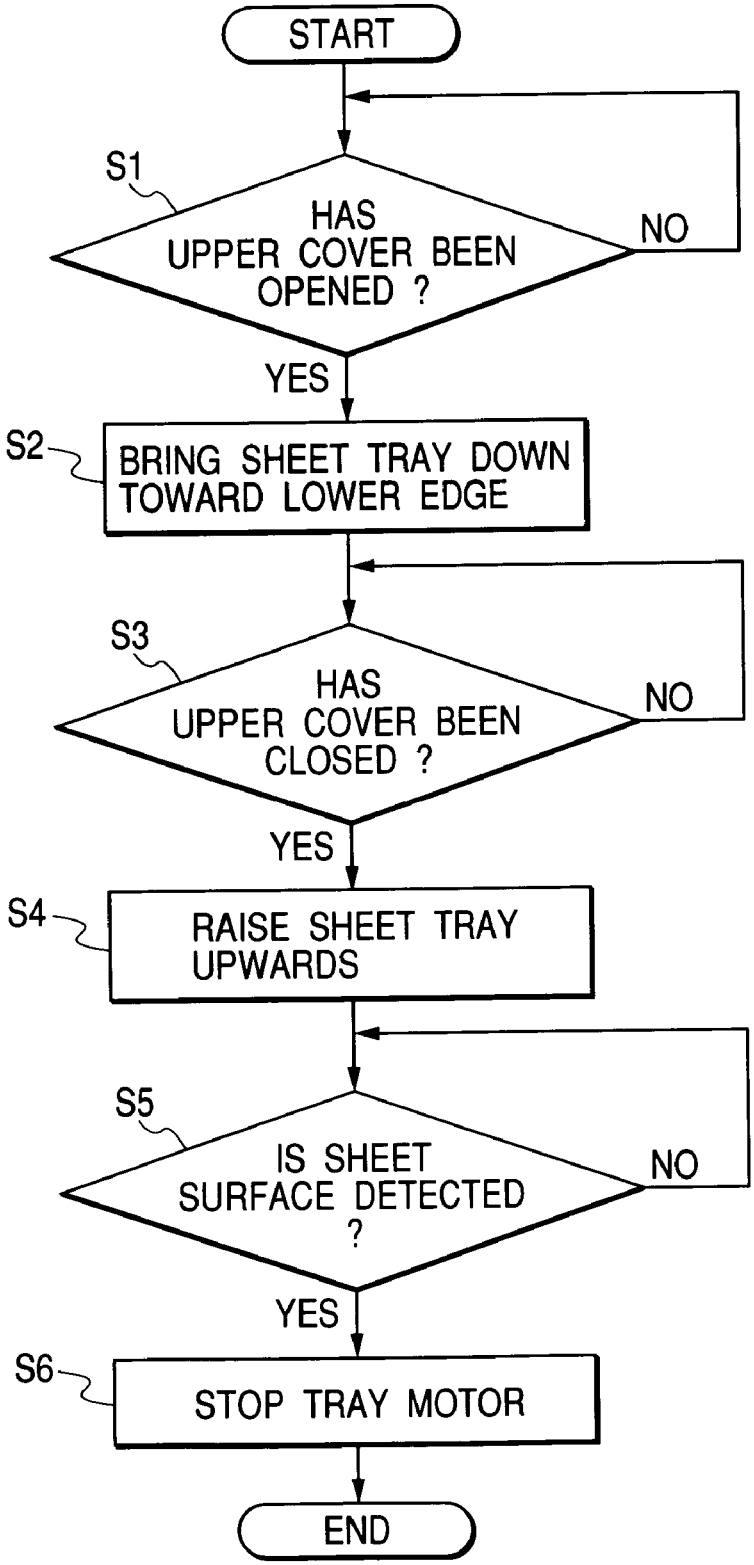
FIG. 9 is a flowchart showing procedures for opening and closing the upper cover in accordance with the first embodiment and raising and lowering of the sheet stacking stand.

More specifically, as shown in a flowchart of FIG. 9, when the cover detecting sensor 62 detects that the upper cover 51 has been opened (S1), the controller 32 drives the tray motor 33 to bring the sheet tray 5 down toward a lower edge position (S2). In this state, the user can access a jam sheet, which is nipped by the separation roller pair 10, with a rear end thereof on the feeding roller 9 side, and easily remove the jam sheet.

After jam treatment or after the sheet stack is stacked, the side cover 53 is closed and the upper cover 51 is further closed, the cover detecting sensor 62 detects the closing (S3), and the controller 32 drives the tray motor 33 to raise the sheet tray 5 (S4). Then, when the sheet surface detecting means U detects that an upper most sheet of the sheet stack on the sheet tray 5 has been raised to a position where the sheet can be fed (S5), the controller 32 stops driving of the tray motor 33 (S6).

As described above, by adopting the structure in which the upper cover 51 for performing the jam treatment and the side cover 53 for setting the sheets S are provided separately, enlargement of the cover can be avoided, and compatibility between cost reduction and operability can be realized.

Second Embodiment

Next, a second embodiment will be described with reference to FIGS. 10 to 13.

This embodiment is different from the first embodiment in that a detecting sensor for detecting the opening or the closing of a cover is fixed, and the different component will be described in detail. Since other components are the same as those in the first embodiment, detailed descriptions of the components will be omitted. Note that, in FIGS. 10 to 13 for explaining this embodiment, components identical with or equivalent to those in the first embodiment are denoted by the identical reference symbols.

Figure 10:
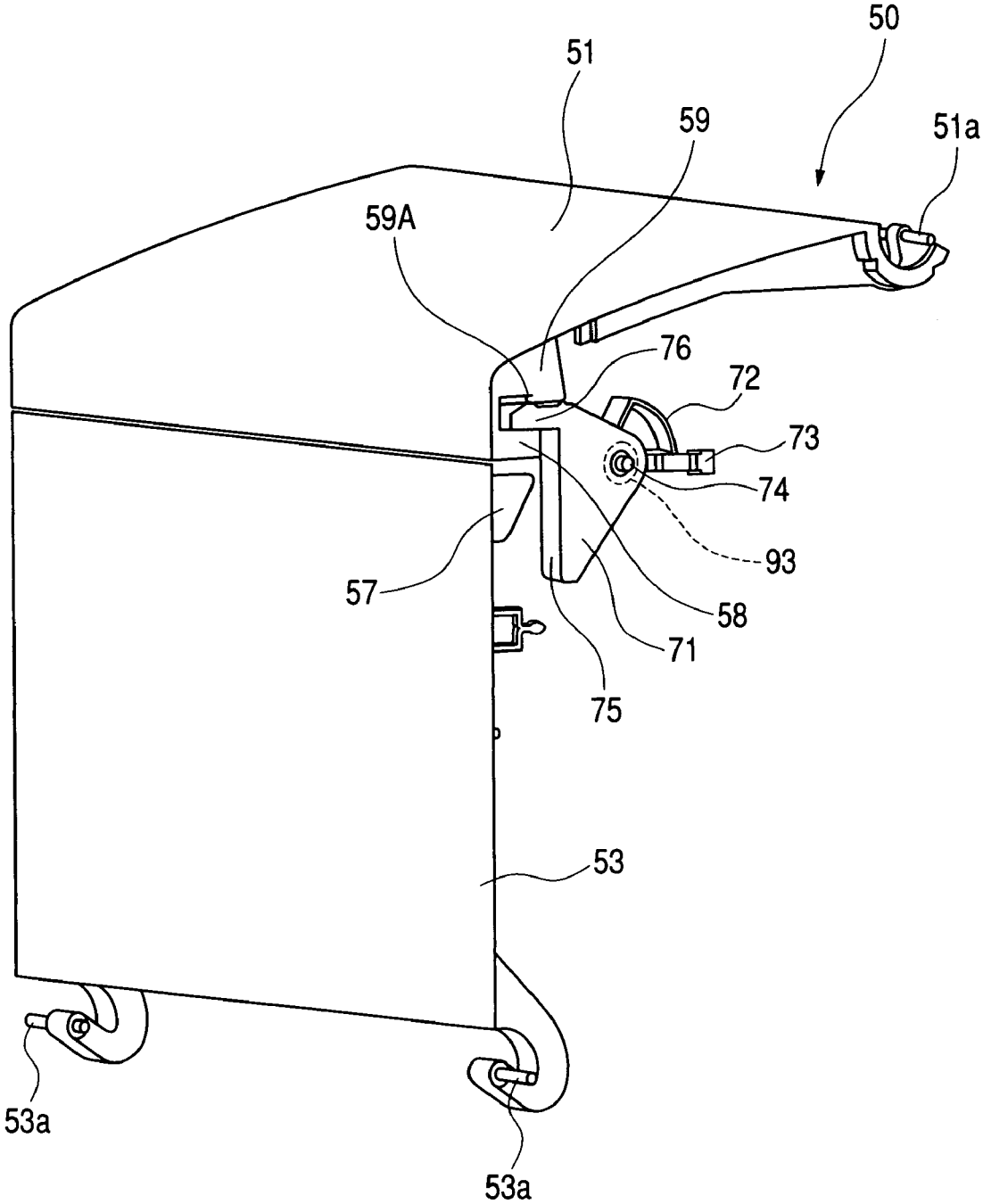
FIG. 10 is a perspective view showing a structure of a cover section of a sheet feeding apparatus in accordance with a second embodiment.

FIG. 10 is a perspective view showing a structure of a cover section of a sheet feeding apparatus in accordance with this embodiment. In FIG. 10, reference numeral 73 denotes a cover detecting sensor serving as a detecting sensor, and 71 denotes a cover detecting lever serving as a moving member. This cover detecting lever 71 is held in a sheet feeding apparatus main body (not shown) so as to be pivotable with a pivotal support shaft 74 as a fulcrum and has a cover detecting sensor flag 72 which is inserted into and pulled out of a slit portion (not shown) of the cover detecting sensor 73 following the pivoting of the cover detecting lever 71.

Here, this cover detecting sensor 73 is a photo-interrupter having a slit portion. As described later, when the upper cover 51 is closed, the cover detecting sensor flag 72 is pulled out of this slit portion, and the cover detecting sensor 73 comes into a light transmitting state. In addition, this cover detecting sensor 73 is connected to a controller (not shown) and, when the cover detecting sensor 73 comes into the light transmitting state, this controller judges that the upper cover 51 and the side cover 53 have been closed. In this way, the cover detecting sensor 73 is turned ON/OFF according to insertion or non-insertion of the cover detecting sensor flag 72, whereby the opening and closing of the upper cover 51 is detected.

Reference numeral 75 denotes a cover detecting lever bumping portion provided at a side edge of a side cover of the cover detecting lever 71. This cover detecting lever bumping portion 75 is provided in a position where it abuts against the side cover projected portion 57 in a state in which the upper cover 51 is opened and the side cover 53 is closed.

Reference numerals 58 and 59 denote first and second projected portions integrally provided in the upper cover 51, and 76 denotes a cover detecting lever projected portion provided at an upper end of the cover detecting lever 71. This cover detecting lever projected portion 76 is provided so as to be placed between the first and second projected portions 58 and 59 of the upper cover 51 in a state in which the upper cover 51 is closed.

Next, detection of the opening or the closing of the upper cover 51 and the side cover 53 in the cover section constituted as described above will be described. Note that, in this embodiment, again, in the case of opening the upper cover 51 and the side cover 53 for supply or the like of the sheets S, the side cover 53 is opened after the opening of the upper cover 51. In the case of closing the upper cover 51 and the side cover 53, the upper cover 51 is closed after closing the side cover 53.

The state shown in FIG. 10 is a state in which the upper cover 51 and the side cover 53 are closed. At this point, the cover detecting lever projected portion 76 of the cover detecting lever 71 is placed between the first and second projected portions 58 and 59 of the upper cover 51, whereby a position of the cover detecting lever 71 is regulated.

Note that, in such a state, since the cover detecting sensor flag 72 is not inserted into the slit portion of the cover detecting sensor 73, the cover detecting sensor 73 comes into the light transmitting state. Consequently, the controller judges that the upper cover 51 and the side cover 53 are in the closed state.

Figure 11:
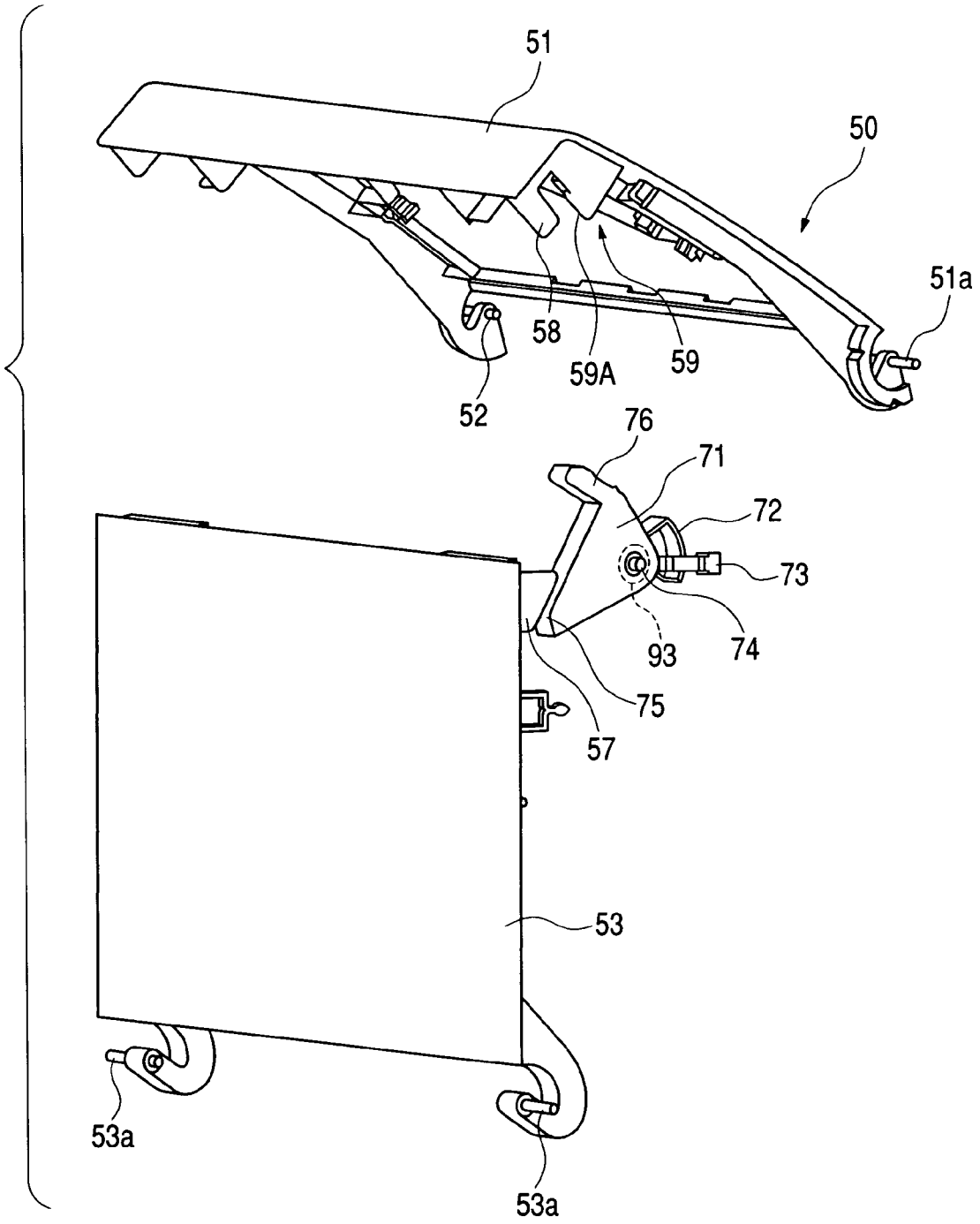
FIG. 11 is a perspective view showing a state at the time when an upper cover of the cover section of the sheet feeding apparatus in accordance with the second embodiment is opened.

Here, for example, in supplying sheets, as shown in FIG. 11, when the upper cover 51 is opened first, the first projected portion 58 of the upper cover 51 pushes up the cover detecting projected portion 76 on the cover detecting lever 71 according to the opening movement of the upper cover 51. Consequently, the cover detecting lever 71 is pivoted around the pivotal support shaft 74, and the cover detecting sensor flag 72 moves into the slit portion of the cover detecting sensor 73 following the pivoting movement.

That is, following the opening of the upper cover 51, the cover detecting lever 71 moves from a first position where the cover detecting sensor 73 detects the closing of the upper cover 51 to a second position where the cover detecting sensor 73 does not detect the closing of the upper cover 51.

As a result, the cover detecting sensor 73 changes from the light transmitting state to the light shielding state, and the controller judges that at least the upper cover 51 has come into the opened state. Then, the cover detecting lever 71 stops after pivoting due to a biasing force of a biasing spring 93 serving as biasing means according to the opening movement of the upper cover 51 until the cover detecting lever bumping portion 75 provided on the cover detecting lever 71 abuts against the side cover projected portion 57.

Figure 12:
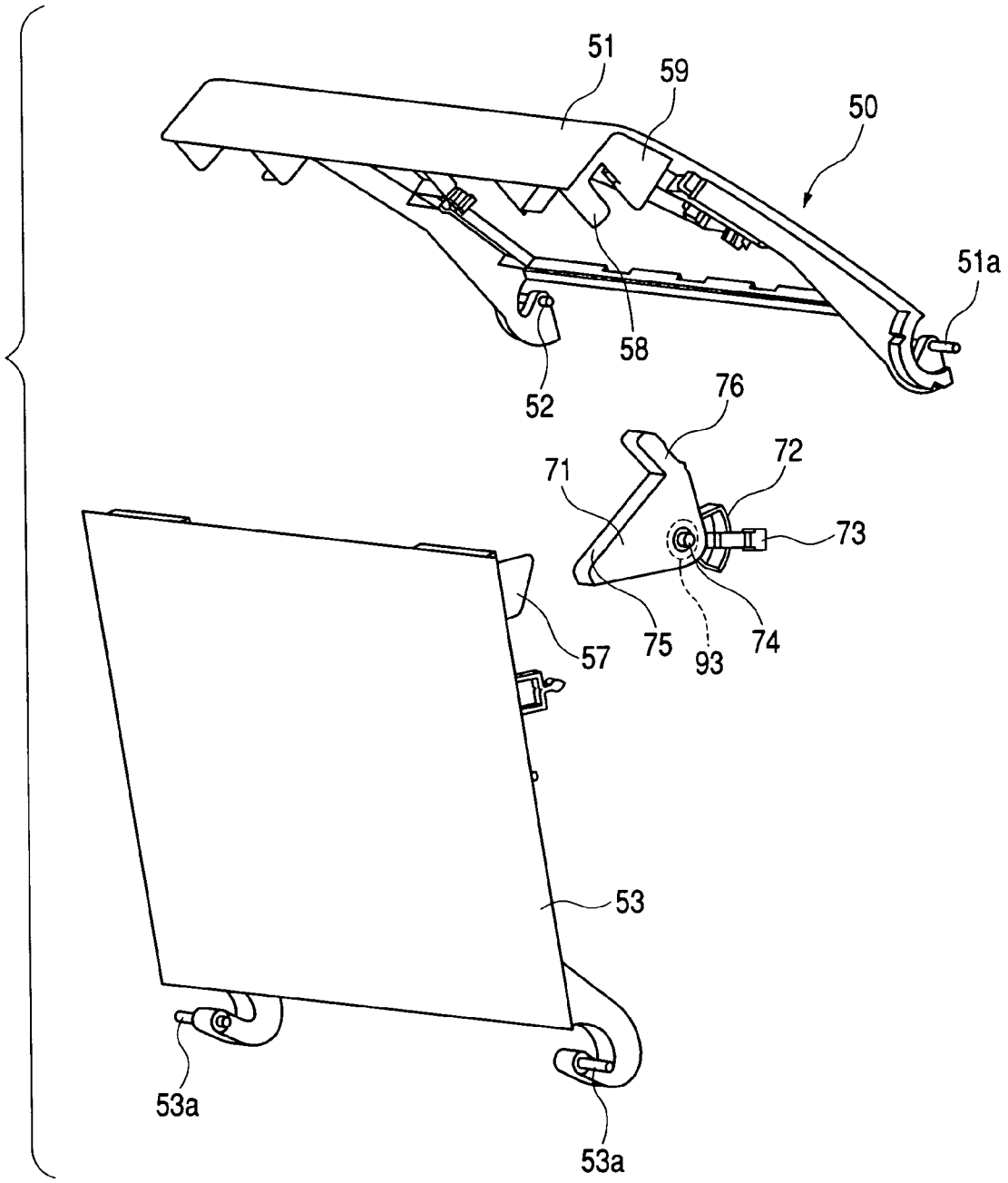
FIG. 12 is a perspective view showing a state at the time when a side cover of the cover section of the sheet feeding apparatus in accordance with the second embodiment is opened.

Following this, when the side cover 53 is opened, as shown in FIG. 12, the cover detecting lever 71, which has been in a stopped state due to the abutment of the cover detecting lever bumping portion against the side cover projected portion 57, is further pivoted by a biasing force of the biasing spring 93 according to the opening movement of the side cover 53 and is stopped in a predetermined position which is a third position, where the cover detecting sensor 73 does not detect the closing of the upper cover 51, by locking means (not shown). Note that even in this third position, the cover detecting sensor flag 72 shields the slit portion of the cover detecting sensor 73 from light, whereby the controller judges that at least the upper cover 51 is in the opened state.

Next, when the side cover 53 is closed in a state in which the supply of sheets is finished and the upper cover 51 is opened, the side cover projected portion 57 abuts against the cover detecting lever bumping portion 75 according to the closing movement of the side cover 53. Consequently, the cover detecting lever 71 is pivoted from the predetermined position where it has been stopped to be returned to the state shown in FIG. 11 (second position).

Then, when the upper cover 51 is closed, after the first projected portion 58 of the upper cover 51 passes by the cover detecting lever projected portion 76, an abutting portion 59A provided in the second projected portion 59 abuts against the upper part of the cover detecting lever projected portion 76. Consequently, the cover detecting lever 71 is pivoted downward while the cover detecting lever projected portion 76 is inserted into a space between the first and second projected portions 58 and 59. As a result, the cover detecting sensor flag 72 moves from the slit portion of the cover detecting sensor 73, and the cover detecting sensor 73 changes from the light shielding state to the light transmitting state. Consequently, the controller judges that the upper cover 51 and the side cover 53 have come into the closed state.

Figure 13:
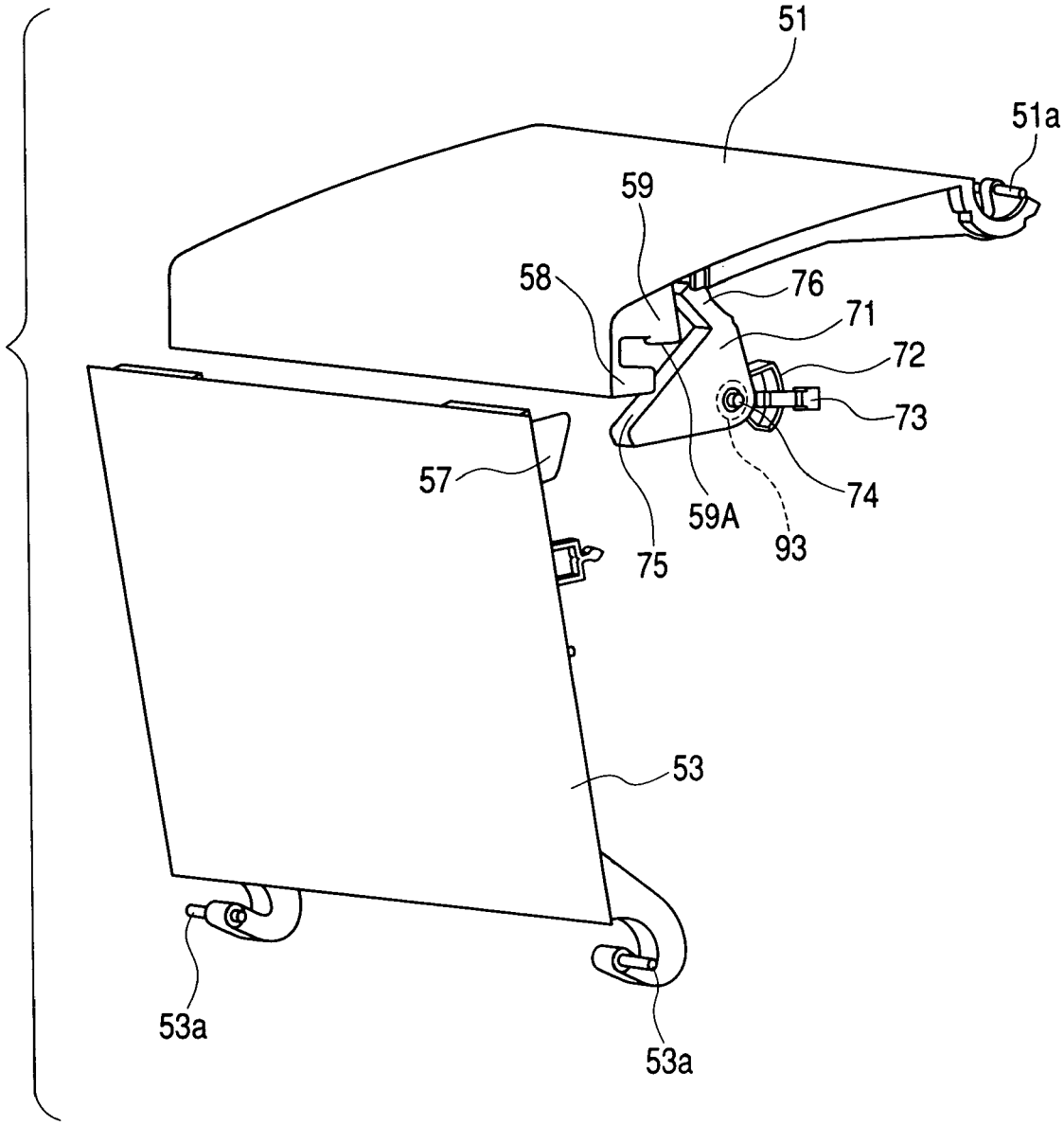
FIG. 13 is a perspective view showing a state at the time when the upper cover is closed in a state in which the side cover of the cover section of the sheet feeding apparatus in accordance with the second embodiment is opened.

Incidentally, when the user closes the upper cover 51 in a state in which the side cover 53 is opened, since the cover detecting lever 71 is stopped in the predetermined position as shown in FIG. 13 at this point, even if the upper cover 51 is closed, the second projected portion 59 of the upper cover 51 does not abut against the cover detecting lever projected portion 76, and the cover detecting lever 71 is not pivoted.

Then, in the case in which the cover detecting lever 71 is not pivoted as described above, the cover detecting sensor flag 72 does not move from the slit portion of the cover detecting sensor 73, and the cover detecting sensor 73 stays in the light shielding state. That is, the cover detecting sensor 73 does not detect the closing of the upper cover 51, and the controller judges that the upper cover 51 is in the opened state.

In this way, according to this embodiment, again, the cover detecting sensor 73 does not detect the closing of the upper cover 51 when the upper cover 51 has been closed earlier than the side cover 53, and detects the closing of the upper cover 51 when the upper cover 51 has been closed in a state in which the side cover 53 is closed. Consequently, the closing of the upper cover 51 and the side cover 53 can be detected by one cover detecting sensor 73. Moreover, in this embodiment, since the cover detecting sensor 73 can be fixed, wiring is facilitated.

Third Embodiment

Next, a third embodiment will be described.

Figure 14:
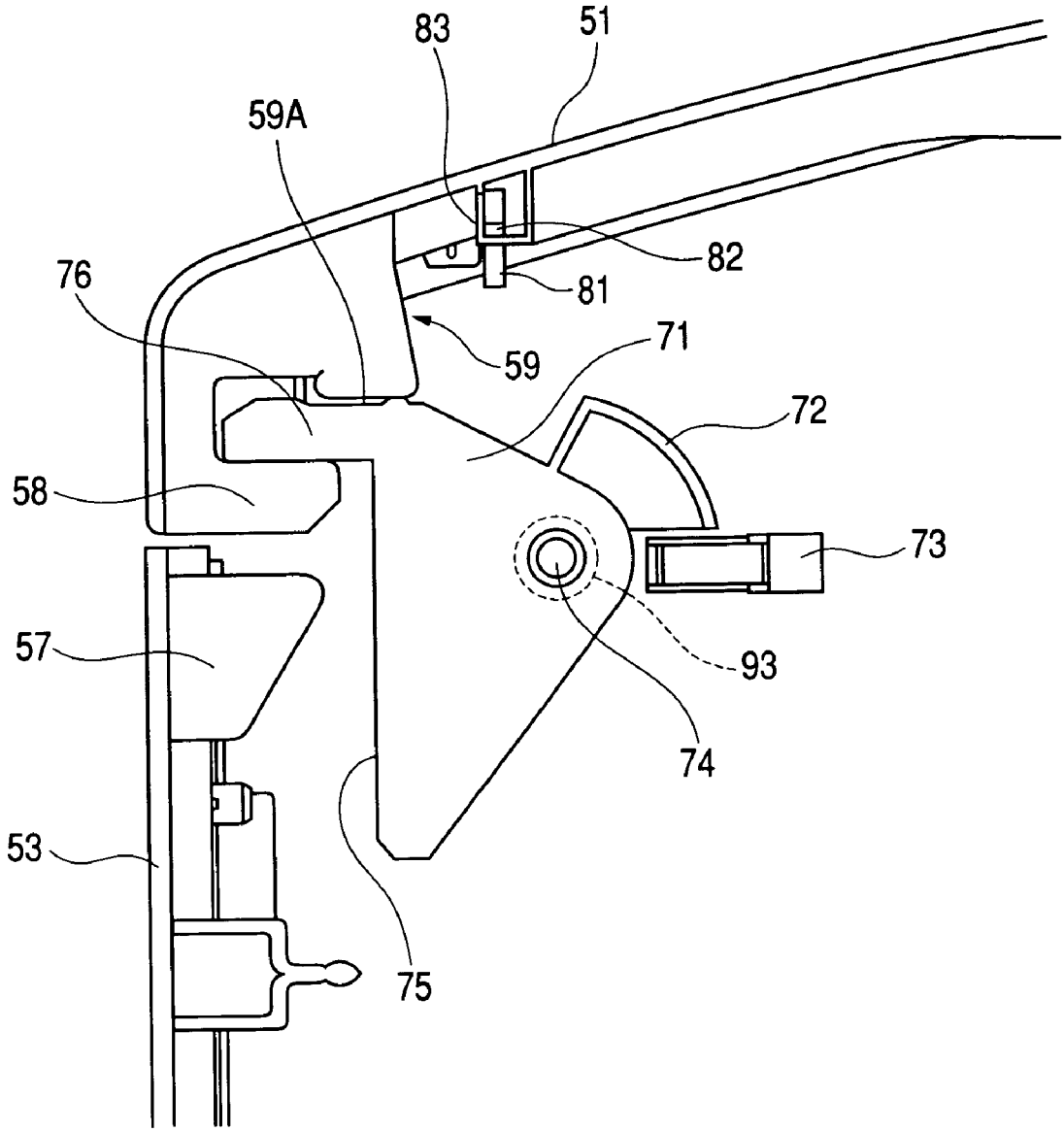
FIG. 14 is an enlarged view of a main part of a cover section of a sheet feeding apparatus in accordance with a third embodiment.
Figure 15:
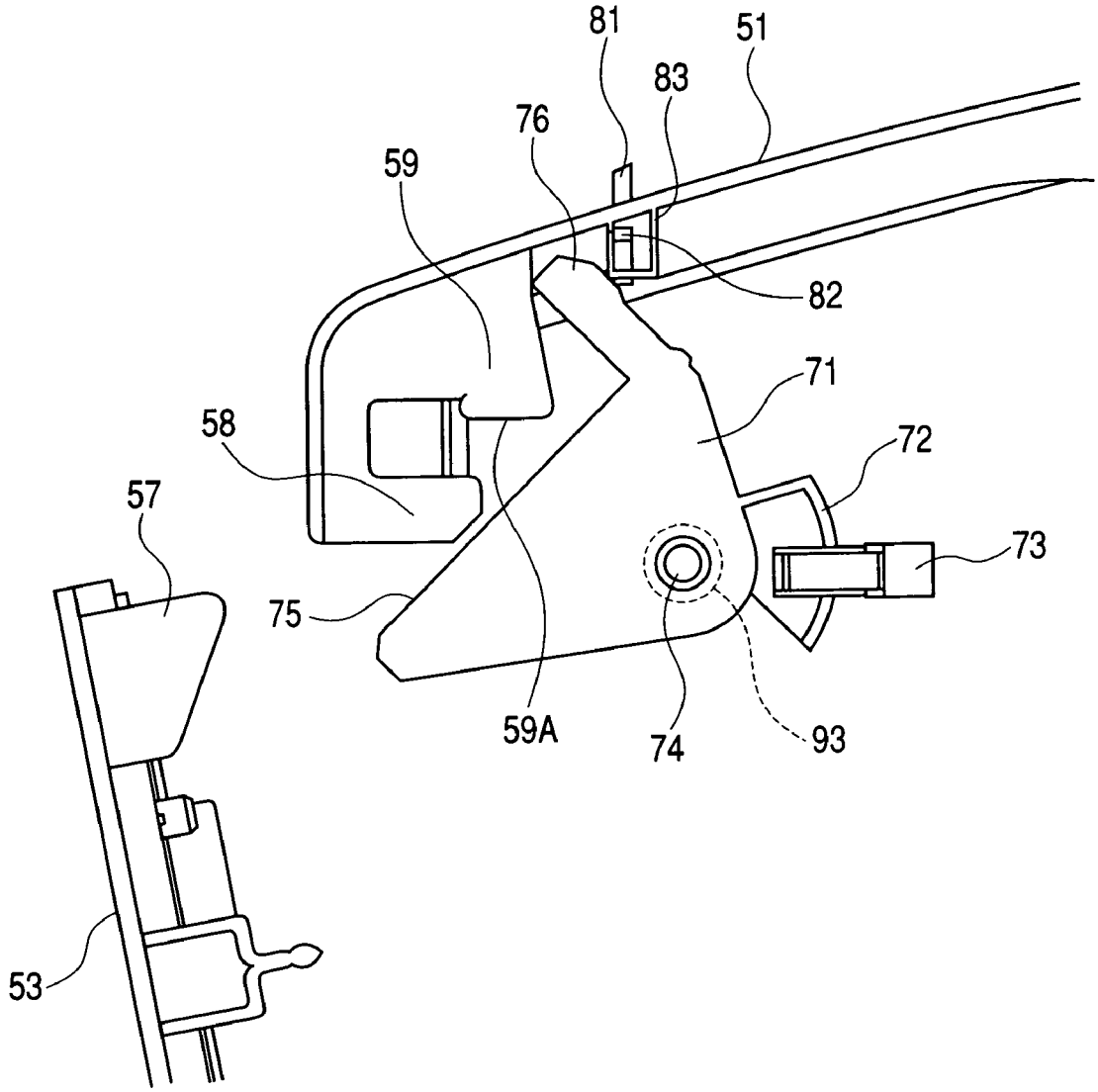
FIG. 15 is a view showing a state at the time when an upper cover is closed in a state in which a side cover of the cover section of the sheet feeding apparatus in accordance with the third embodiment is opened.

FIGS. 14 and 15 are an enlarged view of a main part showing a structure of a cover section of a sheet feeding apparatus in accordance with this embodiment, respectively. This embodiment is different from the second embodiment in that an indication member for drawing a user's attention in the case in which an upper cover has been closed earlier than a side cover is provided, and the different component will be described in detail. Since other components are the same as those in the second embodiment, detailed descriptions of the components will be omitted. Note that, in FIGS. 14 and 15, components identical with or equivalent to those in FIG. 10 are denoted by the identical reference symbols.

In the figures, reference numeral 81 denotes an upper cover flag serving as an indication member which is provided in the upper cover 51 so as to move freely in the vertical direction. This upper cover flag 81 projects from the upper cover 51 when the upper cover 51 is closed earlier than the side cover 53.

Note that reference numeral 82 denotes a stopper for locking the upper cover flag 81 in a position lower than the surface of the upper cover 51 shown in the figures when the upper cover 51 is closed, and 83 denotes an upper cover flag guide for guiding the upper cover flag 81. Note that, in this embodiment, the upper cover flag 81 is guided by the upper cover flag guide 83 to move upward from a position where the stopper 82 abuts against a bottom portion of the upper cover flag guide 83.

Next, operations of this upper cover flag 81 will be described.

When the upper cover 51 and the side cover 53 are closed, the lower part of the upper cover flag 81 is not in contact with the cover detecting lever projected portion 76 on the cover detecting lever 71 as shown in the figures, and the upper cover flag 81 is in a lowered state.

On the other hand, in the case in which the upper cover 51 is closed while the side cover 53 is opened, that is, in the case in which the upper cover 51 is not closed normally, the cover detecting lever 71 is stopped in a predetermined position as shown in FIG. 15 when the side cover 53 is in the opened state. Thus, when the upper cover 51 is closed, the lower part of the upper cover flag 81 abuts against the cover detecting lever 76.

Then, when the lower part of the upper cover flag 81 abuts against the cover detecting lever 76 in this way, the upper cover flag 81 is raised along the upper cover flag guide 82 to project from the upper cover 51 to a position indicating that the upper cover 51 has not been closed normally, that is, the upper cover 51 was closed earlier than the side cover 53.

In this way, when it is attempted to close the upper cover 51 in a state in which the side cover 53 is opened, the upper cover flag 81 projects to the position indicating that the upper cover 51 has not been closed normally, whereby it becomes possible to draw the user's attention to make the user perform a predetermined operation with a simple structure.

Note that, in this embodiment, the upper cover flag 81 projects from the upper cover 51 in the case in which the upper cover 51 has been closed earlier than the side cover 53 to draw the user's attention. However, in such a case, an indication member may be moved by being made to slide or rotate in the upper cover 51 to conduct the indication.

Note that, in this embodiment, the upper cover flag 81 serving as an indication member is provided in the upper cover 51 based upon the structure of the second embodiment. An indication member, which engages with the sensor attachment stand 61 in closing the upper cover 51 from the state shown in FIG. 3 in which the upper cover 51 and the side cover 53 are opened, and projects from the upper cover 51 when the upper cover 51 has been closed earlier than the side cover 53 may be provided in the upper cover 51 based upon the structure of the first embodiment.

Moreover, in the first to third embodiments described above, the case in which a photo-interrupter to be combined with a light shielding flag is used as a cover detecting sensor is described. However, the present invention is not limited to this, and a tact switch may be used as the cover detecting sensor instead.

As described above, according to the first to third embodiments, in the sheet feeding apparatus, covers for jam treatment and sheet stacking are made to operate separately, and a continuous space is opened in order to stack a large number of sheets on a sheet tray by simultaneously opening the two covers, whereby enlargement of the cover is prevented without curbing workability of sheet stacking. In addition, a structure capable of performing jam treatment is realized by opening a cover for jam treatment.

In addition, in the first to third embodiments, a detecting sensor for detecting that a first cover is closed is adapted such that the detecting sensor does not detect the closing of the first cover when the first cover is closed in a state in which a second cover is opened, and detects the closing of the first cover when the first cover is closed in a state in which the second cover is closed, whereby the closing of the first and second covers can be detected by one detecting sensor.

Note that, in the description of any of the first to third embodiments, an upper cover is illustrated as a first cover, and a side cover is illustrated as a second cover. However, it is unnecessary to limit positions where the covers are provided to an upper part or a side part, and the covers may be provided in any positions as long as a continuous opening is formed when both the covers are opened to facilitate jam treatment and sheet stacking.

Further, in the description of any of the first to third embodiments, the electrophotographic process is illustrated as image forming means. However, it is unnecessary to limit the image forming means to this, and other recording process such as ink-jet recording may be adopted.

First other Example of the Side Cover

Figure 16:
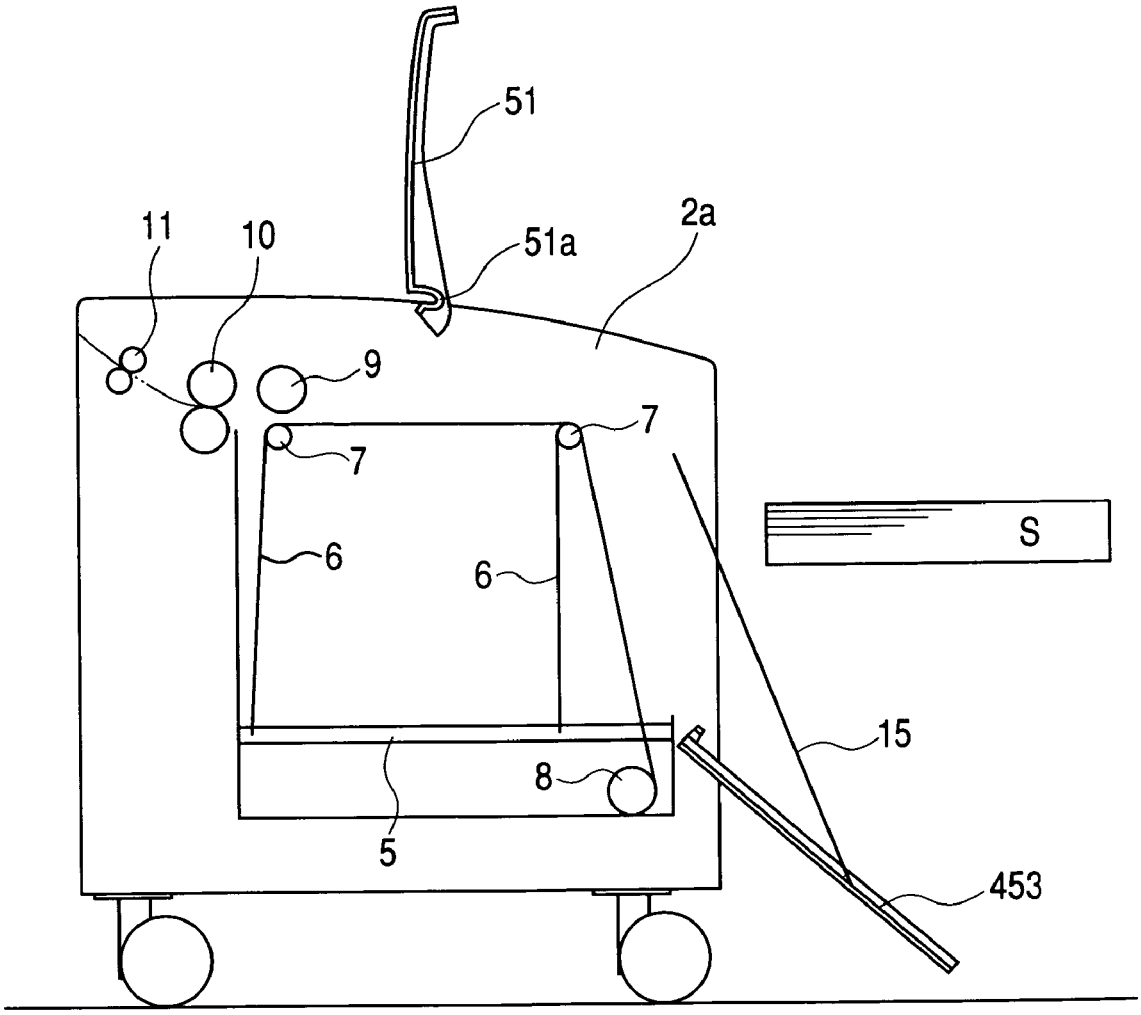
FIG. 16 is a sectional view of a sheet feeding apparatus in accordance with a first other example of the side cover and shows a state in which an upper cover and the side cover are opened.

A first other example of the side cover of the present invention will be hereinafter described with reference to FIG. 16. Note that FIG. 16 is a sectional explanatory view of a sheet feeding apparatus in accordance with the first other example of the side cover and shows a state in which the upper cover 51 and the side cover 453 are opened. In the description of this example, members having the identical functions as the above-mentioned structure are denoted by the identical reference symbols, and descriptions will be omitted for members which are not different from those in the above-mentioned structures in terms of structure and function.

In this example, a side cover 453, which can be opened in a lateral direction of the sheet feeding apparatus 2, is made openable at an angle of 90 degrees or more.

By adopting the structure of this example, since an amount of projection in the case in which the side cover 453 is opened sideways can be reduced, the opened side cover can be prevented from being an obstacle in stacking the sheet stack S on the sheet tray 5. In addition, in the case in which the side cover is opened substantially horizontally as in the first to third embodiments, it is likely that a user places or drops a sheet stack on an opened cover by mistake so that overload may be applied to the side cover or the wire 15. In this example, such a situation can be avoided.

Second other Example of the Side Cover

Figure 17:
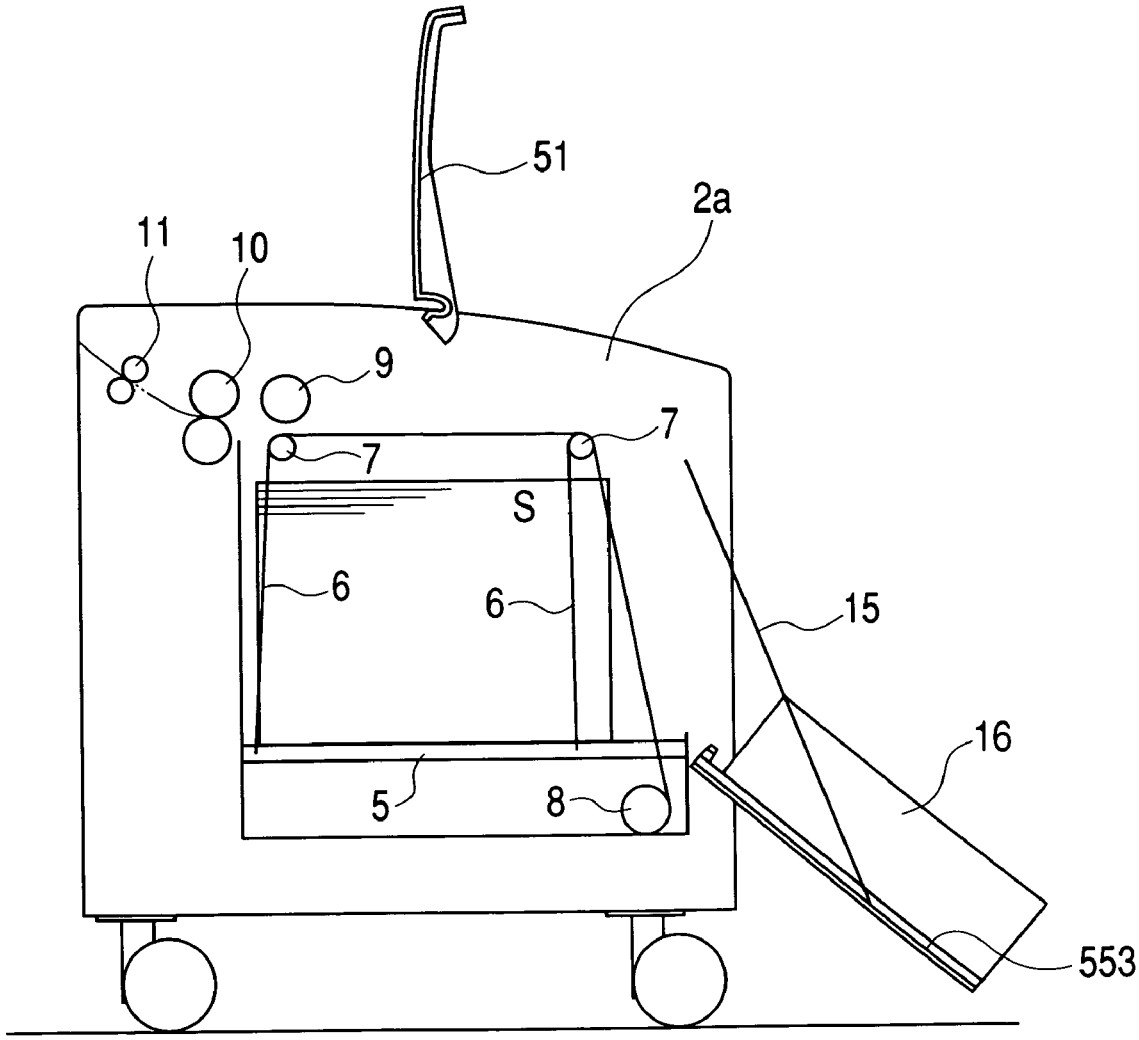
FIG. 17 is a sectional view of a sheet feeding apparatus in accordance with a second other example of the side cover and shows a state in which an upper cover and the side cover are opened.
Figure 18:
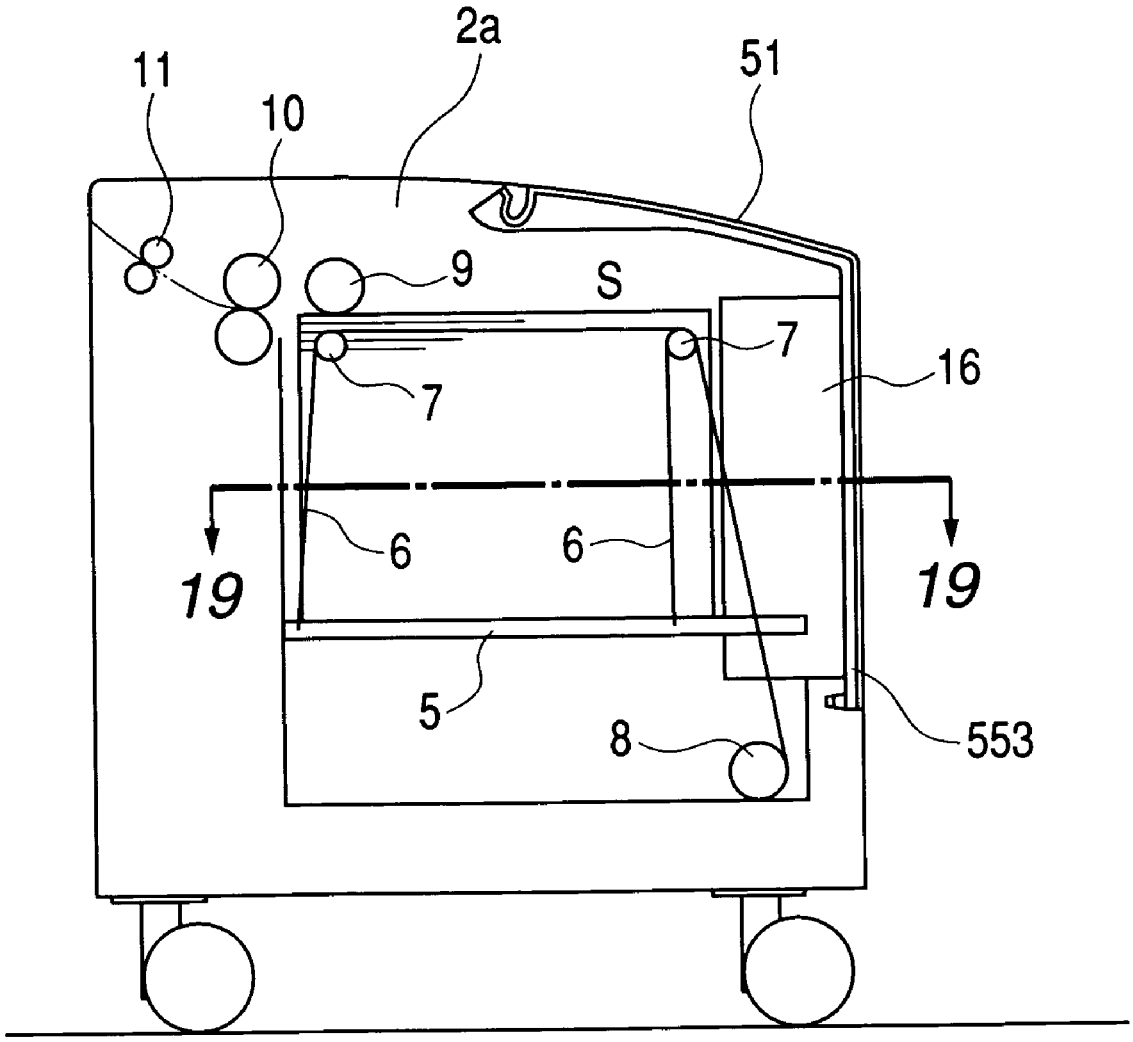
FIG. 18 is a sectional view of a sheet feeding apparatus in accordance with the second other example of the side cover and shows a state in which the upper cover and the side cover are closed.
Figure 19:
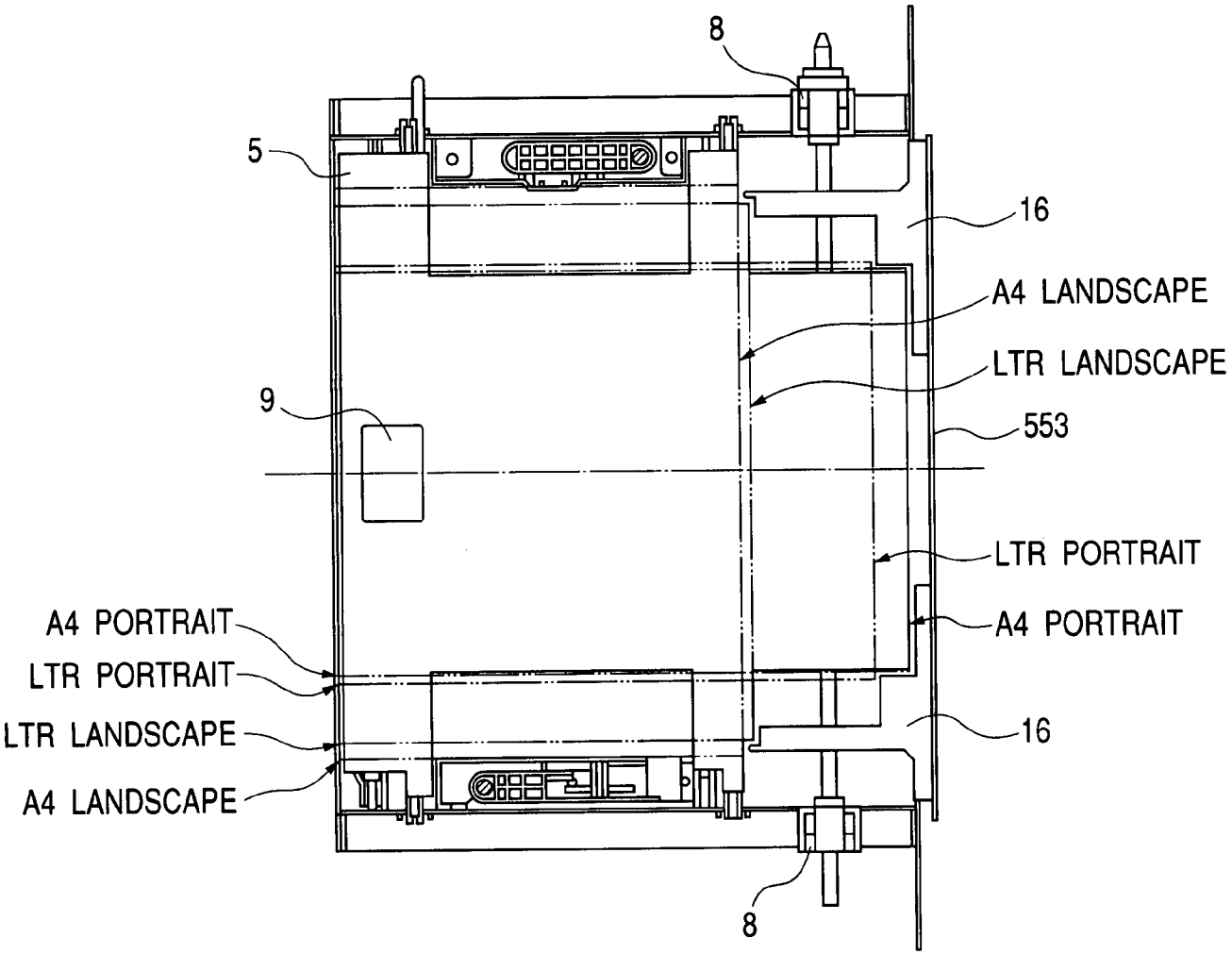
FIG. 19 is a sectional view of a sheet feeding apparatus along a line 19—19 in FIG. 18.

A second other example of the side cover of the present invention will be hereinafter described with reference to FIGS. 17 to 19. Note that FIG. 17 is a sectional explanatory view showing a state in which an upper cover and a side cover of a sheet feeding apparatus in accordance with this example are opened, and FIG. 18 is a sectional explanatory view showing a state in which the upper cover and the side cover are closed. FIG. 19 is an explanatory view of a section along a line 19—19 in FIG. 18. In addition, in this example, members having the identical functions as the structures described above are denoted by the identical reference symbols, and descriptions will be omitted for members which are not different from those in the first embodiment in terms of structure and function.

In this example, a sheet rear end regulating member (sheet rear end regulating means) 16 for regulating a sheet position of the sheet stack S is provided in a side cover 553.

The rear end regulating member 16 is fixed to the side cover 553 and is pivoted together with the side cover 553 as shown in FIG. 17. In addition, as shown in FIG. 18, when the side cover 553 is closed, the rear end regulating member 16 is arranged in a position where it regulates a side edge of the sheet stack S stacked on the sheet tray 5.

As shown in FIG. 19, a sectional shape of the rear end regulating member 16 is adjusted to regulate the side of the sheet S and the back with respect to a conveying direction of the sheet stack S in accordance with sheet sizes of landscape and portrait of A4 and letter (LTR) size sheets.

By providing the rear end regulating member 16 in the side cover 553, a structure capable of stacking the sheet stack S in a desired position on the sheet tray 5 can be realized while keeping workability for stacking the sheet stack S on the sheet tray 5.

Conventionally, a structure has been devised in which a member for regulating a sheet end is provided in an opening/closing cover of a sheet feeding apparatus. However, in the case in which a member is added to one large cover rather than two covers as in the present invention, there is a significant problem concerning maintenance of strength of the cover and a hinge portion.

In a structure in which the upper cover 3 and the side cover 553 are separately provided as in the present invention, the above-mentioned problem can be solved.

Third other Example of the Side Cover

Figure 20:
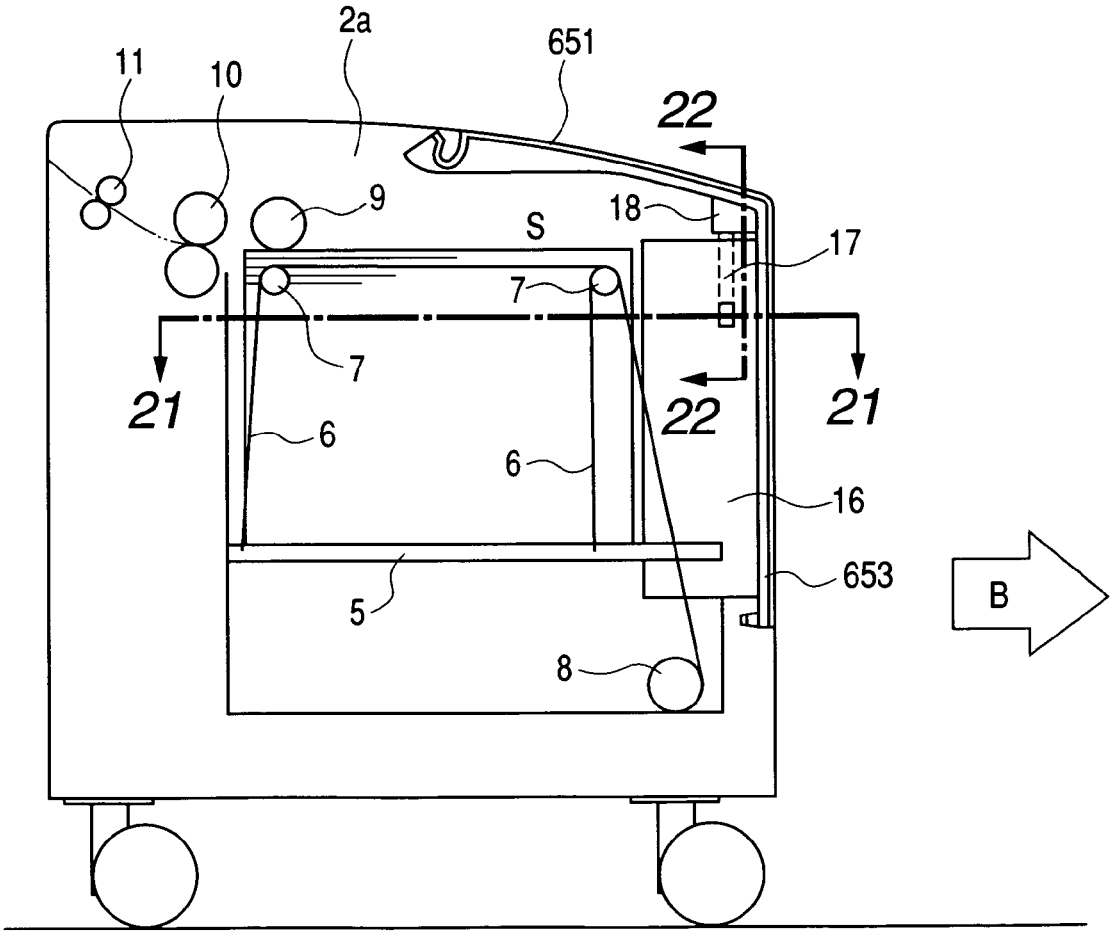
FIG. 20 is a sectional view of a sheet feeding apparatus in accordance with a third other example of the side cover and shows a state in which an upper cover and the side cover are closed.
Figure 21:
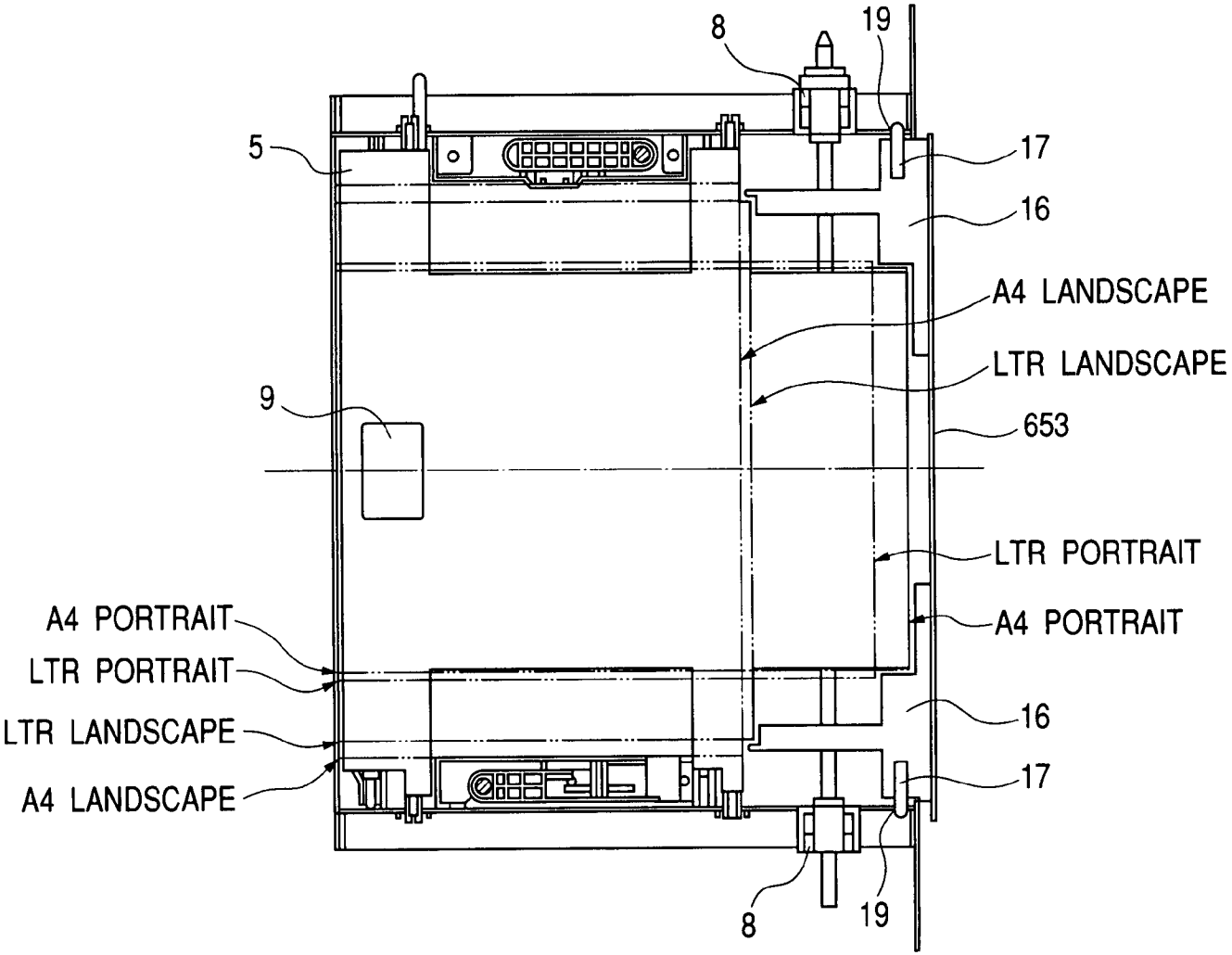
FIG. 21 is a sectional view of a sheet feeding apparatus along a line 21—21 in FIG. 20.
Figure 22A:
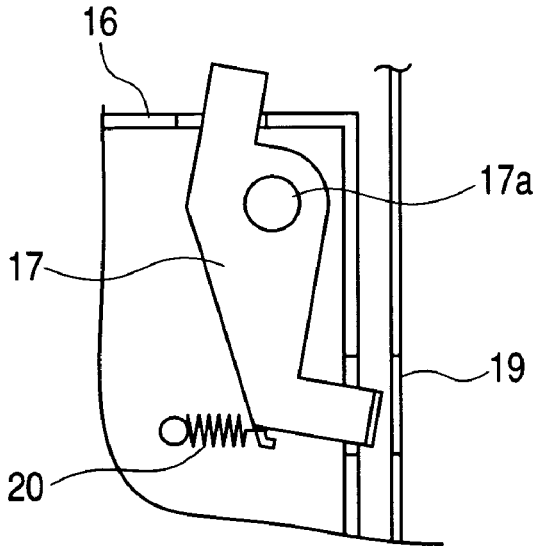
FIG. 22A is a sectional view of a sheet feeding apparatus along a line 22—22 in FIG. 20.
Figure 22B:
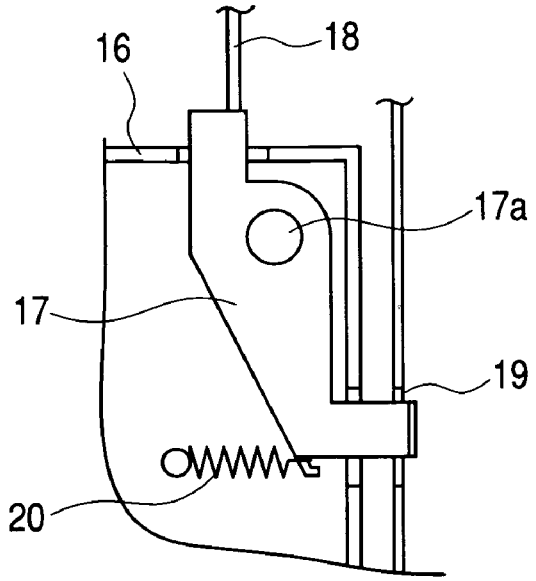
FIG. 22B is a sectional view of a sheet feeding apparatus along the line 22—22 in FIG. 20.

A third other example of the side cover of the present invention will be hereinafter described with reference to FIGS. 20 to 22. Note that FIG. 20 is a sectional explanatory view showing a state in which an upper cover and a side cover of a sheet feeding apparatus in accordance with this example are closed. FIG. 21 is an explanatory view of a section along a line 20—20 in FIG. 20. FIGS. 22A and 22B are explanatory views of a section along a line 22—22 in FIG. 20. In addition, in this example, members having the identical functions as the first embodiment are denoted by the identical reference symbols, and descriptions will be omitted for members which are not different from those in the first embodiment in terms of structure and function.

In this example, the sheet rear end regulating member 16 for regulating a sheet position of the sheet stack S is provided and, at the same time, a latch mechanism (regulating means) for holding a side cover 653 in a closed state is provided in a side cover 653.

The latch mechanism, which is a characteristic of this example, will be hereinafter described in detail.

A latch 17 is arranged inside the rear end regulating member 16 provided in the side cover 653, that is, on a surface not in contact with the sheet stack S on the sheet tray 5. The latch 17 is adjusted so as to engage with the slit 19 provided in a frame body of the sheet feeding apparatus 2 in a state in which the side cover 4 and an upper cover 651 are closed, and the latch 17 and the slit 19 are disengaged simultaneously with an opening of the upper cover 651.

The latch 17 is held so as to rotate freely around a shaft 17*a* provided inside the rear regulating member 16. In a state in which the upper cover 651 is opened, the latch 17 is biased to a first position shown in FIG. 22A by a tensile spring 17*a*. At this point, since the latch 17 and the slit 19 provided in the frame body of the sheet feeding apparatus 2 are disengaged, the side cover 653 can be opened and closed freely.

On the other hand, when the upper cover 651 is closed together with the side cover 653, a latch pressing section 18 integrally formed in the upper cover 651 abuts against the latch 17, and the latch 17 is pivoted to a second position shown in FIG. 22B around the shaft 17*a* against the tensile spring 20. At this point, the latch 17 engages with the slit 19 provided in the frame body of the sheet feeding apparatus 2, and side cover 653 is fixed so as not to be opened.

In the case in which the sheet rear end regulating member 16 is provided in a side cover, if the sheet stack S is not stacked in a desired position of the sheet tray 5, the side cover is kept not completely closed, which is likely to be a cause of troubles such as feeding failure and print accuracy failure. However, by adopting this example, the latch 17 does not pivot unless the side cover 653 is completely closed, and it is impossible to close the upper cover 51. Thus, a user can easily recognize that the side cover 653 is not closed, and can be urged to stack the sheet stack S in a desired position.

In addition, in the case in which there is a jam sheet in a transfer portion of the image forming apparatus main body 1 and the sheet feeding apparatus 2, it is necessary to remove the jam sheet after moving the sheet feeding apparatus 2 in a direction of arrow B in FIG. 20 to be separated from the image forming apparatus 2. In this case, there has been a problem in that, when the sheet feeding apparatus 2 is moved in a direction of arrow B rapidly and stopped, the side cover is opened by an inertia force of the large amount of sheet stack S stacked on the sheet tray 5. According to this example, such a problem can be avoided.

First other Example of the Elevating Mechanism for a Sheet Tray

A first other example of the elevating mechanism of a sheet tray will be described with reference to FIGS. 23 to 29. This example is different from the above-mentioned sheet feeding apparatus in the elevating mechanism of the sheet tray. The difference will be described in detail and, since other components are the same as those already described, detailed descriptions will be omitted for the other components.

A structure for controlling raising and lowering of the sheet tray 5 by opening and closing the cover, which is a characteristic of this example, will be described with reference to FIGS. 23 to 29.

Figure 23:
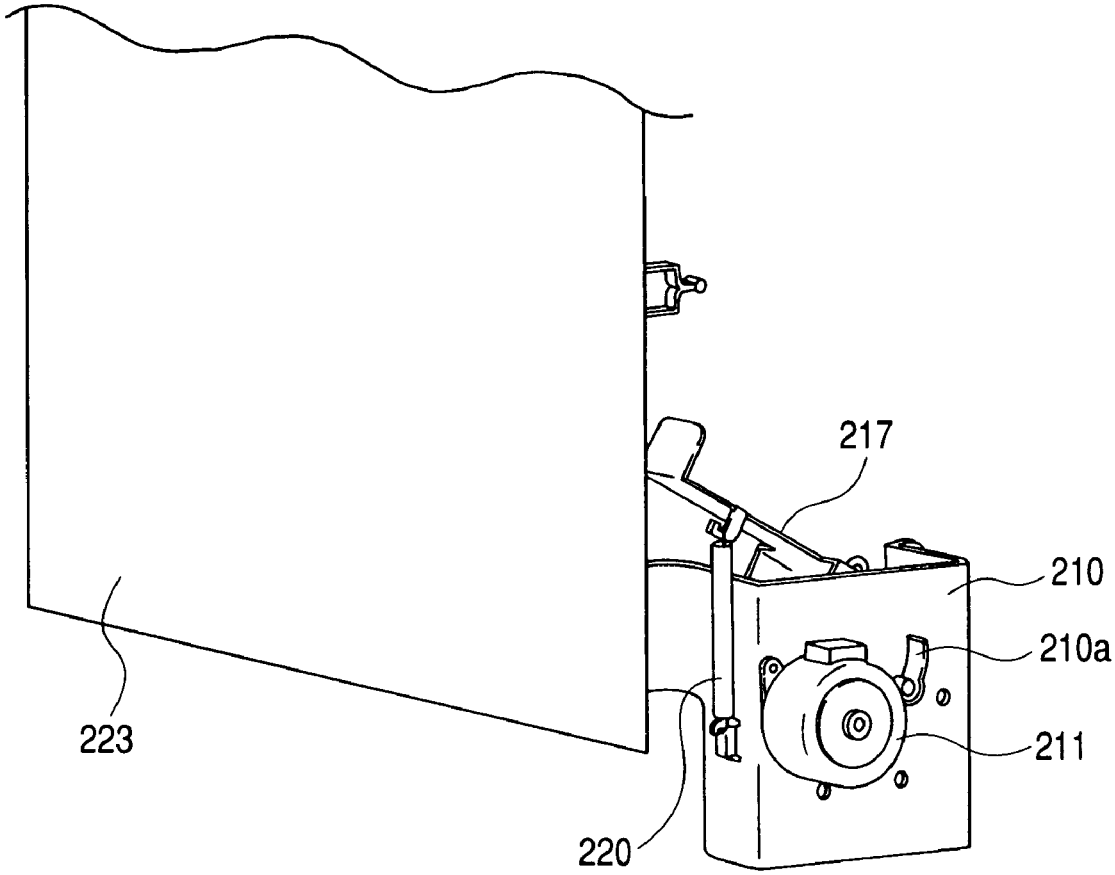
FIG. 23 is a perspective view of a lift-up mechanism viewed from the outside in a first other example of an elevating mechanism for a sheet tray.
Figure 24:
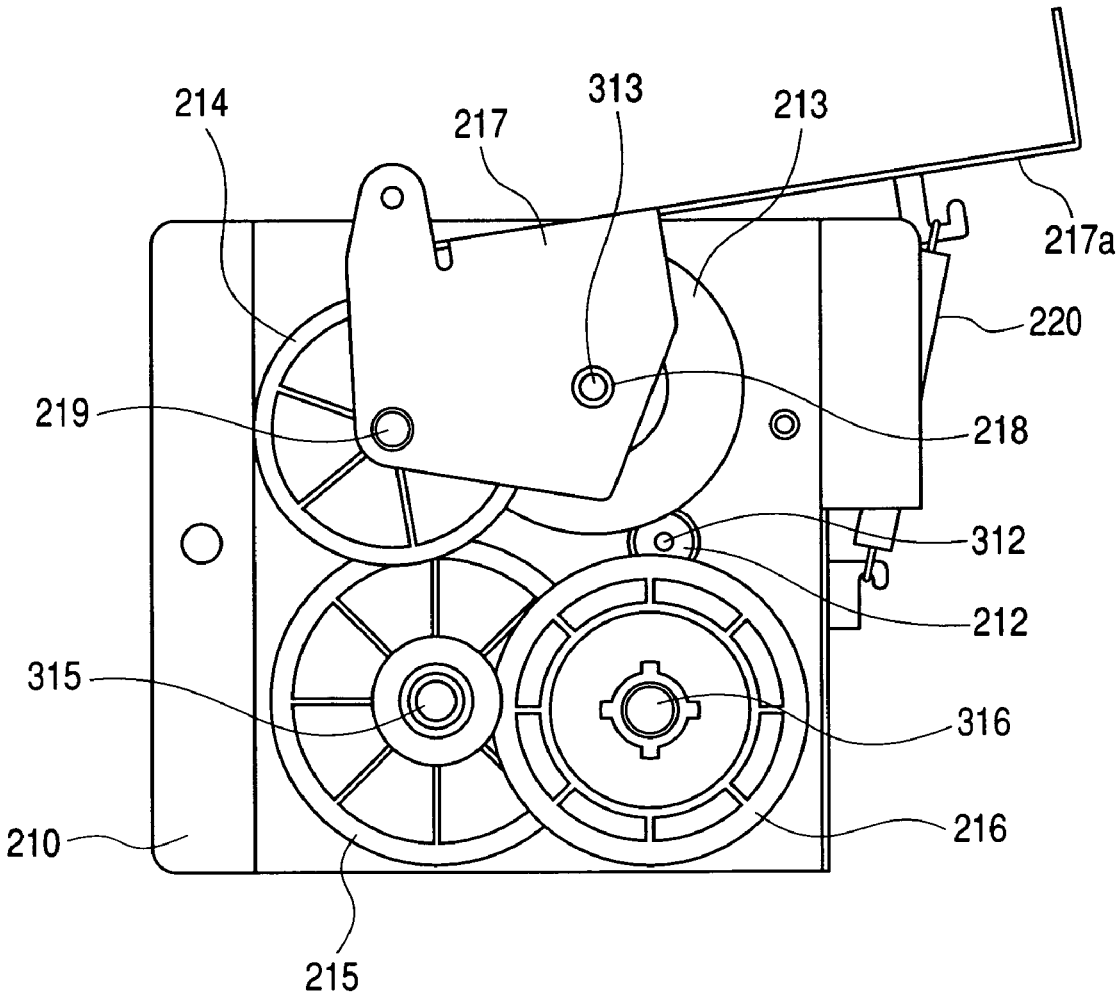
FIG. 24 is an explanatory view of the lift-up mechanism viewed from the inside in the first other example of the elevating mechanism for the sheet tray.
Figure 25:
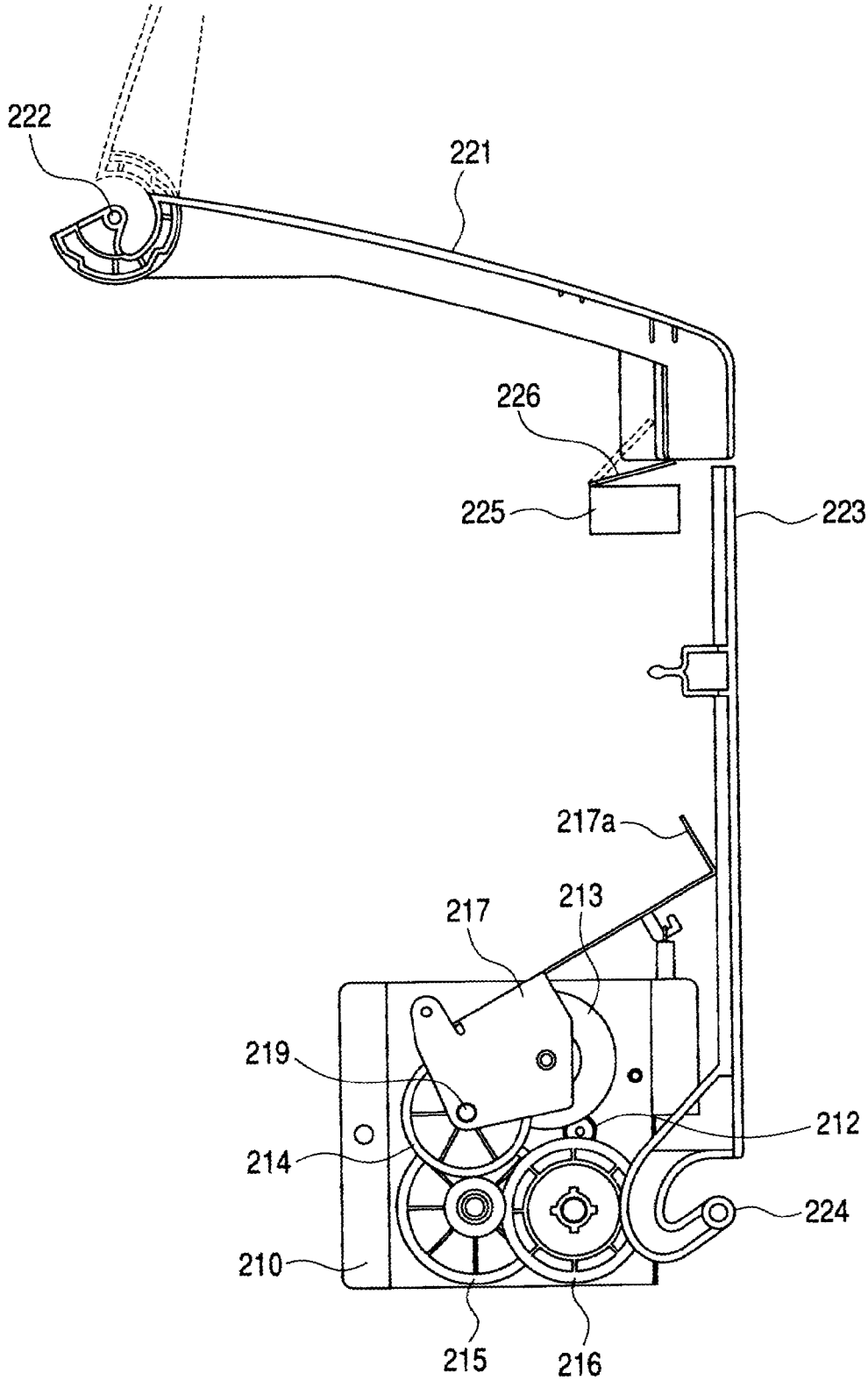
FIG. 25 is a schematic view showing a state in which an upper cover and a side cover are closed in the first other example of the elevating mechanism for the sheet tray.
Figure 27:
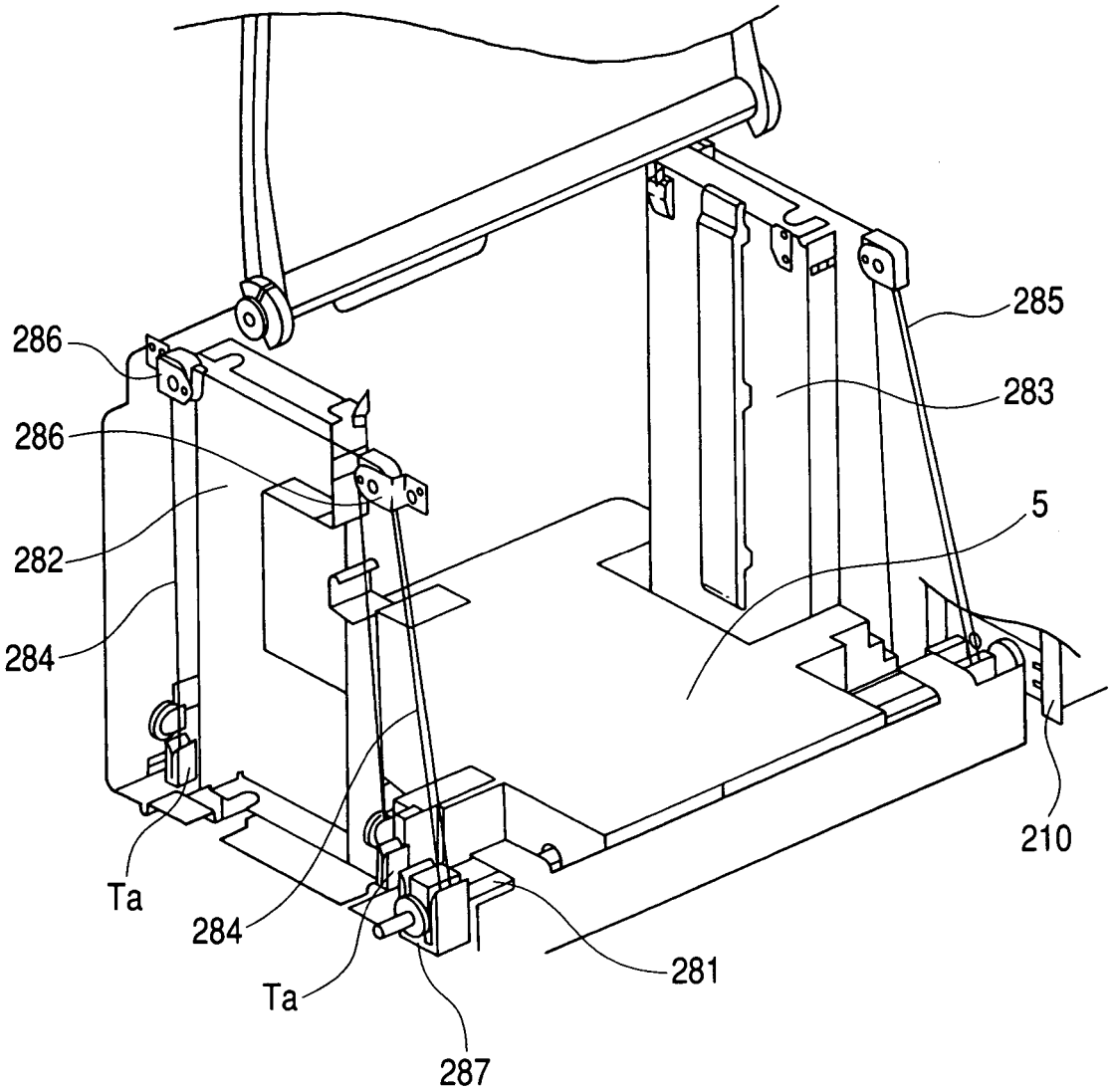
FIG. 27 is a perspective view illustrating a structure for raising and lowering the sheet tray in the first other example of the elevating mechanism for the sheet tray.
Figure 28:
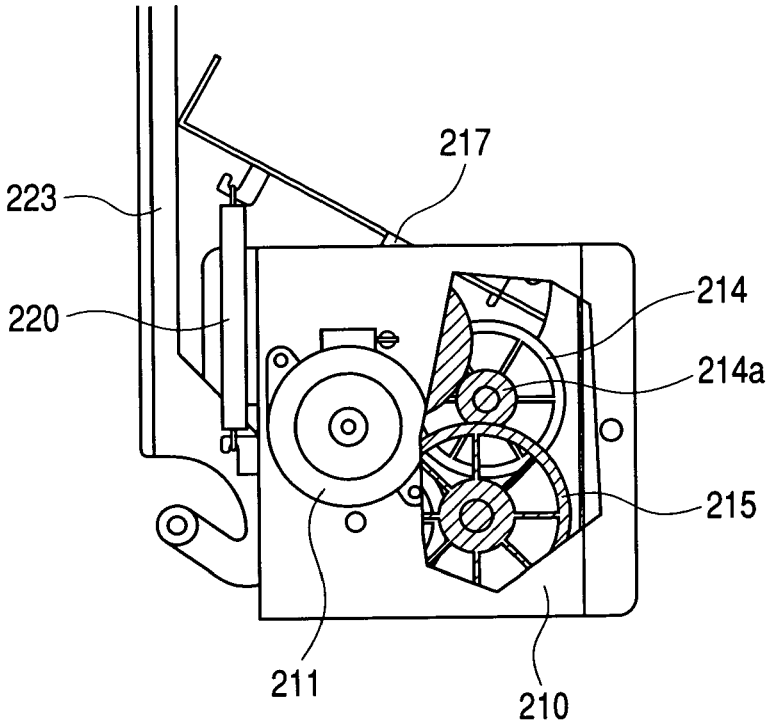
FIG. 28 is a view of the lift-up mechanism in the first other example of the elevating mechanism for the sheet tray (a state in which a side cover 23 is closed)
Figure 29:
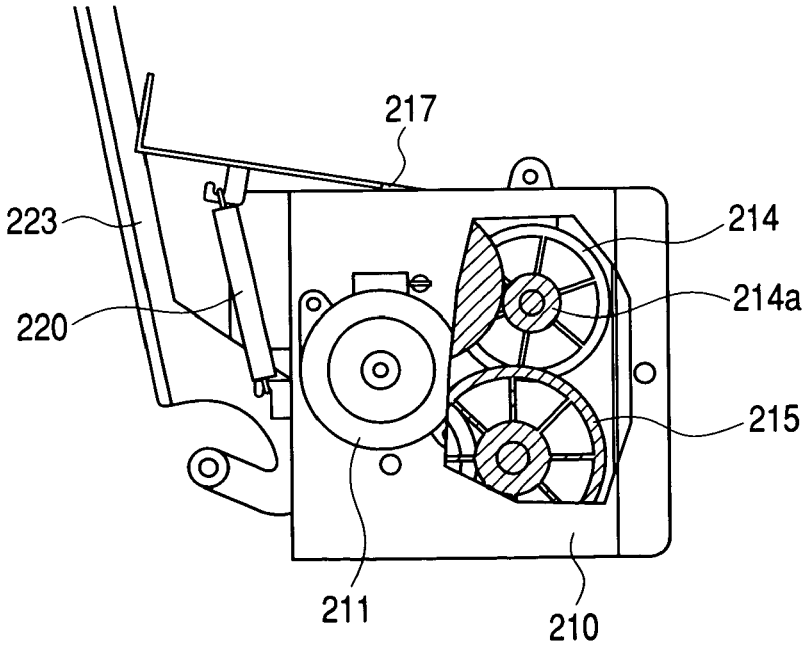
FIG. 29 is a view of the lift-up mechanism viewed from the outside in the first other example of the elevating mechanism for the sheet tray (a state in which the side cover 23 is opened)

First, a lift-up mechanism for raising and lowering the sheet tray 5 will be described with reference to FIGS. 23 to 29. FIG. 23 is a perspective view of a lift-up mechanism viewed from the outside. FIG. 24 is a view of the lift-up mechanism viewed from the inside. FIG. 25 is a view showing a positional relation among the lift-up mechanism, an upper cover 221, and a side cover 223. FIG. 27 is a perspective view illustrating a structure for raising and lowering the sheet tray 5. FIGS. 28 and 29 are detailed views showing a structure of a gear train which transmits a drive force for raising the sheet tray 5.

In FIG. 24, reference numeral 210 denotes a drive side plate fixed to the sheet feeding apparatus main body 2*a*, which holds a drive motor 211 generating a drive force for raising the sheet tray 5. The drive side plate 210 is provided with a motor gear shaft 312, a one-way gear shaft 313, an idler gear shaft 315, and a connection gear shaft 316. A motor gear 212, a one-way gear 213, an idler gear 215, and a connection gear 216 are attached to the shafts, respectively. A drive force of the drive motor 211 is transmitted to the connection gear 216 through the motor gear 212, the one-way gear 213, an oscillating gear 214 described later, and the idler gear 215. Note that the gear train of the present invention is constituted by the motor gear 212, the one-way gear 213, the oscillating gear 214, and the idler gear 215.

The one-way gear 213 contains a one-way clutch mechanism, and is rotatable in a direction for raising the sheet tray 5 but does not rotate in a direction for lowering the sheet tray 5. Since the one-way gear 213 does not rotate in the direction for lowering the sheet tray 5, even in the case in which drive electric power is not supplied to the drive motor 211 and the drive motor 211 is stopped, the sheet tray 5 is not lowered when gears of the gear train engage with each other.

Reference numeral 217 denotes an oscillating sheet metal. As shown in FIG. 25, an abutting portion 217*a* of the oscillating sheet metal 217 is provided so as to be able to abut against the side cover 223. The oscillating sheet metal 217 is attached to the drive side plate 210 such that it is oscillatable with an oscillation support shaft 218 provided in the drive side plate 210 as a fulcrum of oscillation. Reference numeral 220 denotes an oscillating spring, which is attached to the drive side plate 210 and the oscillating sheet metal 217 and biases the oscillating sheet metal 217 in a clockwise direction in FIG. 25. In a state in which the side cover 223 is closed, the abutting portion 217*a* of the oscillating sheet metal 217 abuts against the side cover 223, and oscillation of the oscillating sheet metal 217 in the clockwise direction is regulated. The oscillating sheet metal 217 is oscillated in a clockwise direction in FIG. 5 by a biasing force of the oscillating spring 220 following an opening of the side cover 223. Note that tray lowering means of the present invention is constituted by the oscillating sheet metal 217 and the oscillating spring 220.

The oscillating sheet metal 217 is provided with an oscillating gear shaft 219 to which the oscillating gear 214 is attached. The oscillating sheet metal 217 is oscillated with the oscillation support shaft 218 as a fulcrum, whereby the oscillating gear 214 provided in the oscillating gear shaft 219 is oscillated. The oscillating gear shaft 219 is inserted in a long hole 210*a* (shown in FIG. 23) formed in the drive side plate 210 and moves along the long hole 210*a* following oscillation of the oscillating sheet metal 217.

As shown in FIGS. 24 and 29, in a state in which the oscillating sheet metal 217 is not regulated by the side cover 223, since the oscillating gear 214 is oscillated upward and a small gear portion 214*a* of the oscillating gear 214 is separated from the idler gear 215, transmission of a drive force is interrupted. As shown in FIGS. 25 and 28, when oscillation of the oscillating sheet metal 217 is regulated by the side cover 223, since the small gear portion 214*a* of the oscillating gear 214 engages with the idler gear 215, a drive force is transmitted.

Reference numeral 225 denotes an interlock switch attached to the sheet feeding apparatus main body 2*a*, and a switch lever 226 moves to an open position or a close position following the opening and closing of the upper cover 21. The interlock switch 225 performs connection and interruption of power supply to the drive motor 211. In a state in which the switch lever 226 is closed, electric power is supplied to the drive motor 211. In a state in which the switch lever 226 is opened, the supply of electric power to the drive motor 11 is interrupted. Note that tray stopping means of the present invention is constituted by the interlock switch 225 and the switch lever 226.

FIG. 27 is a perspective view showing a structure for raising the sheet tray 5 with a drive force transmitted to the connection gear 216. The connection gear shaft 316 to which the connection gear 216 is attached is coupled with a winding shaft 281, which rotates with the drive force transmitted to the connection gear 216. A wire drum 287, which winds wires 284 and 285 for raising the sheet tray 5, is provided in the winding shaft 281.

A left side plate 282 and a right side plate 283 are vertically provided on the left and right of the sheet tray 5. Pulleys 286 for stretching the wires 284 and 285 are provided on the left side plate 282 and the right side plate 283, respectively. Projections Ta are formed at four corners of the sheet tray 5. The projections Ta of the sheet tray 5 are disposed on both end sides of the left side plate 282 and the right side plate 283, respectively.

One end of the wire 284 stretched by the pulley 286 is attached to the projection Ta of the sheet tray 5, and the other end of the wire 284 is attached to the wire drum 287. Since the wire drum 287 is attached to the winding shaft 281, when the drive force of the drive motor 211 is transmitted to the winding shaft 281 and the winding shaft 281 rotates, the wire drum 287 winds the wires 284 and 285 to raise the sheet tray 5.

In FIG. 29, only the left side plate 282 side is illustrated. However, on the right side plate 282 side, the wire 285, one end of which is attached to the projection Ta of the sheet tray 5 and the other end of which is attached to a wire drum, is stretched by pulleys provided on the right side plate 283 in the same manner.

Next, a switching operation of raising and lowering of the sheet tray 5 following the opening or closing of the upper cover 221 and the side cover 223 will be described.

The switch lever 226 is closed in a state in which the upper cover 221 is closed as shown in FIG. 25, and drive electric power is supplied from the controller to the drive motor 11, and the sheet tray 5 is raised. In the state in which the upper cover 221 and the side cover 223 are closed as shown in FIG. 25, the sheet tray 5 is raised until it is detected by the sheet surface detecting sensor U that an uppermost sheet supported by the sheet tray 5 has reached a predetermined sheet feeding position.

The sheet tray 5 is stopped by an operation for opening the upper cover 221 from the state in which the upper cover 221 and the side cover 223 are closed shown in FIG. 25. Dotted lines in FIG. 25 indicates a state in which the upper cover 221 is opened, and the switch lever 226 comes into an opened state according to the opening of the upper cover 221. Since the switch lever 226 is in the opened state, the drive electric power to the drive motor 211 is interrupted by the interlock switch 225. Since the electric power to the drive motor 211 is interrupted, the sheet tray 5 is not raised. Since the one-way gear 213 does not rotate in a direction for lowering the sheet tray 5 as described above, due to a holding function of the one-way gear 213, the sheet tray 5 is not lowered but is held at the height when the upper cover 221 was opened even if the drive electric power to the drive motor 211 is interrupted.

Figure 26:
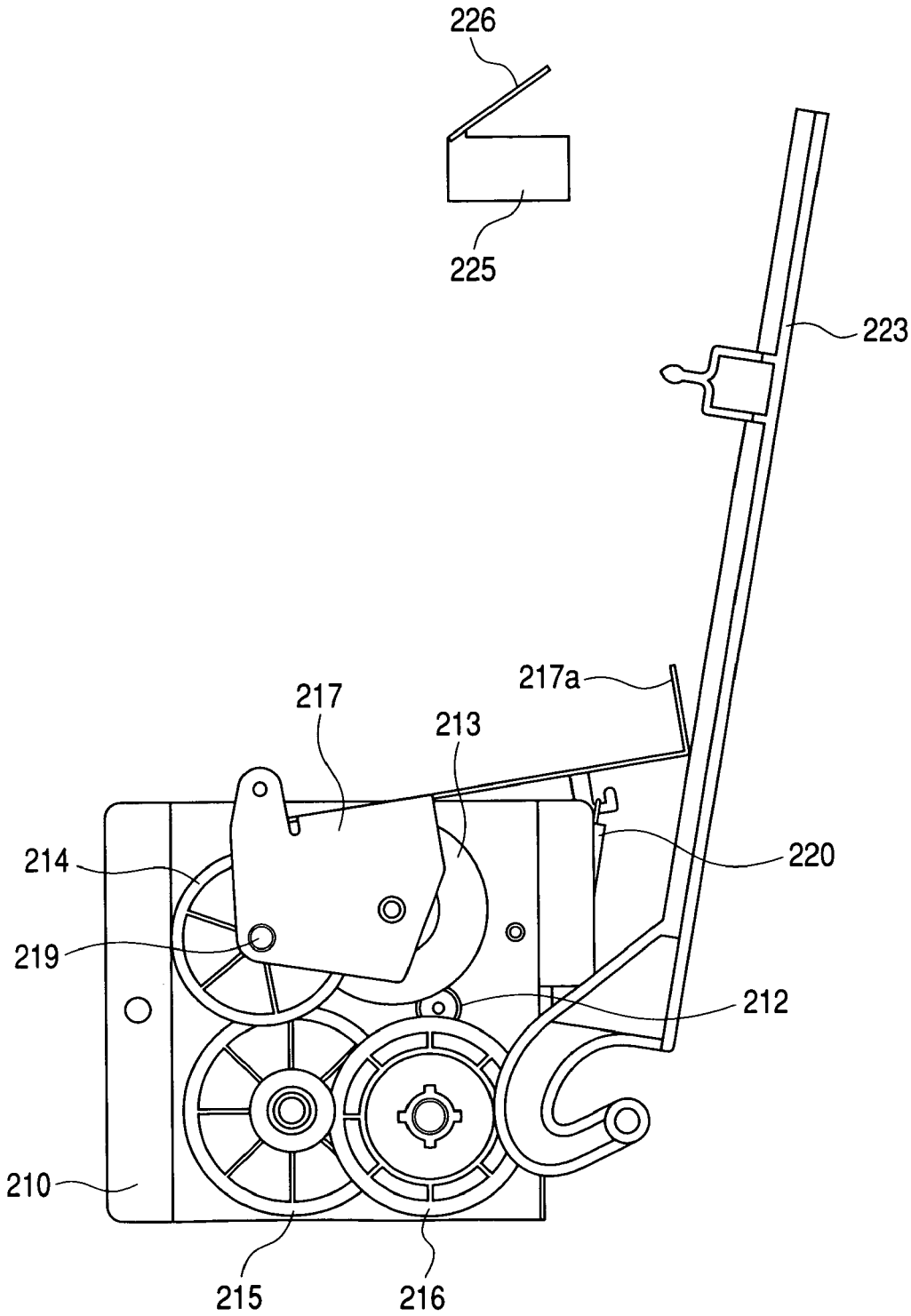
FIG. 26 is a schematic view showing a state in which the upper cover and the side cover are opened in the first other example of the elevating mechanism for the sheet tray.

When the side cover 223 is opened as shown in FIG. 26, the oscillating sheet metal 217 is oscillated by a urging force of the oscillating spring 220 following the opening operation of the side cover 223. The oscillating gear 214 attached to the oscillating gear shaft 219 provided on the oscillating sheet metal 217 is moved by oscillation of the oscillating sheet metal 217, and the small gear portion 214*a* of the oscillating gear 214 and the idler gear 215 are disengaged to separate the oscillating gear 214 and the idler gear 215. Since the oscillating gear 214 and the idler gear 215 are located on a downstream side in a transmission direction of the drive force of the one-way gear 213, the small gear portion 214*a* of the oscillating gear 214 and the idler gear 215 are disengaged, whereby the holding function of the one-way gear 213 is released, and the sheet tray T falls to a lowermost position due to its own weight. That is, the oscillating sheet metal 217 is moved by the operation for opening the side cover 223 to disengage the oscillating gear 214 and the idler gear 215, and the sheet tray 5 starts to be lowered.

When the side cover 223 is closed, the oscillating sheet metal 217 is oscillated in a clockwise direction in FIG. 24 following the operation for closing the side cover 223. The oscillating gear 214 attached to the oscillating gear shaft 219 provided in the oscillating sheet metal 217 is moved by the oscillation of the oscillating sheet metal 217. The small gear portion 214*a* of the oscillating gear 214 and the idler gear 215 engage with each other according to the movement of the oscillating gear 214 following the operation for closing the side cover 223.

Even if the oscillating gear 214 and the idler gear 215 engage with each other according to the operation for closing the side cover 223, since electric power is not supplied to the drive motor in the case in which the upper cover 221 is opened, the sheet tray T is not raised. The sheet tray 5 starts to be raised by closing the upper cover 221 in a state in which the side cover 223 is closed.

Note that, in this example, a structure is described in which the oscillating gear 214 is moved such that the oscillating gear 214 and the idler gear 215, which are provided on the downstream side in the transmission direction of a drive force of the one-way gear 213, are disengaged following the opening of the side cover 223. However, the present invention is not limited to this, and the oscillating gear 214 may be moved such that the one-way gear 213 and the oscillating gear 214 are disengaged. In addition, the oscillating gear 214 may be used as a one-way gear.

Note that, in this example, the gear, which does not rotate in a direction in which the sheet tray T is lowered, is shown as the one-way gear 213. However, a gear that regulates rotation to a predetermined torque realizes the same effect.

Note that, in this example, effects characteristic of this example as described below are realized.

1. Since the sheet tray 5 is stopped by the opening of the upper cover 221 and the sheet tray 5 is lowered by the opening of the side cover 223, a user only has to open a necessary cover of the two covers, whereby workability is improved.
2. Since, even if only the upper cover 221 is opened, the sheet tray 5 is not lowered but keeps a height at the time when the upper cover 221 is opened, in the case in which the upper cover 221 is opened in order to perform jam treatment, the sheet tray T is not lowered, and productivity of an image forming apparatus never falls due to unnecessary raising and lowering of the sheet tray.
3. Since the sheet tray 5 starts to be lowered according to an opening operation of the side cover 223, there is no waiting time during which a user waits for the sheet tray 5 to be lowered, whereby workability at the time of sheet supply is improved and, at the same time, decrease in productivity of the image forming apparatus is prevented.
4. Since supply of electric power to the drive motor 211 is interrupted in a state in which the upper cover 221 is opened, and the sheet tray 5 is not raised even if the side cover 223 is closed in a state in which the upper cover 221 is opened, the sheet tray 5 is not raised when any one of the two covers is opened.

Note that, in this example, a structure is described in which the interlock switch 225 performs connection and interruption of power supply to the drive motor 211. However, the cover detecting sensor 62 described in the first embodiment or the cover detecting sensor 73 described in the second embodiment may be provided to interrupt power supply to the drive motor 211 in the case in which it is detected by the cover detecting sensor that either an upper cover or a side cover is opened.

Second other Example of the Elevating Mechanism for a Sheet Tray

FIGS. 30 to 34 shows a second other example of the present invention concerning an elevating mechanism for a sheet tray. In the first other example of the elevating mechanism for a sheet tray, supply of electric power to the drive motor 211 is interrupted by the opening of the upper cover 221 to stop raising of the sheet tray 5. This example is different from the first example in that an oscillating sheet metal is moved following the opening of the upper cover 221 to disengage gears for transmitting a drive force of a drive motor, whereby the sheet tray 5 is stopped. The difference will be described in detail and, since other components are the same as those already described, detailed descriptions will be omitted for the other components.

Figure 30:
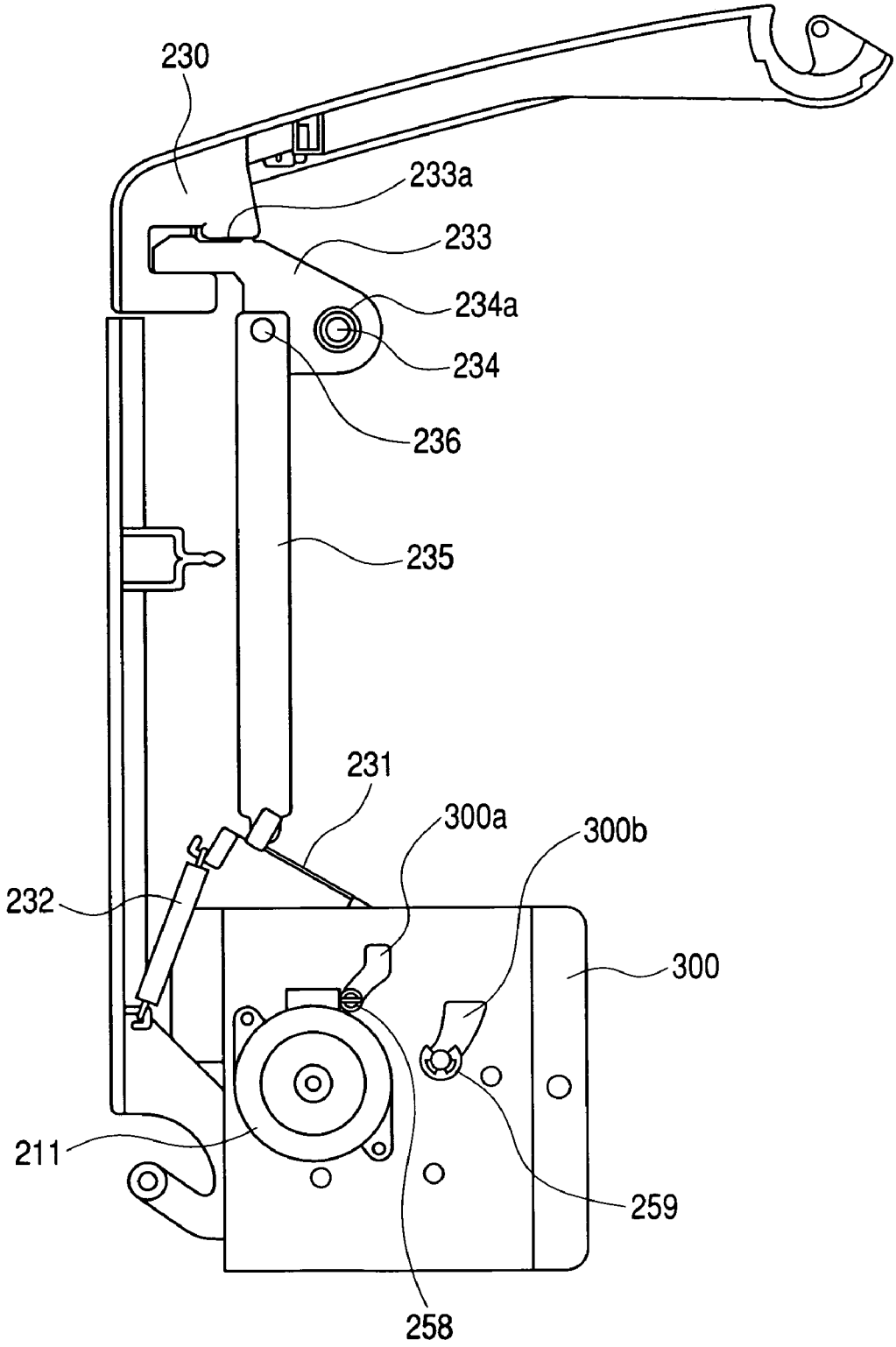
FIG. 30 is an explanatory view of a lift-up mechanism from the inside in a second other example of an elevating mechanism for a sheet tray.
Figure 31:
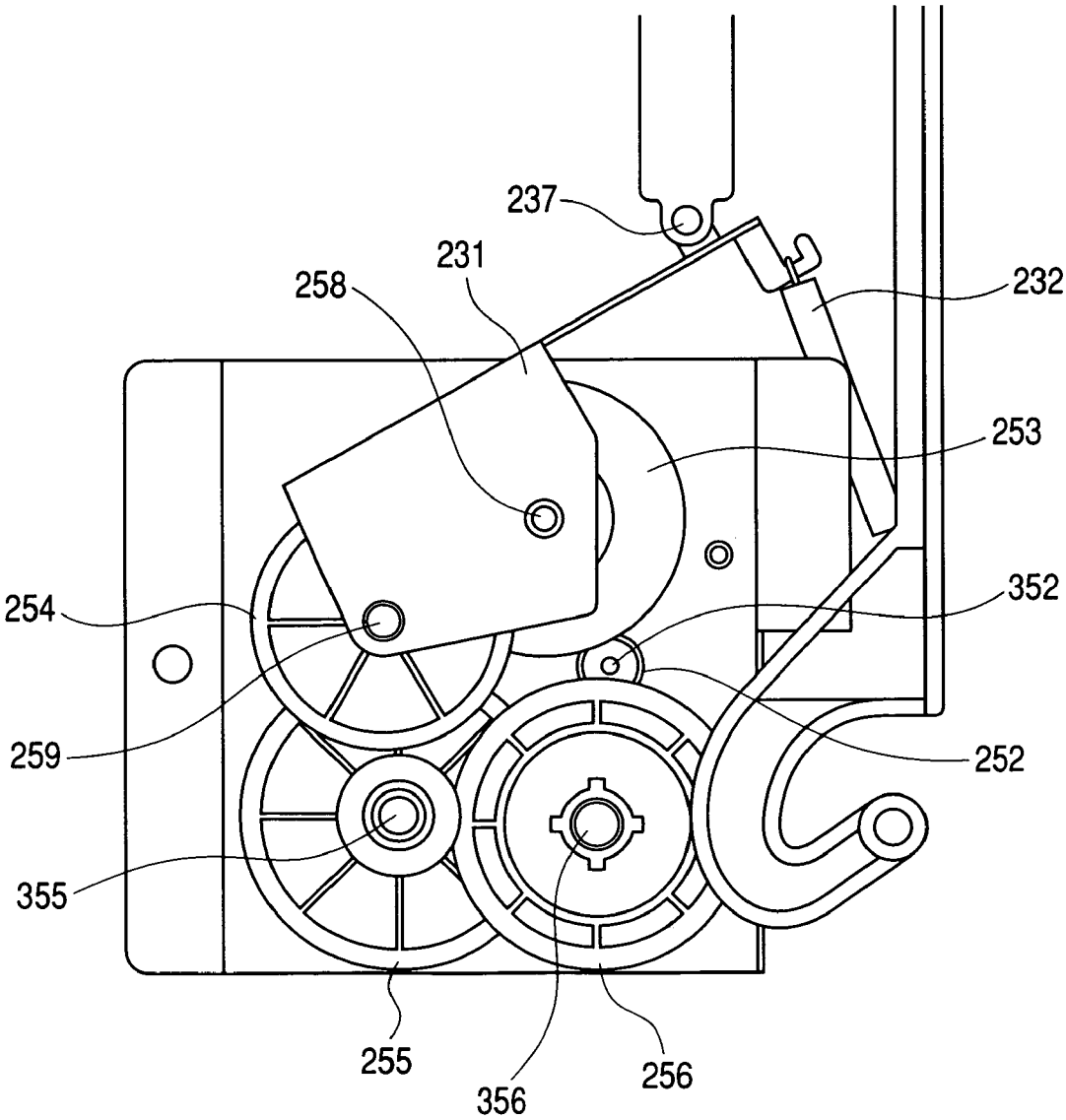
FIG. 31 is an explanatory view of the lift-up mechanism viewed from the outside in the second other example of the elevating mechanism for the sheet tray.

First, a structure of a lift-up mechanism for raising and lowering the sheet tray 5 will be described with reference to FIGS. 30 and 31. FIG. 30 is a view showing a positional relation among the lift-up mechanism, the upper cover 221, and the side cover 223. FIG. 31 is a view of the lift-up mechanism viewed from the inside thereof.

Reference numeral 211 denotes a drive motor, which is a power source for the lift-up mechanism. A drive side plate 300 fixed to the sheet feeding apparatus main body 2*a* holds the drive motor 211, a motor gear shaft 352 to which a motor gear 252 is attached, an idler gear shaft 355 to which an idler gear 255 is attached, and a connection gear shaft 356 to which a connection gear 256 is attached. A drive force generated by the drive motor 211 is transmitted from the motor gear 252 coupled to the drive motor 211 to the connection gear 256 through an oscillatable one-way gear 253, an oscillating gear 254, and the idler gear 255. As in the first other example of the elevating mechanism for a sheet tray, the rotation drive force transmitted to the connection gear 256 is transmitted to a winding shaft to rotate the winding shaft, and a wire is wound by a wire drum provided in the winding shaft to raise the sheet tray 5.

Reference numeral 231 denotes an oscillating sheet metal, which holds a one-way gear shaft 258 provided with the oscillatable one-way gear 253 and an oscillating gear shaft 259 provided with the oscillating gear 254. Long holes 300*a* and 300*b* are formed in the drive side plate 300. The one-way gear shaft 258 and the oscillating gear shaft 259 held by the oscillating sheet metal 231 are inserted in the long holes 300*a* and 300*b*, respectively, to be movable along the long holes 300*a* and 300*b*. The one-way gear shaft 258 or the oscillating gear shaft 259 moves along the long hole 300*a* or 300*b*, whereby the oscillating sheet metal 231 is oscillated along the drive side plate 300.

Reference numeral 233 denotes an upper cover interlocking member, both ends of which are attached pivotably to a lever fulcrum 234, which is attached to the sheet feeding apparatus main body 2*a*, with the lever fulcrum 234 as a pivotal center. The upper cover interlocking member 233 is biased in a clockwise direction in FIG. 32 by a biasing spring 234*a* with the lever fulcrum 234 as a fulcrum. In a state in which the upper cover 221 is closed, an upper cover abutting portion 230 integrally provided in the upper cover 221 and an abutting portion 233*a* of the upper cover interlocking member 233 abut with each other to regulate pivoting of the upper cover interlocking member 233. The upper cover interlocking member 233 is pivoted in the clockwise direction in FIG. 32 by a biasing force of the biasing spring 234*a* following an operation for opening the upper cover 221.

Reference numeral 235 denotes an oscillating link, one end of which is pivotably attached to a first link fulcrum 236 provided in the upper cover interlocking member 233 and the other end of which is pivotably attached to a second link fulcrum 237 provided in the oscillating sheet metal 231 with the respective fulcrums as pivotal centers. The upper cover interlocking member 233 is pivoted following an operation for opening the upper cover 223 to move the oscillating link 235 upward. The oscillating sheet metal 231 is oscillated following the upward movement of the oscillating link 235. A shape of the long holes 300*a* and 300*b* is set such that the oscillation of the oscillating sheet metal 231 following the upward movement of the oscillating link 235 is performed with the oscillating gear shaft 259 as a fulcrum as the one-way gear shaft 258 moves along the long hole 300*a* of the drive side plate 300.

Reference numeral 232 denotes an oscillating spring, one end of which is attached to the side cover 223 and the other end of which is attached to the oscillating sheet metal 231. By opening the side cover 223, the oscillating spring 232 is extended and a biasing force is generated to oscillate the oscillating sheet metal 231 in the clockwise direction in FIG. 32 with the second link fulcrum 237 as a fulcrum. A shape of the long holes 300*a* and 300*b* is set such that the oscillation of the oscillating sheet metal 231 following the operation for opening the side cover 223 is performed with the second link fulcrum 237 as a fulcrum as the oscillating gear shaft 259 moves along the long hole 300*b* formed in the drive side plate 300. Note that tray stopping means of the present invention is constituted by the upper cover abutting portion 230, the upper cover interlocking member 223, the oscillating link 235, and the oscillating sheet metal 231, and tray lowering means of the present invention is constituted by the oscillating link 235, the oscillating sheet metal 231, and the oscillating spring 232.

An oscillating operations of the oscillating sheet metal 231 and a switching operation of raising and lowering of the sheet tray 5 following opening and closing operations of the upper cover 221 and the side cover 223 will be hereinafter described.

Figure 32:
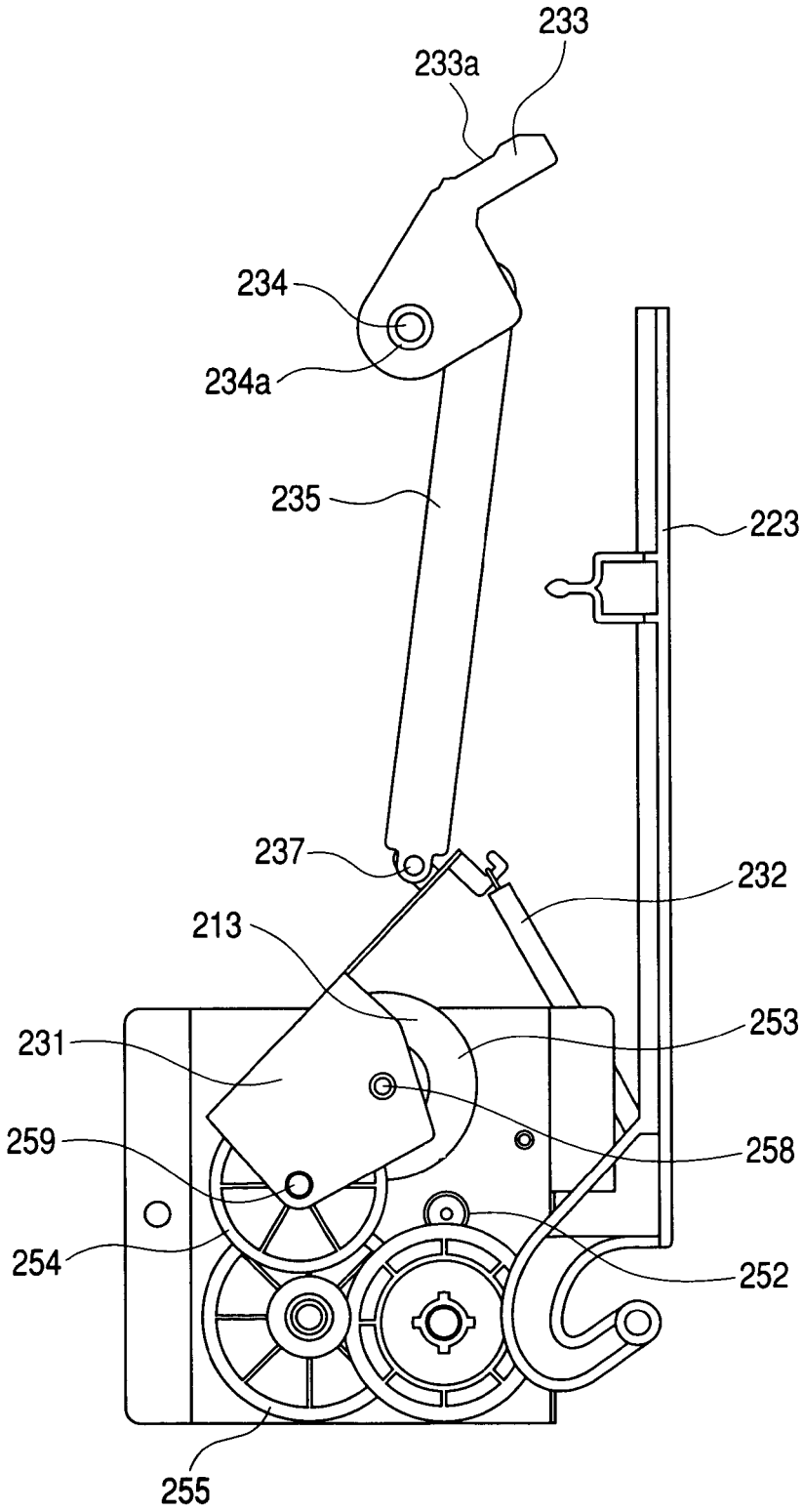
FIG. 32 is a schematic view showing a state in which an upper cover is opened and a side cover is closed in the second other example of the elevating mechanism for the sheet tray.

In a state in which the upper cover 221 and the side cover 223 are closed shown in FIG. 32, since the motor gear 252, the oscillatable one-way gear 253, the oscillating gear 254, the idler gear 255, and the connection gear 256 engage with each other, and a drive force of the drive motor 211 is transmitted to the connection gear 256, the sheet tray T is raised. In the state in which the upper cover 221 and the side cover 223 are closed, the sheet tray T is raised until it is detected by a paper surface detecting sensor U that an uppermost sheet supported in the sheet tray T has reached a predetermined sheet feeding position.

When the upper cover 221 is opened as shown in FIG. 32, the upper cover interlocking member 233 and the upper cover abutting portion 230 separate from each other following an operation for opening the upper cover 221, and the upper cover interlocking member 233 is pivoted in a clockwise direction in FIG. 30 by the biasing spring 234*a* around the lever fulcrum 234. Since the first link fulcrum 236 provided in the upper cover interlocking member 233 is moved by the pivoting of the upper cover interlocking member 233, the oscillating link 235 attached to the first link fulcrum 236 is moved upward. The oscillating sheet metal 231 is oscillated following the upward movement of the oscillating link 235. In this case, the oscillating sheet metal 231 is oscillated with the oscillating gear shaft 259 as a fulcrum such that the one-way gear shaft 258 moves along the long hole 300*a*. The motor gear 252 and the oscillatable one-way gear 253 are disengaged by the oscillation of the oscillating sheet metal 231 while the oscillating gear 254 and the idler gear 255 are kept engaged.

Since a drive force of the drive motor 211 is not transmitted to the sheet tray 5 as the motor gear 252 and the oscillatable one-way gear 253 are disengaged, raising of the sheet tray 5 is stopped. However, since the gear train from the connection gear 256 to the oscillatable one-way gear 253 is coupled and the oscillatable one-way gear 253 does not rotate in a direction for lowering the sheet tray 5, the sheet tray 5 is stopped without being lowered. In the state in which the upper cover 221 is opened, the upper cover interlocking member 233 is stopped in a predetermined position in a state in which it is biased by the biasing spring 234*a*. Consequently, in the state in which the upper cover 221 is opened, the sheet tray 5 is maintained in a state in which the motor gear 252 and the oscillatable one-way gear 253 are kept disengaged. That is, the sheet tray 5 is stopped by the operation for opening the upper cover 221 without being lowered from the state in which the upper cover 221 and the side cover 223 are closed, and the sheet tray T keeps a height at the time when the upper cover 221 is opened.

In addition, a stopped position of the upper cover interlocking member 233 in a state in which the side cover 223 is closed and the upper cover 221 is opened, is a position where the upper cover abutting portion 230 abuts against the abutting portion 233*a* of the upper cover interlocking member 233 when the upper cover 221 is closed, and the upper cover interlocking member 233 can return to the initial position shown in FIG. 32. Thus, when the upper cover 221 is closed from the state in which the side cover 223 is closed, the upper cover abutting portion 230 and the abutting portion 233*a* of the upper cover interlocking member 233 abut with each other, and the upper cover abutting portion 230 pivots the upper cover interlocking member 233 against a biasing force of the biasing spring 234*a*. The oscillating sheet metal 231 is oscillated in a clockwise direction in FIG. 34 by the pivoting of the upper cover interlocking member 233 with the oscillating gear shaft 259 as a fulcrum. The motor gear 252 and the oscillatable one-way gear 253 engage with each other according to the oscillation of the oscillating sheet metal 231 and a drive force of the drive motor 211 is transmitted to the sheet tray 5 to raise the sheet tray 5.

Figure 33:
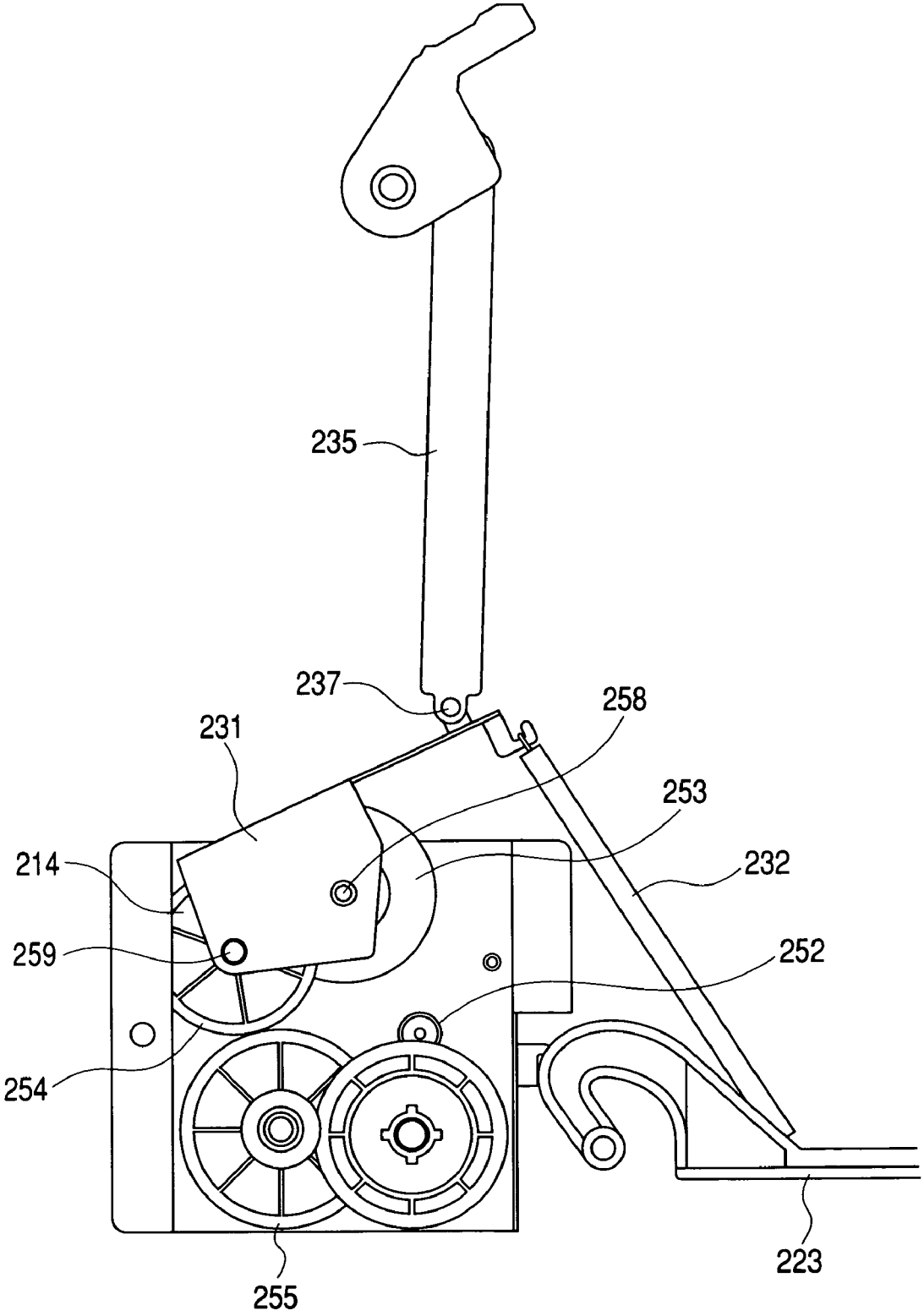
FIG. 33 is a schematic view showing a state in which the upper cover and the side cover are opened in the second other example of the elevating mechanism for the sheet tray.

As shown in FIG. 33, when the side cover 223 is opened from a state in which the upper cover 221 is opened, the oscillating spring 232 attached to the side cover 223 is extended according to the opening of the side cover 223, and the oscillating sheet metal 231 is oscillated in the clockwise direction in FIG. 32 by a biasing force of the oscillating spring 232 around the second link fulcrum 237. The oscillation of the oscillating sheet metal 231 caused by opening the side cover 223 is performed with the link fulcrum 237 as a fulcrum as the oscillating gear shaft 259 moves along the long hole 300*b* of the drive side plate 300. Thus, the oscillating gear 254 and the idler gear 255 are disengaged by the oscillation of the oscillating sheet metal 231 following the opening of the side cover 223. The holding mechanism of the one-way gear 253 is released as the gear train further downstream than the one-way gear 253 is released, whereby the sheet tray 5 falls to a lowermost position due to its own weight.

When the upper cover 223 is closed from a state in which the upper cover 221 and the side cover 223 are opened, the oscillating sheet metal 231 is pivoted in a counterclockwise direction, and the oscillating gear 254 and the idler gear 255 engage with each other. In the case in which the upper cover 221 is opened even if the side cover 223 is closed, since the motor gear 252 and the oscillatable one-way gear 253 are kept disengaged, a drive force of the drive motor 211 is not transmitted to the sheet tray 5, and the sheet tray 5 is not raised.

Figure 34:
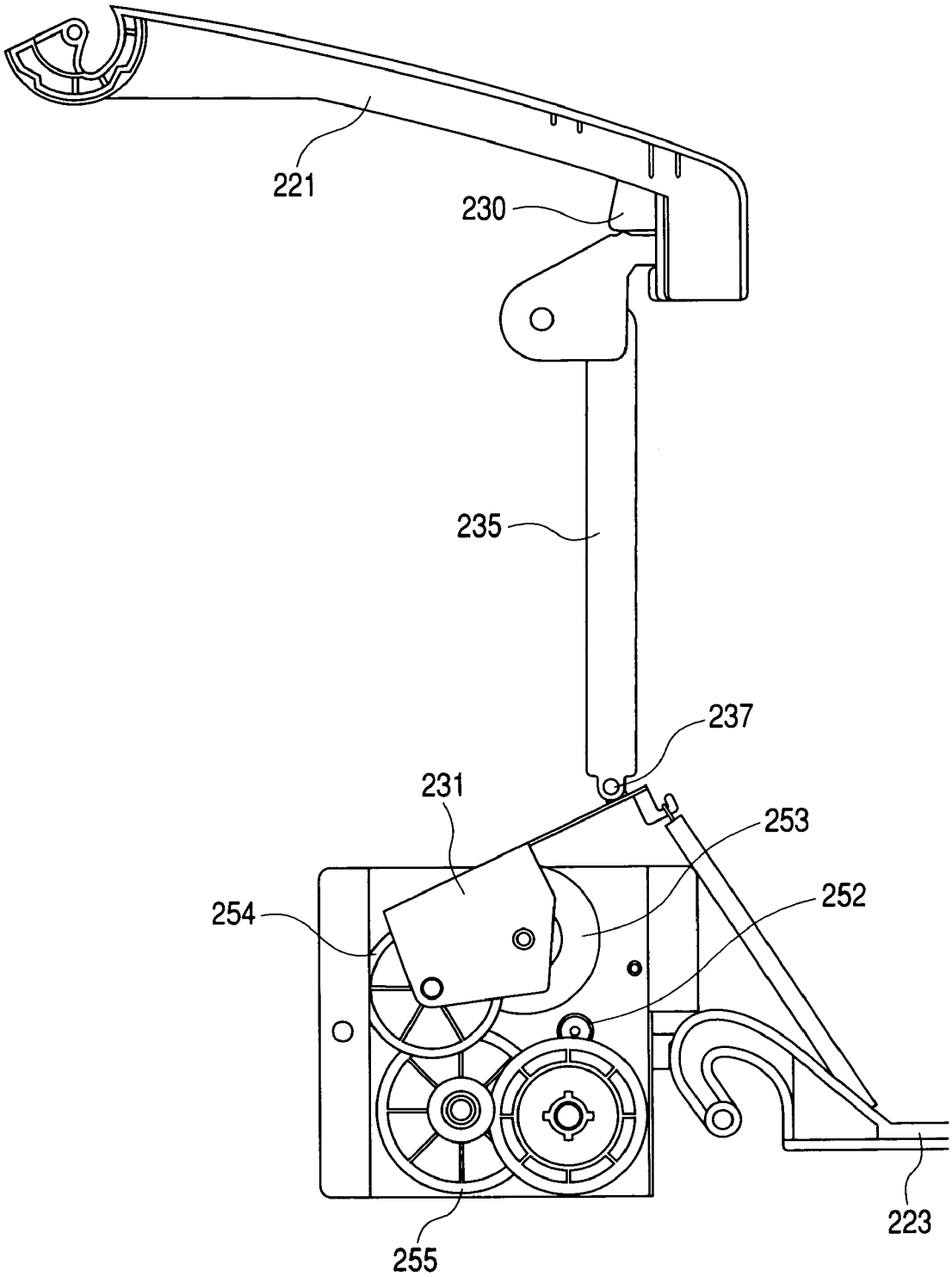
FIG. 34 is a schematic view showing a state in which the upper cover is closed and the side cover is opened in the second other example of the elevating mechanism for the sheet tray.

FIG. 34 shows a state in which the upper cover 221 is closed from a state in which the side cover 223 is opened. By closing the upper cover 221, the upper cover interlocking member 233 abuts against the upper cover abutting portion 230 to be pivoted in the clockwise direction, and the oscillating link 235 is moved downward by the pivoting of the cover interlocking member 233. However, since the oscillating spring 232 is extended by the opening of the side cover 223 and the oscillating sheet metal 231 is biased in the clockwise direction by the oscillating spring 232 around the second link fulcrum, the motor gear 252 and the oscillatable one-way gear 253, as well as the oscillating gear 254 and the idler gear 255 are kept disengaged. That is, the sheet tray 5 is not raised even if the upper cover 221 is closed in a state in which the side cover 223 is opened.

Note that, in this example, the oscillating spring 232 also functions as a buffer spring for the side cover 223.

Note that, in this example, a structure is described in which, following the opening of the upper cover 223, the oscillatable one-way gear 253 is moved so as to disengage the oscillatable one-way gear 253 and the motor gear 252, which engages with the oscillatable one-way gear 253 and is provided on the upstream side in a drive force transmission direction of the oscillatable one-way gear 253. However, the present invention is not limited to this, and a gear provided on an upstream side in a drive force transmission direction of a one-way gear may be moved such that gears provided on the upstream side in the drive force transmission direction of the one-way gear are disengaged following the opening of the upper cover 223.

Note that, in this example, a structure is described in which the oscillating gear 254 is moved such that the oscillating gear 254 and the idler gear 255, which are provided on the downstream side in the drive force transmission direction of the oscillatable one-way gear 253, are disengaged in accordance with the opening of the side cover 223. However, the present invention is not limited to this, and the oscillating gear 254 may be moved such that the one-way gear 253 and the oscillating gear 254 are disengaged. In addition, a one-way gear may be used as the oscillating gear 254.

Note that, in this example, a gear which does not rotate in a direction for lowering the sheet tray 5 is described as the oscillatable one-way gear 253. However, the same effect is realized by a gear which regulates rotation to a predetermined torque.

Note that, in this example, in addition to the effect in the first other example of the elevating mechanism for a sheet tray, by providing a link member which is constituted by two covers and operates according to opening and closing operations of two covers opening and closing for sheet supply or jam treatment, it becomes possible to perform release and coupling of driving without disconnecting electric wiring of a drive motor, and reduction of costs for electric components and simplification of wiring work can be realized.

Note that, in this example, the cover detecting sensor 62 described in the first embodiment or the cover detecting sensor 73 described in the second embodiment of the present invention may be further provided to interrupt power supply to the drive motor 211 in the case in which the cover detecting sensor detects that an upper cover or a side cover is opened.

Third other Example of the Elevating Mechanism for a Sheet Tray

FIGS. 35 to 39 shows a third other example of the elevating mechanism for a sheet tray. In the already described first other example of the elevating mechanism for a sheet tray, a structure is adopted in which electric power supply to the drive motor 211 is interrupted by the opening of the upper cover 221, and an oscillating sheet metal is oscillated following the opening of the side cover 223 and gears provided in the oscillating sheet metal are disengaged to control raising and lowering of the sheet tray T. This example is different from the first other example in that an oscillating sheet metal is moved by movement of a cover interlocking member, which is capable of abutting against and separating from each of the upper cover 221 and the side cover 223, to switch raising and lowering of the sheet tray 5. The difference will be described in detail and, since other components are the same as those already described, detailed descriptions will be omitted for the other components.

Figure 35:
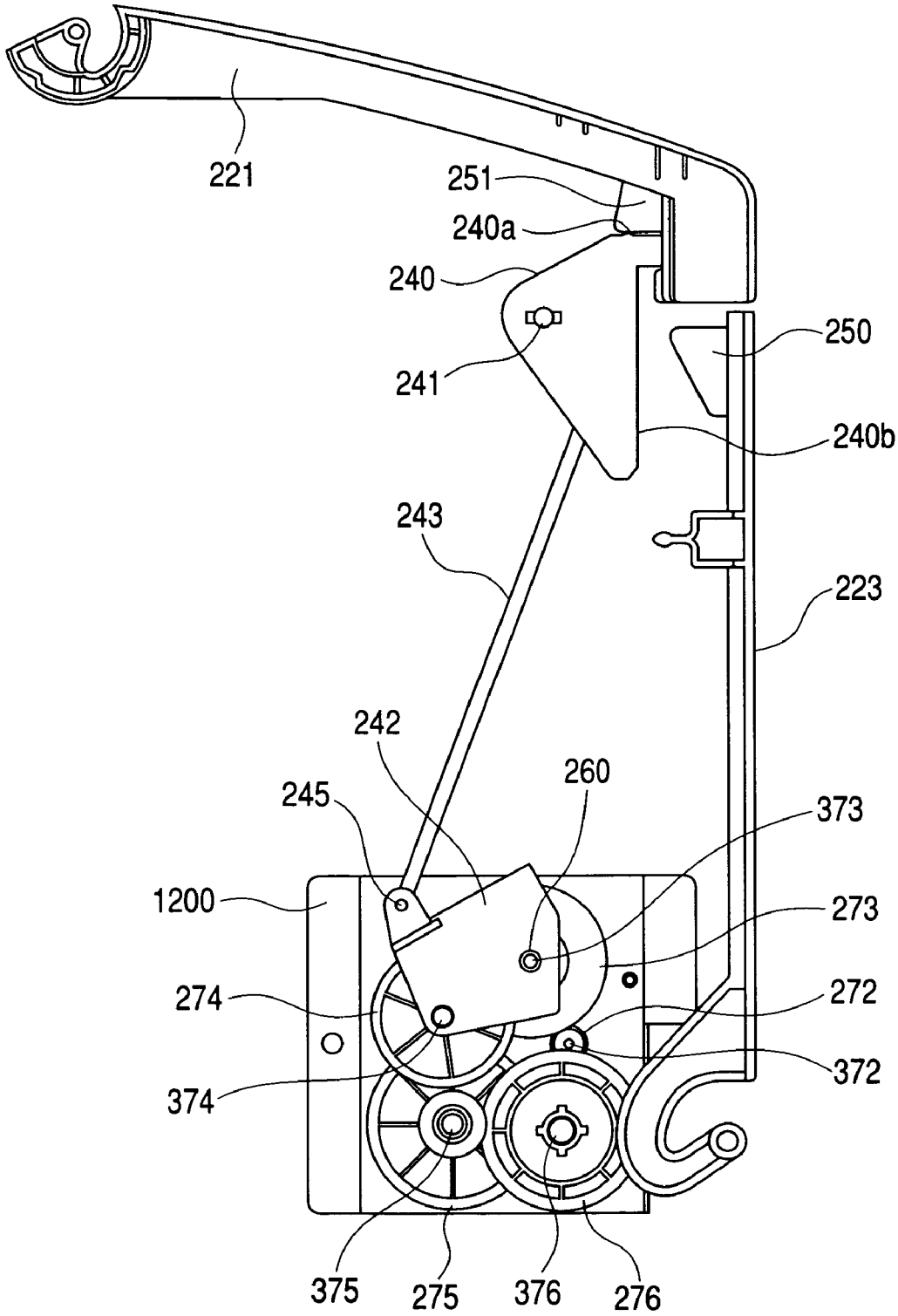
FIG. 35 is an explanatory view of a lift-up mechanism from the inside in a third other example of an elevating mechanism for a sheet tray.
Figure 36:
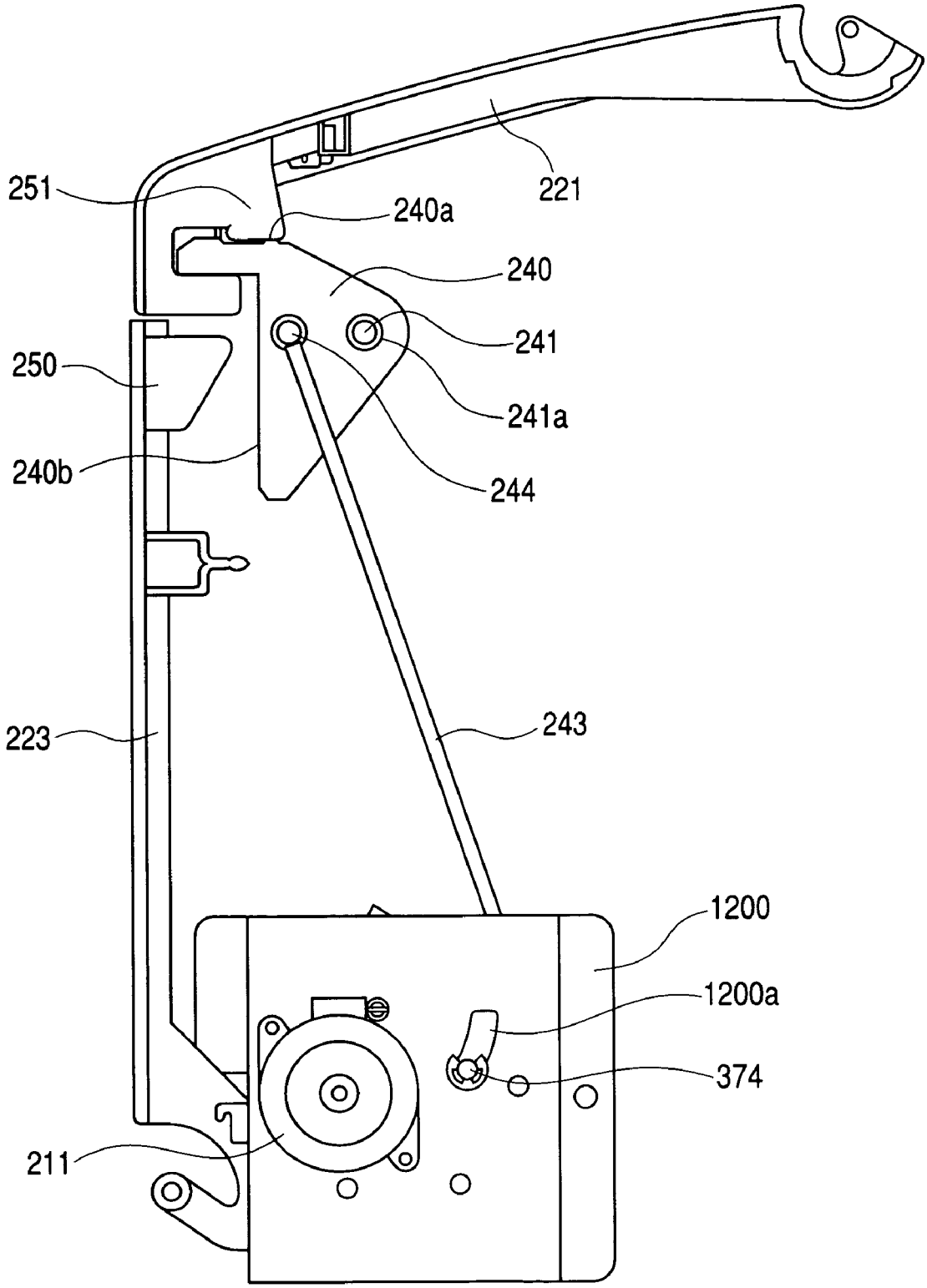
FIG. 36 is an explanatory view of the lift-up mechanism viewed form the outside in the third other embodiment of the elevating mechanism for the sheet tray.

First, a structure of a lift-up mechanism for raising and lowering the sheet tray 5, the upper cover 221, and the side cover 223 will be described with reference to FIGS. 35 and 36. FIG. 35 is a view of the lift-up mechanism viewed from the inside thereof. FIG. 36 is a view showing a positional relation between the upper cover 221 and the side cover 223.

Reference numeral 211 denotes a drive motor, which is a power source of the lift-up mechanism held by a drive side plate 1200. A motor gear shaft 372, a one-way gear shaft 373, an idler gear shaft 375, and a connection gear shaft 376 are provided in the drive side plate 1200. A motor gear 272, a one-way gear 273, an idler gear 275, and a connection gear 276 are attached to the respective shafts. A drive force generated by the drive motor 211 is transmitted from the motor gear 272 coupled to the drive motor 211 to the connection gear 276 through the one-way gear 253, the oscillating gear 274, and the idler gear 275. The rotation drive force transmitted to the connection gear 276 is transmitted to a winding shaft 281 of FIG. 27 to rotate the winding shaft 281. Wires 284 and 285 are wound by a wire drum 287 provided in the winding shaft 281 to raise the sheet tray 5.

Reference numeral 240 denotes a cover interlocking member serving as an interlocking member of the present invention, both ends of which are attached pivotably to a lever fulcrum 241, which is attached to the sheet feeding apparatus main body 2*a*, with the lever fulcrum 241 as a pivotal center. A first abutting portion 240*a*, which is capable of abutting against an upper cover abutting portion 251 provided in the upper cover 221, and a second abutting portion 240*b*, which is capable of abutting against a side cover abutting portion 250 provided in the side cover 223, are provided in the cover interlocking member 240. The cover interlocking member 240 is biased in a counterclockwise direction in FIG. 35 by a biasing spring 241*a* with the lever fulcrum 241 as a fulcrum and abuts against the upper cover abutting portion 251 or the side cover abutting portion 250, whereby movement of the cover interlocking member 240 is regulated. Therefore, the cover interlocking member 240 and the upper cover abutting portion 251 (or side cover abutting portion 250) abut with or separate from each other following opening and closing operations of the upper cover 221 (or side cover 223), whereby it is possible to move the cover interlocking member 240.

Reference numeral 242 denotes an oscillating sheet metal, which holds an oscillating gear shaft 374 provided with the oscillating gear 274 and is attached to an oscillating support shaft 260 so as to be oscillatable with the oscillating support shaft 260 as a fulcrum. The oscillating gear shaft 374 is inserted in a long hole 1200*a* which is formed in the drive side plate 1200, to be provided movable along the long hole 1200*a*. Thus, the oscillation of the oscillating sheet metal 242 is performed such that the oscillating gear shaft 374 moves along the long hole 1200*a* formed in the drive side plate 1200.

Reference numeral 243 denotes an oscillating link, one end of which is pivotably attached to a first link fulcrum 244 on the cover interlocking member 240 and the other end of which is pivotably attached to a second link fulcrum 245 on the oscillating sheet metal 242 at the respective fulcrums. Note that tray lowering means of the present invention is constituted by the upper cover abutting portion 251, the side cover abutting portion 250, the cover interlocking lever 240, the oscillating link 243, and the oscillating sheet metal 242.

Operations involved in the opening and closing of the upper cover 221 and the side cover 223 will be described.

In the state in which the upper cover 221 and the side cover 223 are closed shown in FIG. 35, since the drive gear 272, the one-way gear 273, the oscillating gear 274, the idler gear 275, and the connection gear 276 engage with each other, and a drive force of the drive motor 211 is transmitted to the connection gear 276, the sheet tray 5 is raised. In the state in which the upper cover 221 and the side cover 223 are closed as shown in FIG. 35, the sheet tray 5 is raised until it is detected by a paper surface detecting sensor U that an uppermost sheet supported in the sheet tray 5 has reached a predetermined sheet feeding position. Note that FIGS. 35 and 36 shows a state in which both the upper cover 221 and the side cover 223 are closed and, in this state, the cover interlocking lever 240 is in the first position of the present invention.

Figure 37:
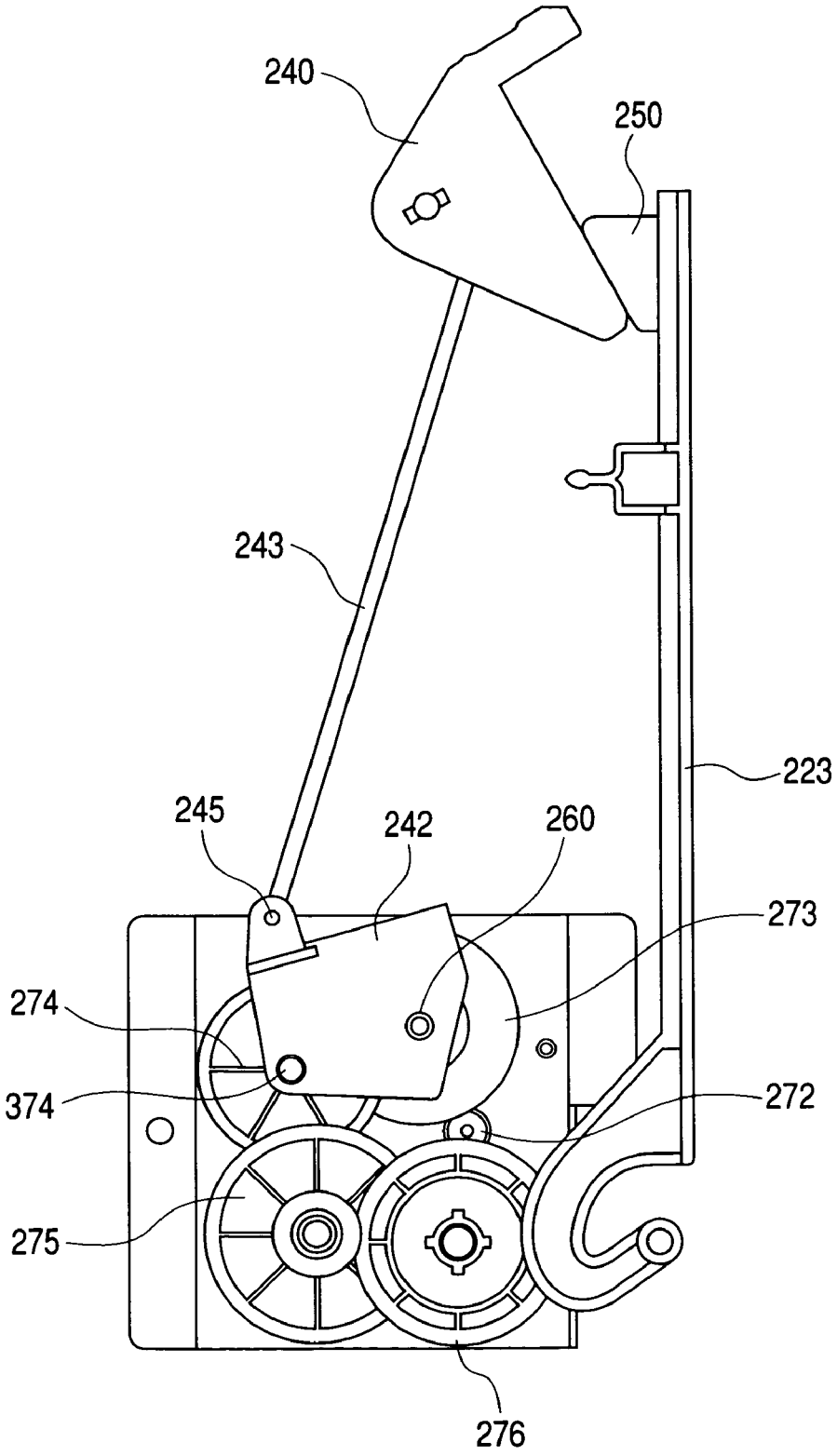
FIG. 37 is a schematic view showing a state in which an upper cover is opened and a side cover is closed in the third other example of the elevating mechanism for the sheet tray.

FIG. 37 shows a state in which the upper cover 221 is opened from the state shown in FIG. 35 in which the upper cover 221 and the side cover 223 are closed. By opening the upper cover 221, the upper cover abutting portion 251 abutting against the cover interlocking member 240 is separated from the cover interlocking member 240. The cover interlocking member 240 is pivoted in the counterclockwise direction in FIG. 35 by a biasing force of the biasing spring 241*a* to abut against the side cover abutting portion 250 and is stopped in the second position of the present invention.

The first link fulcrum 244 of the cover interlocking member 240 is also moved by the pivoting of the cover interlocking member 240 to move the oscillating link 243 upward. Following the upward movement of the oscillating link 243, the oscillating sheet metal 242 is oscillated in the clockwise direction in FIG. 35 with the oscillating support shaft 260 as an oscillation center. The oscillation gear 274 provided in the oscillation gear shaft 374 fixed to the oscillating sheet metal 242 is moved by the oscillation of the oscillating sheet metal 242, and the oscillating gear 274 and the idler gear 275 are disengaged. That is, since a part of a drive force transmission path from the drive motor 211 to the contact gear 276 is released by opening the upper gear 221, the tray sheet 5 falls to a lowermost position due to its own weight.

When the upper cover 221 is closed from a state in which the side cover 223 is closed, the upper cover abutting portion 251 and the cover interlocking member 240 abut with each other, and the upper cover abutting portion 251 pivots the cover interlocking member 240 in the clockwise direction in FIG. 14 against a biasing force of the biasing spring 241*a* to stop it in the first position. The oscillating link 243 is moved downward and the oscillating sheet metal 242 is oscillated in the counterclockwise direction with the oscillating support shaft 260 as a fulcrum by the pivoting of the cover interlocking member 240. Since the oscillating gear 274 and the idler gear 275 engage with each other according to the oscillation of the oscillating sheet metal 242, and a drive force of the drive motor 211 is transmitted, the sheet tray T is raised.

Figure 38:
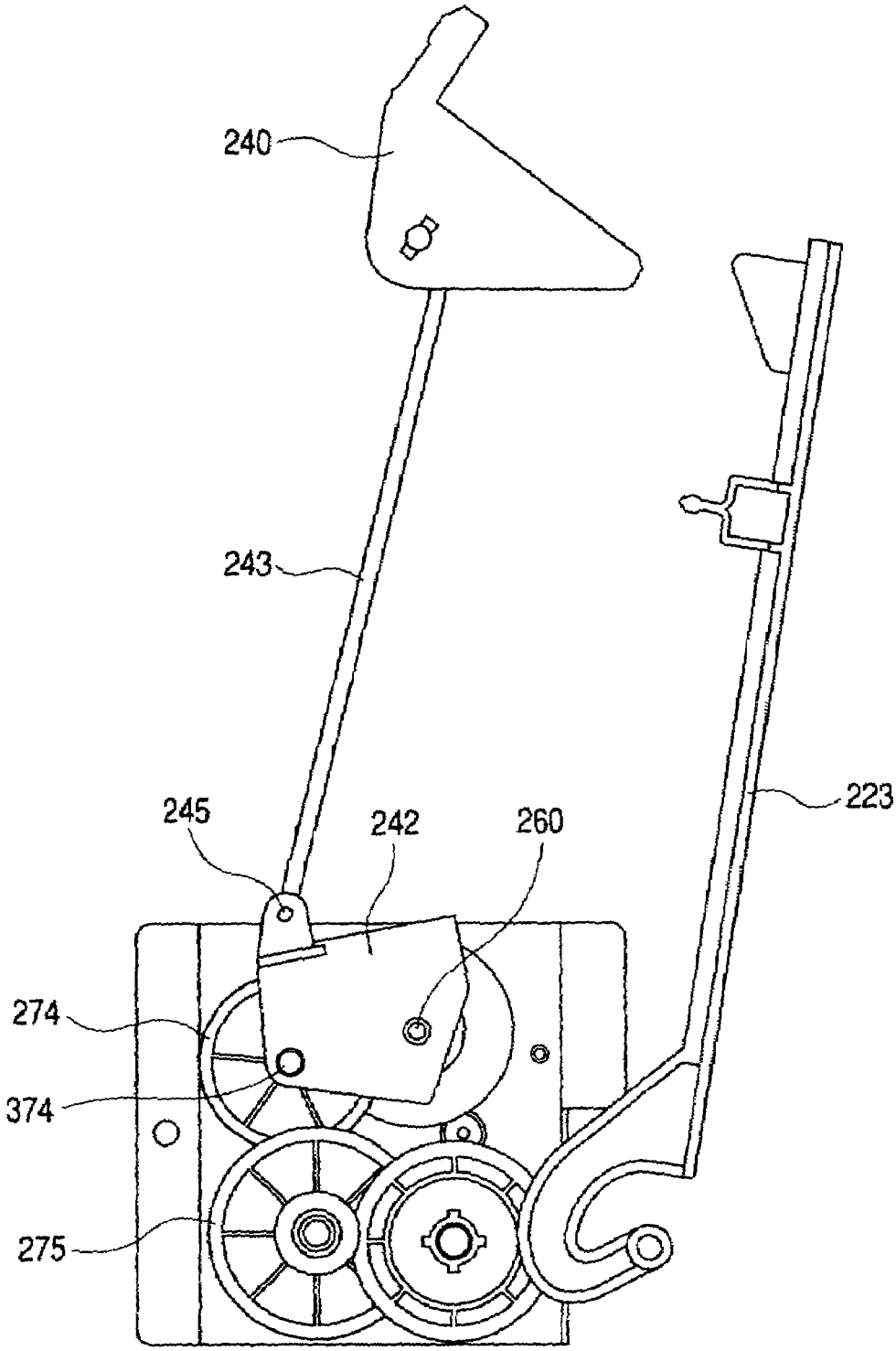
FIG. 38 is a schematic view showing a state in which the upper cover and the side cover are opened in the third other example of the elevating mechanism for the sheet tray.

FIG. 38 shows a state in which the side cover 223 is opened from the state shown in FIG. 37 in which the upper cover 221 is opened and the side cover 223 is closed. By opening the side cover 223 from the state in which the upper cover 221 is opened, the side cover abutting portion 250 and the second abutting portion 240*b* of the cover interlocking member 240 are separated from each other, and the cover interlocking member 240 is rotated in the counterclockwise direction by a biasing force of the biasing spring 241*a* and stopped in the third position of the present invention (state of FIG. 38). Even if the side cover 223 is opened and the cover interlocking member 240 is moved to the third position, the oscillating gear 274 and the idler gear 275 are kept disengaged.

Figure 39:
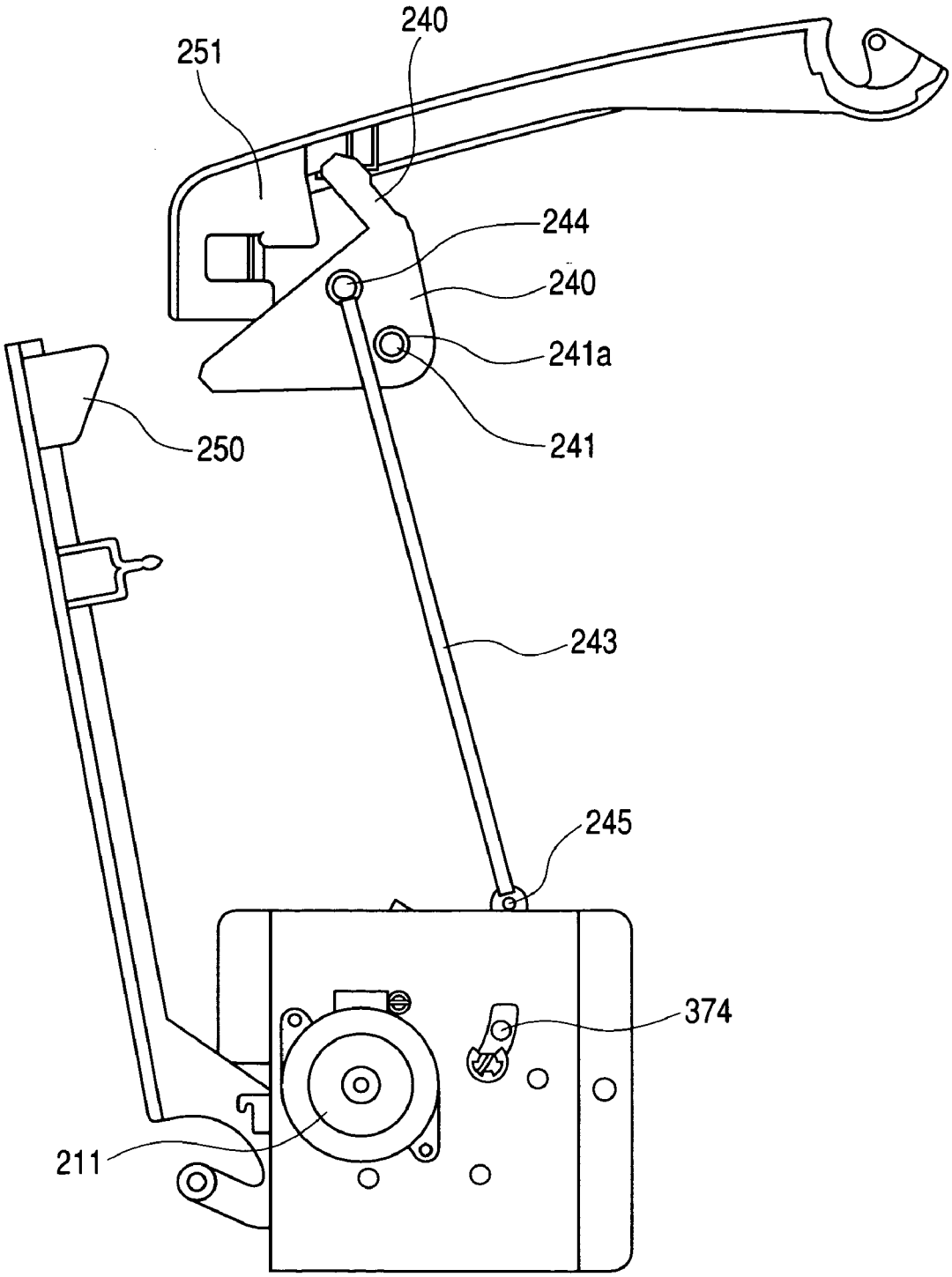
FIG. 39 is a view showing a state in which the upper cover is closed from a state in which the upper cover and the side cover are opened in the third other example of the elevating mechanism for a sheet tray.
Figure 40:
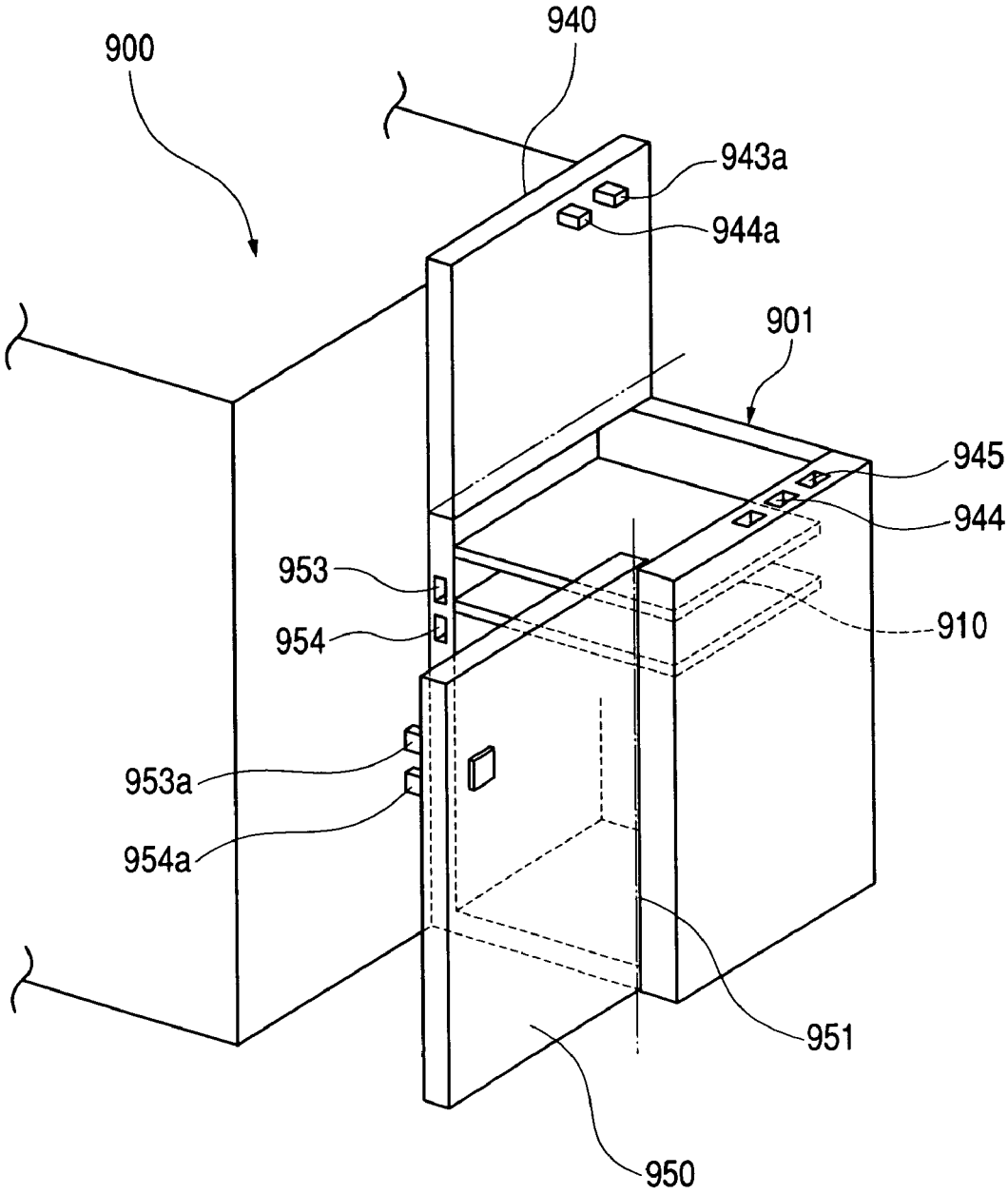
FIG. 40 is a schematic view of a conventional sheet feeding apparatus and a conventional image forming apparatus main body.

FIG. 39 shows a state in which the upper cover 221 is closed form the state shown in FIG. 38 in which the upper cover 221 and the side cover 223 are opened. When the cover interlocking lever 240 is in the third position shown in FIG. 38, even if the upper cover 221 is closed, the upper cover abutting portion 251 and the cover interlocking member 240 doe not engage with each other, and the cover interlocking member 240 is not moved by the upper cover abutting portion 251. Thus, the oscillating gear 274 and the idler gear 275 are kept disengaged. That is, even if the upper cover 221 is closed from a state in which the side cover 223 is opened, since the cover interlocking member 240 is not moved to the first position shown in FIG. 37, and the oscillating gear 274 and the idler gear 275 are kept disengaged, the sheet tray 5 is not raised.

In this example, effects characteristic of this example as described below are realized.

1. A sheet tray is not raised when any one of two covers is opened.
2. Since the cover interlocking lever 240 which is moved following the opening of the upper cover 221 and the side cover 223 is provided, and gears of a gear train transmitting a drive force for raising the sheet tray 5 according to movement of the cover interlocking lever 240 are engaged and disengaged to switch raising and lowering of the sheet tray 5, the switching of raising and lowering of a sheet tray according to opening and closing operations of two covers can be performed with a simple structure, and an inexpensive apparatus can be provided.

Note that, in this example, a structure is described in which only the oscillating gear 274 and the idler gear 275 are disengaged. However, since the cover interlocking lever 240 is further moved according to an operation for opening the side cover 223, the movement of the cover interlocking lever 240 following the opening of the side cover 223 may be utilized to disengage gears other than the gears disengaged according to the opening of the upper cover 221. For example, it is also possible to disengage the drive gear and the one-way gear following the opening of the upper cover 221 and disengage the oscillating gear and the idler gear 275 following the opening of the side cover 223.

A sheet feeding apparatus can be provided which is capable of preventing decrease in productivity in supplying sheets because the sheet feeding apparatus has an upper cover and a side cover capable of opening and closing for sheet supply and jam treatment, a sheet tray is stopped by opening the upper cover in a state in which the side cover is closed, and the sheet tray starts to be lowered according to the opening of the side cover in a state in which the upper cover is opened.

Note that, in this example, the cover detecting sensor 62 described in the first embodiment or the cover detecting sensor 73 described in the second embodiment may be further provided to interrupt power supply to the drive motor 211 in the case in which the cover detecting sensor detects that an upper cover or a side cover is opened.

Note that, in this example, movement of the cover interlocking member 240 at the time when the cover interlocking member 240 interlocks according to an opening operation of an upper cover and a side cover is the same as movement of the cover detection lever 71 at the time when the cover detection lever 71 interlocks according to an opening operation of an upper cover and a side cover in the second embodiment of the present invention. Thus, in this example, the cover detecting sensor described in the second embodiment may be further provided to detect the opening and closing of the upper cover and the side cover as described in the second embodiment by detecting a position of the cover interlocking member 240 with the cover detecting sensor. That is, when it is detected by the cover detecting sensor that the upper cover and the side cover are closed, the sheet tray 5 is raised until the sheet surface detection means U detects that an uppermost sheet of a sheet stack on the sheet tray 5 has been raised to a position for allowing feeding of the sheet. Then, when the upper cover is opened, the oscillating gear 274 and the idler gear 275 are disengaged by movement of the cover interlocking member 240 to lower the sheet tray 5.

What is claimed is:

1. A sheet feeding apparatus for containing sheets in an inside thereof, comprising:

a first cover and a second cover provided in an apparatus main body so as to be openable and closable; and a detecting sensor for detecting an opening or a closing of the first cover;

wherein said detecting sensor does not detect the closing of the first cover when the first cover is closed in a state in which the second cover is opened and detects the closing of the first cover when the first cover is closed in a state in which the second cover is closed, and wherein the detecting sensor is provided movably, and moves in a non-detection position where the closing of the first cover is not detected, according to an opening of the second cover, and moves to a detection position where the closing of the first cover can be detected, according to the closing of the second cover.

2. A sheet feeding apparatus according to claim 1, further comprising:

sheet supporting means which supports sheets and is capable of being raised and lowered;

a drive motor which generates a drive force for raising the sheet supporting means; and a gear train for transmitting the drive force of the drive motor to the sheet supporting means, wherein gears of the gear train are disengaged according to a movement of the moving member from the first position to the second position to lower the sheet supporting means.

3. A sheet feeding apparatus according to claim 1, further comprising an indication member which is provided movably in the first cover and indicates that the first cover is closed earlier than the second cover, wherein, when the first cover is closed in a state in which the second cover is not closed, the indication member moves to a position for indicating that the first cover is closed earlier than the second cover.

4. A sheet feeding apparatus according to claim 1, further comprising:

sheet supporting means which supports sheets contained in the inside of the apparatus main body;

sheet feeding means which feeds the sheets supported by the sheet supporting means; and elevating means which raises and lowers the sheet supporting means, wherein, when the detecting sensor detects the closing of the first cover, the sheet supporting means maintains a height for allowing sheet feeding, and when the detecting sensor detects that the first cover is opened, the sheet supporting means is lowered to a lowermost part.

5. A sheet feeding apparatus according to claim 1, further comprising regulating means which is capable of regulating an opening operation of the second cover in a state in which the second cover is closed, wherein the regulating means operates in association with the opening or the closing operation of the first cover, in a state in which the first cover is closed, the regulating member regulates the opening operation of the second cover, and in a state in which the first cover is opened, the regulating means does not regulating the opening or the closing operation of the second cover.

6. A sheet feeding apparatus according to claim 1, further comprising:

sheet supporting means which supports sheets and is capable of being raised and lowered;

a drive motor which generates a drive force for raising the sheet supporting means; and a gear train for transmitting the drive force of the drive motor to the sheet supporting means, wherein the sheet supporting means falls due to its own weight as gears of the gear train are disengaged according to an opening operation of the first cover, and even if the first cover is closed in a state in which the second cover is opened, a state in which the gears of the gear train are disengaged by the opening operation is maintained.

7. A sheet feeding apparatus for containing sheets in the inside thereof, comprising:

a first cover and a second cover which are which are provided in an apparatus main body so as to be openable and closable;

a moving member which moves following an opening or a closing operation of one of the first cover and the second cover;

a detecting sensor which is provided in the apparatus main body an turned ON or OFF by the moving member, wherein, when the second cover is closed, the moving member is moved to a position where the closing of the first cover can be detected by the detecting sensor, and when the second cover is opened, the moving member is moved to a position where the closing of the first cover is not detected by the detecting sensor, sheet supporting means which supports sheets and is capable of being raised and lowered;

a drive motor which generates a drive force for raising the sheet supporting means; and a gear train for transmitting the drive force of the drive motor to the sheet supporting means, wherein it is possible to disengage gears of the gear train following movement of the moving member to lower the sheet supporting means, the moving member is movable to a first position where the detecting sensor detects the closing of the first cover and a second position where the detecting sensor does not detect the closing of the first cover and, in a state in which the second cover is closed, the moving member moves from the first position to the second position following the opening of the first cover and moves from the second position to the first position following the closing of the first cover, when the second cover is opened after the first cover is opened, the moving member moves to a third position where the detecting sensor does not detect the closing of the first cover from the second position, when the second cover is closed, the moving member moves from the third position to the second position and, even if the first cover is closed when the moving member is in the third position, the moving member does not move to the first position, when the moving member is in the first position, the gears of the gear train engage with each other, and when the moving member is in the second position and the third position, the gears of the gear train are disengaged and the sheet supporting means falls.

* * * * *

UNITED STATES PATENT AND TRADEMARK OFFICE

CERTIFICATE OF CORRECTION

PATENT NO. : 7,029,006 B2
APPLICATION NO. : 10/601529
DATED : April 18, 2006
INVENTOR(S) : Makoto Izumi et al.

It is certified that error appears in the above-identified patent and that said Letters Patent is hereby corrected as shown below:

COLUMN 4:
Line 22, “form” should read --from--.

COLUMN 10:
Line 38, “an enlarged view” should read --enlarged views--.

COLUMN 16:
Line 27, “indicates” should read --indicate--.

COLUMN 17:
Line 62, “shows” should read --show--.

COLUMN 19:
Line 25, “operations” should read --operation--.

COLUMN 23:
Line 20, “shows” should read --show--.

COLUMN 26:
Line 19, “regulating” should read --regulate--.
Line 39, “which are” (2nd occurrence) should be deleted.
Line 46, “an” should read --and--.

Signed and Sealed this

Twenty-fourth Day of October, 2006

JON W. DUDAS
*Director of the United States Patent and Trademark Office*